US008733224B2

(12) United States Patent
Lasichak et al.

(10) Patent No.: US 8,733,224 B2
(45) Date of Patent: May 27, 2014

(54) AMMUNITION FEED SYSTEM FOR FIREARM

(71) Applicant: Meninas Inc., Las Vegas, NV (US)

(72) Inventors: Andrea J. Lasichak, Gregory, MI (US); Thomas E. Quetschke, Toledo, OH (US); Kenneth D. Woodard, Lambertville, MI (US)

(73) Assignee: Meninas Inc., Las Vegas, NV (US)

( * ) Notice: Subject to any disclaimer, the term of this patent is extended or adjusted under 35 U.S.C. 154(b) by 0 days.

(21) Appl. No.: 13/874,001

(22) Filed: Apr. 30, 2013

(65) Prior Publication Data

US 2014/0076137 A1 Mar. 20, 2014

Related U.S. Application Data

(63) Continuation of application No. 12/800,822, filed on May 24, 2010, now Pat. No. 8,448,558.

(60) Provisional application No. 61/280,810, filed on Nov. 9, 2009.

(51) Int. Cl.
*F41A 9/75* (2006.01)

(52) U.S. Cl.
USPC ..... 89/33.02; 89/33.01; 42/49.01

(58) Field of Classification Search
USPC ..... 89/33.01, 33.02, 33.1, 33.17, 33.16, 89/33.25; 42/49.01, 19, 49.02, 50
See application file for complete search history.

(56) References Cited

U.S. PATENT DOCUMENTS

| | | | | | |
|---|---|---|---|---|---|
| 1,921,871 | A | * | 8/1933 | Gaidos | 42/50 |
| 2,131,412 | A | * | 9/1938 | Ostman | 42/49.01 |
| 2,321,720 | A | * | 6/1943 | Whittaker | 42/50 |
| 2,394,606 | A | * | 2/1946 | Gazda | 89/34 |
| 4,332,097 | A | * | 6/1982 | Taylor, Jr. | 42/50 |
| 4,384,508 | A | | 5/1983 | Sullivan et al. | |
| 4,413,546 | A | * | 11/1983 | Taylor, Jr. | 89/33.02 |
| 4,658,700 | A | | 4/1987 | Sullivan | |
| 4,689,907 | A | * | 9/1987 | Gwinn, Jr. | 42/50 |
| 4,745,842 | A | * | 5/1988 | Shou-Fu | 89/33.02 |
| 4,888,898 | A | | 12/1989 | Miller et al. | |
| 4,926,742 | A | | 5/1990 | Ma et al. | |
| 4,947,572 | A | | 8/1990 | Miller et al. | |

(Continued)

OTHER PUBLICATIONS

International Search Report and Written Opinion for International Application No. PCT/US2011/000924 Filed May 24, 2011.

(Continued)

*Primary Examiner* — Jonathan C Weber
(74) *Attorney, Agent, or Firm* — Warn Partners, P.C.

(57) ABSTRACT

The present invention is a firearm cartridge feeding system to automatically feed firearm cartridges in a successive order one diameter of a firearm cartridge at a time, to the chamber of a bolt action, semi-automatic, or fully automatic firearm until all firearm cartridges in the system are expended. The firearm cartridges are stored in a tight spiral channel side by side to maximize the use of the peripheral space surrounding the area of a magazine well or feed point of a firearm. The housing or body of the firearm feeding system consists of a multiple segment body or housing. The housing contains a spiral channel, clutch mechanism pocket and a spring drive compartment which supports the storage of firearm cartridges and the arrangement of a drive system for feeding the firearm cartridges to the feed lips.

29 Claims, 35 Drawing Sheets

(56) References Cited

U.S. PATENT DOCUMENTS

| | | | | | |
|---|---|---|---|---|---|
| 4,962,604 | A | | 10/1990 | Miller et al. | |
| 4,965,951 | A | | 10/1990 | Miller et al. | |
| 5,056,252 | A | * | 10/1991 | Velezis | 42/50 |
| 5,353,679 | A | | 10/1994 | Nordmann | |
| 5,398,590 | A | | 3/1995 | Snyder, Sr. | |
| 5,456,153 | A | * | 10/1995 | Bentley et al. | 89/33.02 |
| 5,816,444 | A | | 10/1998 | David | |
| 5,905,224 | A | | 5/1999 | Jordan | |
| 5,929,366 | A | | 7/1999 | Kennedy | |
| 7,806,036 | B2 | * | 10/2010 | Cook et al. | 89/33.02 |
| 7,942,091 | B2 | * | 5/2011 | Winge | 89/33.02 |
| 8,037,800 | B2 | * | 10/2011 | Snow | 89/33.02 |
| 8,220,377 | B2 | | 7/2012 | Quetschke et al. | |
| 2011/0203448 | A1 | * | 8/2011 | Emde | 89/33.02 |
| 2012/0117840 | A1 | | 5/2012 | Chewning et al. | |

OTHER PUBLICATIONS

International Search Report and Written Opinion for International Application No. PCT/US2010/002928 Filed Nov. 9, 2010.

How the X-Series Coil Magazine Operates: [online]. X-Series Magazine—Exploring the inner operation—XS Products [retrieved on Nov. 1, 2011]. Retrieved from Internet: <URL: www.xs-products.com/x-series-magazine-exploring-the-inner-operation>.

* cited by examiner

AMMUNITION FEED SYSTEM FOR FIREARM

CROSS-REFERENCE TO RELATED APPLICATIONS

This application is a continuation of U.S. patent application Ser. No. 12/800,822, filed May 24, 2010. This application claims the benefit of U.S. Provisional Application No. 61/280,810, filed Nov. 9, 2009. The disclosures of the applications are incorporated herein by reference.

FIELD OF THE INVENTION

This invention is directly related to firearms, and the feeding of non-linked cartridges in semi-automatic and automatic small arms. More particularly, the invention expands on the capacity of cartridges that can be fed into a firearm without having to change magazines as frequently.

BACKGROUND OF THE INVENTION

Since the discovery of gunpowder in the ninth century, and the invention of firearms in the tenth century, firearms have made significant advancements. Single shot, single barreled, muzzle loading flintlock musket firearms of the late 1700's and early 1800's were a great advancement in the history of firearms, but they did not offer the marksman with a quick subsequent shot(s). If the target was missed and the marksman wanted to reload, a time consuming process of reloading involved pouring gunpowder down the barrel, and ramming a projectile on top of the powder, followed by priming the breach before being able to fire once again. In a life or death situation, the time to reload was unacceptable.

The quest for a faster second shot or in reality a faster reload for any number of shots, was found to be a feature that is extremely desirable. In approximately 1860, a single barreled "repeating rifle" (a rifle in which could be reloaded by operating a lever as fast as a marksman could actuate it) using a cartridge was patented. This was the beginning of the multiple cartridge magazine and fast loading/reloading firearms.

Today, many modern firearms use box magazines containing many cartridges. Most box type magazines stack cartridges that lay horizontal relative to the barrel of the firearm in a rectangular magazine, but in a vertical stack. That is to say that the cartridges are laying on their sides, one stacked on top of another, and feed upward in a channel within a somewhat rectangular-shaped magazine in the position in which they are fed into the chamber of the firearm.

However, the capacity of box type magazines are limited because they have the physical characteristic of extending significantly below the firearm. Additionally, drum type magazines in some cases offer a higher cartridge capacity in a shallower area below a firearm, but normally offer only one method of loading. Also many drum type magazines become jammed and fail to feed, and it is difficult to correct the jammed drum type cartridges.

A deviation of the standard box magazine is a "banana" shaped box magazine which does help limit some of the protrusion of the magazine below the firearm, and provides a greater cartridge capacity. The curvature of this type of magazine is generally towards the muzzle of the firearm.

Additionally, many of these conventional box magazines or drum magazines include one or more springs for applying tension to the cartridges to ensure that the cartridges load transfer from the magazine to the firearm properly. As with a conventional box magazines or drum magazines, when a magazine is stored with cartridges loaded into the magazine, the spring becomes weakened because of the constant tension being placed on the follower spring for long periods of time. The spring has a tendency to take a "set" and become less powerful.

Accordingly there exists a need for a magazine for use with various types of firearms which overcome the current drawbacks of conventional magazines.

SUMMARY OF THE INVENTION

The present invention is a firearm cartridge feeding system that feeds non-linked cartridges to semi-automatic and automatic small arms. It is designed to replace the boxed-type magazine and the drum-type magazine in firearms designed to accept boxed-type and drum-type magazines.

The outward appearance of the feeding system of the present invention is round or somewhat circular in appearance. However, it is within the scope of the invention that the feeding system may be shaped differently to other shapes to meet fastener and other equipment requirements.

The firearm cartridge feeding system of the present invention is adaptable to any weapon that receives a box or drum type magazine. In one embodiment, the body of the invention has two distinct compartments. One compartment is designed to house the power spring, sometimes called a clock spring, and the second compartment sits behind the spring compartment and is separated by a firewall, which holds the cartridges in a spiral channel. In one embodiment of the present invention, the spiral channel is of the single stack type, and in other embodiments, the spiral channel is a double stack type.

The firearm cartridge feeding system, when inserted into a weapon with the magazine well opening at the bottom of the firearm, feeds cartridges from the spiral channel into a chamber positioning channel, and then to the feed lips. With the cartridges positioned as to feed into the chamber of a firearm, the cartridges are stripped from the feed lips by the firearm's loading mechanism.

The firearm cartridge feeding system of the present invention stores cartridges in a spiral channel or groove within a housing that is optionally offset in an angular direction tangent to the magazine well. This is to compact a greater number of cartridges in an area which is not obstructive or less obstructive to the operation of a firearm, compared to the number of cartridges available in a conventional box magazine or a conventional drum-type magazine.

In one embodiment of the feeding system of the invention, cartridges are easily loaded into the firearm cartridge feeding system by inserting cartridges at the feed lips, and/or the firearm cartridges are loaded by placing cartridges directly into the spiral channel after removing the spiral cover of the housing.

Loading the firearm cartridge feeding system by removing the spiral cover of the housing for loading the spiral channel provides a distinct advantage over prior art designs. With some designs of the firearm cartridge feeding system of the present invention, a number of cartridges can be "dumped" into a formed loading bowl (raised lip around the spiral to retain cartridges) around the spiral and then shaken by the user to quickly orientate the cartridges in the spiral. Because of the physical design and shape of some cartridges, they fall into the spiral correctly orientated for use.

The firearm cartridge feeding system of the present invention includes a cam stop winding knob which allows the user to only wind the power spring in one direction. The winding knob also acts as a pawl to prevent the power spring from unwinding before the user desires the spring tension to be released. This is accomplished by using a set of cam stop bearings disposed in a set of cam bearing pockets formed as part of a cam stop winding knob power spring pocket retainer.

The spring tension on the spiral following cartridge drive arm, which drives the cartridges through the spiral, is relieved by pressing a clutch release push button, which in turn disengages the power spring drive shaft from the encapsulated spring clutch mechanism.

The present invention also includes a power spring drive shaft assembly which is incorporated into the encapsulated spring clutch mechanism. When the clutch release push-button is pressed, it disengages a power spring primary drive shaft pin from a set of encapsulated spring clutch mechanism castle cover locking notches, and allows spring tension to be released from the spiral follow cartridge drive arm.

Once the firearm cartridge feeding system has been loaded and spring tension has been put on the cartridges to feed through the spiral by winding the cam stop winding knob with power spring pocket, the firearm cartridge feeding system is easily unloaded using one of two methods. One method that is used to remove the cartridges is to push the first cartridge exposed at the feed lips in a forward direction as if the cartridge were being stripped from the feed lips by a firearm. A second more expeditious method of unloading the firearm cartridge feeding system is to relieve spring tension on the spiral following cartridge drive arm by pressing the clutch release push button, removing the spiral cover and underlying drive components, and dump the cartridges from the spiral.

Another advantage of the present invention is that the firearm cartridge feeding system is able to be loaded with cartridges and stored for long periods of time without damaging the power spring because it can be stored with little or no tension on the power spring. The user needs only to wind the cam stop winding knob to place tension on the power spring and to make the firearm cartridge feeding system ready for use. This provides for tension to be applied to the power spring only when necessary, extending the life of the power spring.

The firearm cartridge feeding system is primarily constructed from composite materials which aid in contributing to the lightweight, weather resistant, and natural lubricity of the space age materials. However, some components such as the springs are made of metals. The metal components are made of materials that resist rust and corrosion.

Further areas of applicability of the present invention will become apparent from the detailed description provided hereinafter. It should be understood that the detailed description and specific examples, while indicating the preferred embodiment of the invention, are intended for purposes of Figure only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
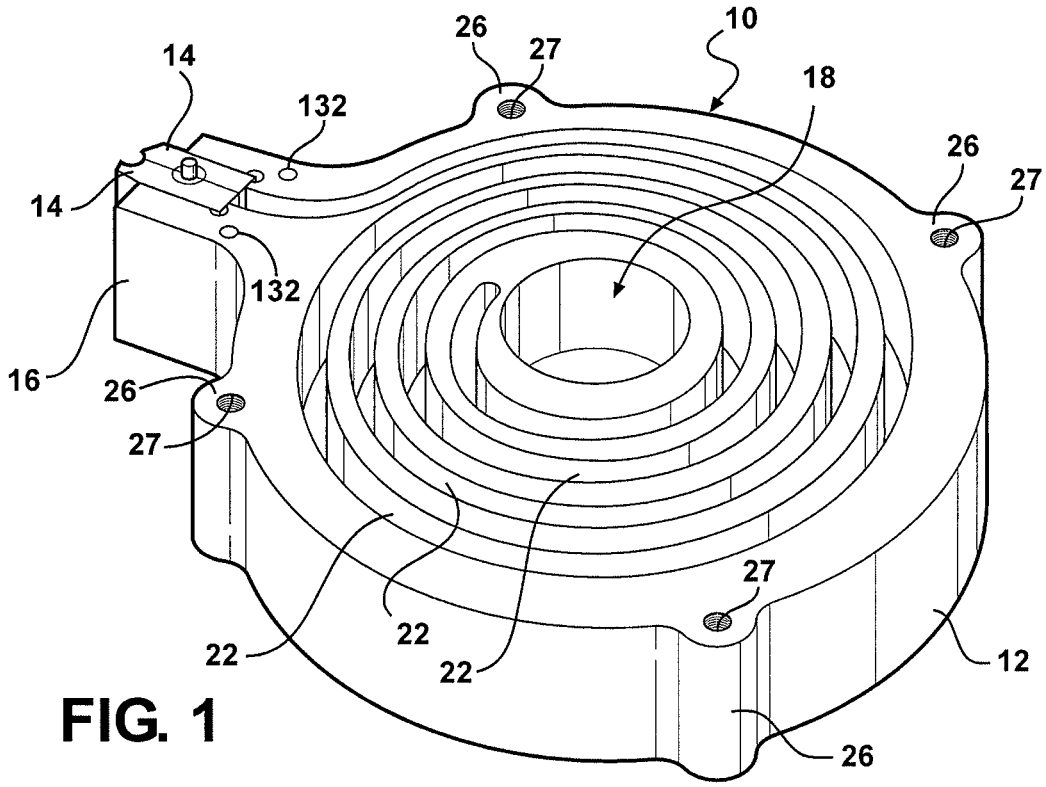
FIG. 1 is a first perspective view of a body portion for a firearm ammunition feeding system, according to the present invention.
Figure 2:
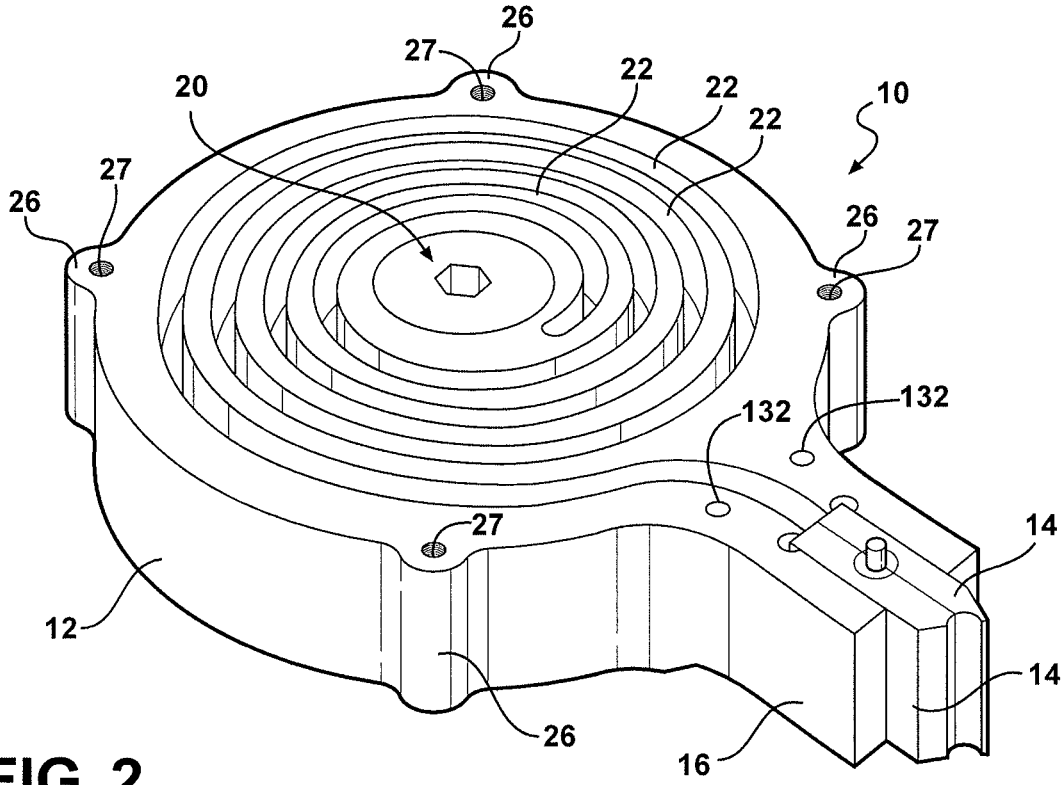
FIG. 2 is a second perspective view a body portion with an encapsulated spring clutch mechanism installed to full depth in the center of the body portion, used in a firearm ammunition feeding system, according to the present invention.

The following description of the preferred embodiment(s) is merely exemplary in nature and is in no way intended to limit the invention, its application, or uses.

An ammunition feed system is shown in the Figures according to the present invention, generally at 10. The basic housing or body 12 of the system includes feed lips 14 installed at a neck 16 of the body 12. Also included is a larger opening or pocket, shown generally at 18, in the center of the body 12 which is for the insertion of an encapsulated spring clutch mechanism, generally shown at 20. Also shown in the Figures is a spiral channel 22 which is used to contain a plurality of firearm cartridges, generally shown at 24. On the outside of the body 12 are projections 26 having threaded apertures 27 used to fasten a spiral cover 28 to the housing 12. In alternate embodiments, the projections 26 are of different shapes and forms, depending upon the fasteners used. A firewall 30 (best seen in FIGS. 1-7), separates the spiral channel 22 from a power spring drive shaft compartment 48, and is located opposite spiral channel 22. The spiral channel 22 does not penetrate the firewall 30; however, in alternate embodiments there are penetrations or apertures in the firewall 30 in selected locations to allow fluid draining if the system 10 becomes contaminated with a fluid. In still another embodiment, drain holes are placed in the spiral compartment and housing or body 12 to drain fluid.

While the housing or body 12 is shown in the Figures, in an alternate embodiment, a slightly raised lip to form a bowl is placed around the spiral channel 22 to prevent cartridges 24 from rolling off of the spiral area when loading the cartridges 24. Firearm cartridges 24 are loaded directly into the spiral channel 22 with the spiral channel 22 oriented spiral side up and horizontal to the ground, or the cartridges 24 are removed from the spiral channel 22 when the body 12 is placed spiral side down and in a horizontal position. In another alternate embodiment, the system 10 is manufactured with a shortened feed neck 216 to accept multiple feed neck extensions with unique feed lips to mate to different firearms when the caliber of the firearm is in common.

Figure 5:
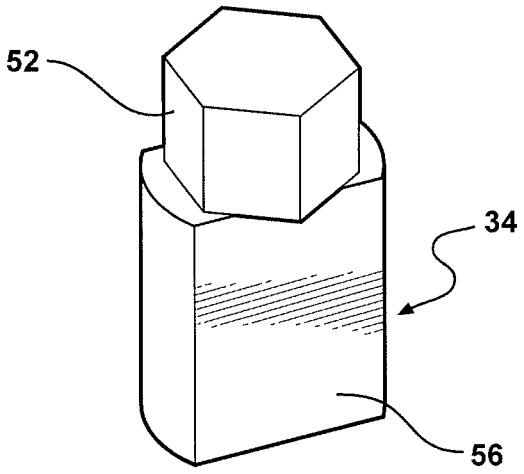
FIG. 5 is a perspective view of an encapsulated spring clutch mechanism secondary drive shaft used for a firearm ammunition feeding system, according to the present invention.

Also shown in the center of the encapsulated spring clutch mechanism 20 is an opening 32 which receives an encapsulated spring clutch mechanism secondary drive shaft 34. The secondary drive shaft 34 inserts into this opening 32 and in turn drives a spiral following cartridge drive arm 36. The secondary drive shaft 34 includes a hex end 52 which mates or inserts into the encapsulated spring clutch mechanism hex drive opening 32, while a double flat key end 56 extends through an elongated aperture 114 formed as part of the drive arm 36, and turns the spiral following cartridge drive arm 36 when assembled. The hex drive opening 32 is part of an encapsulated spring clutch mechanism cup 98. In an alternate embodiment, the encapsulated spring clutch mechanism secondary drive shaft 34 is integral to the encapsulated spring clutch mechanism cup 98, instead of being separate, as shown in FIG. 5.

Figure 3:
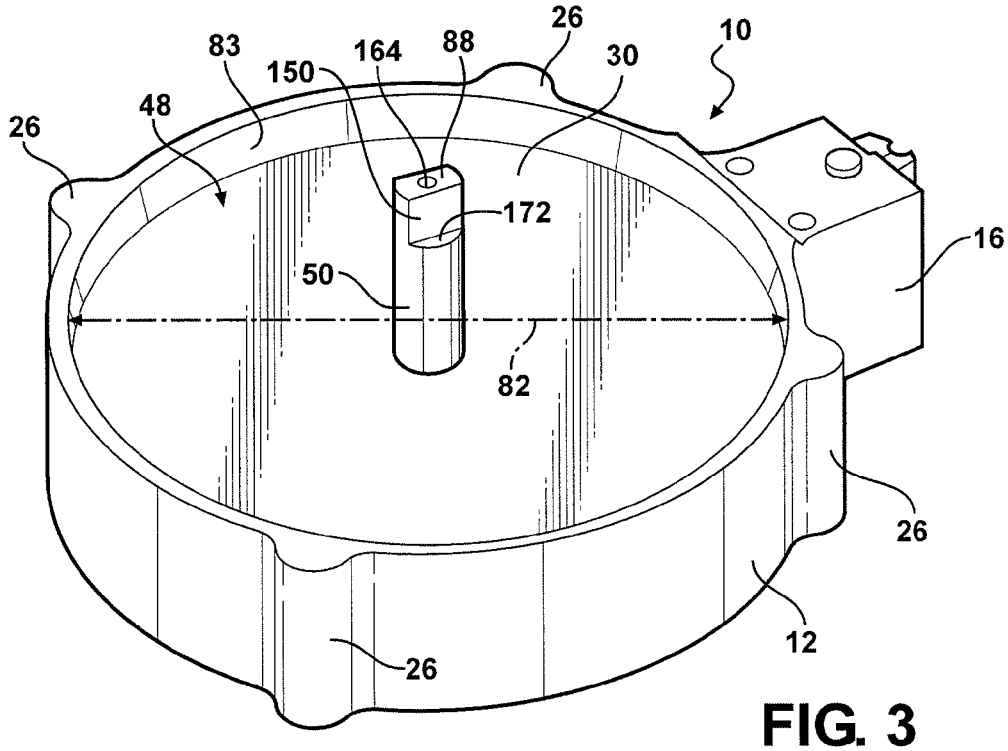
FIG. 3 is a third perspective view of a body portion used in a firearm ammunition feeding system, according to the present invention.
Figure 4:
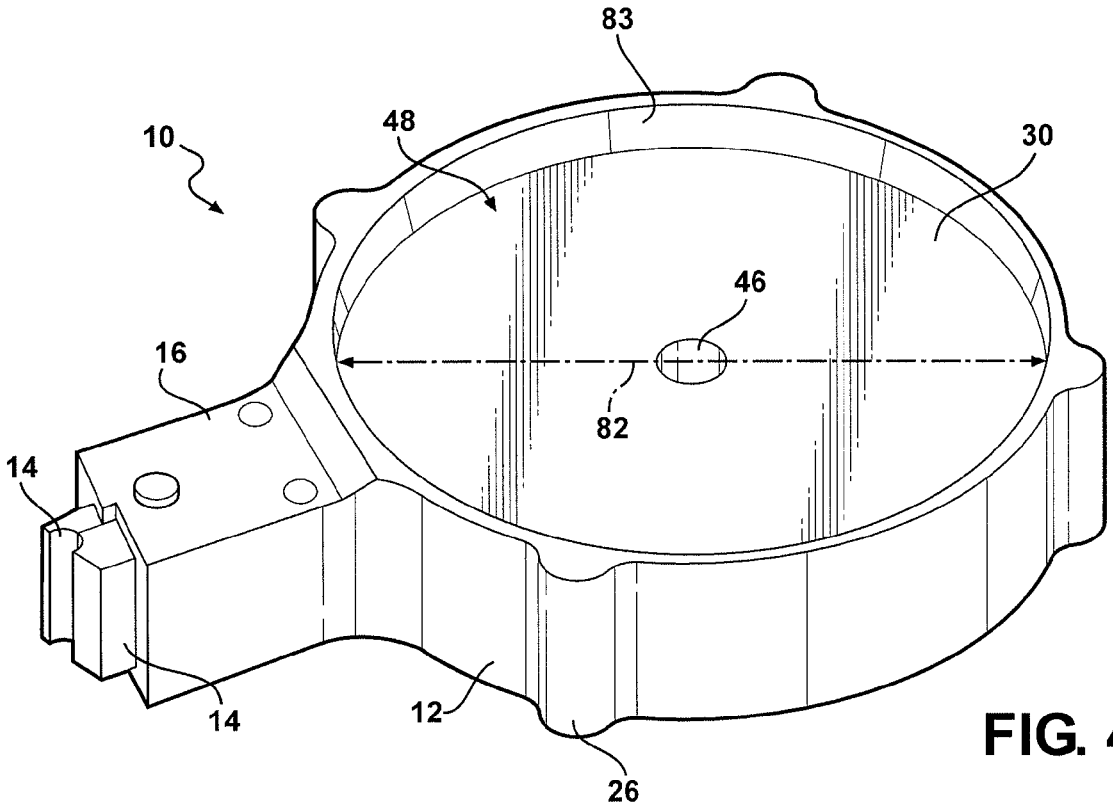
FIG. 4 is a fourth perspective view of a body portion used in a firearm ammunition feeding system, according to the present invention.

FIGS. 3 and 4 shows the opposite side of the body 12 in relation to the spiral channel 22. This side of the body 12 houses the power spring assembly 64, a cam stop winding knob 38 with power spring pocket 40, a plurality of cam stop bearings 42, and a power spring drive shaft 50 which protrudes through a power spring drive shaft opening 46 centered in the power spring compartment 48. The firewall 30 forms part of the power spring compartment 48.

Figure 6:
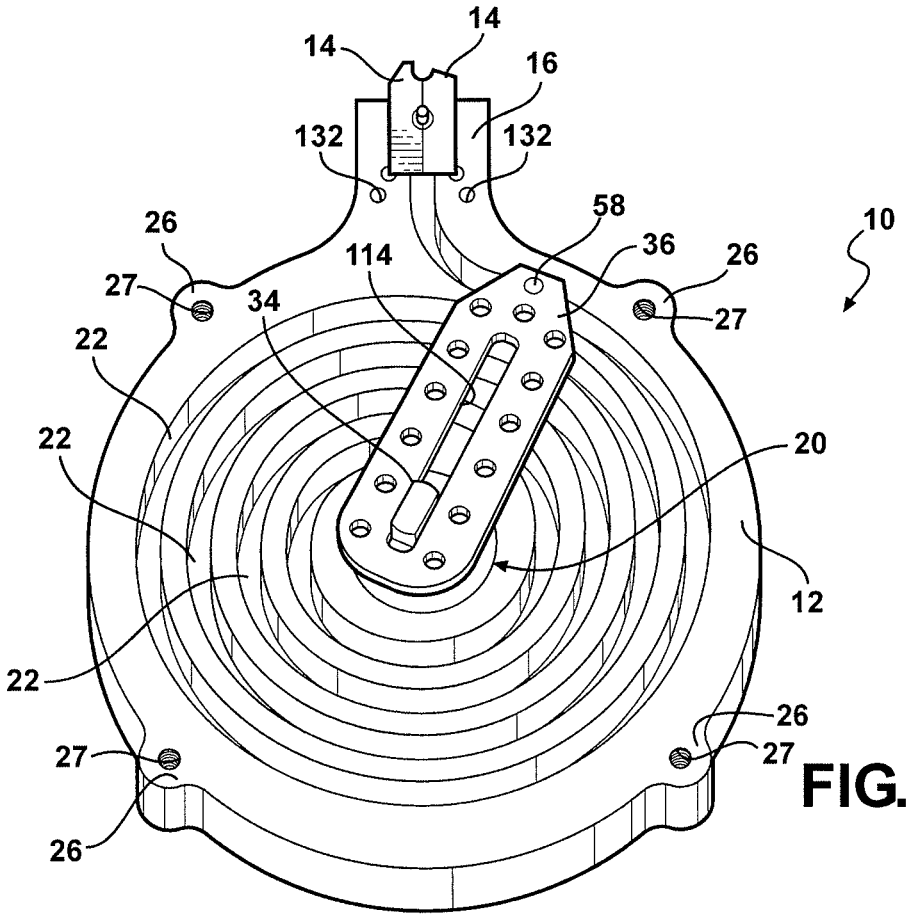
FIG. 6 is a perspective view of a body portion of a firearm ammunition feeding system with a spiral following cartridge drive arm in a fully extended position, according to the present invention.
Figure 7:
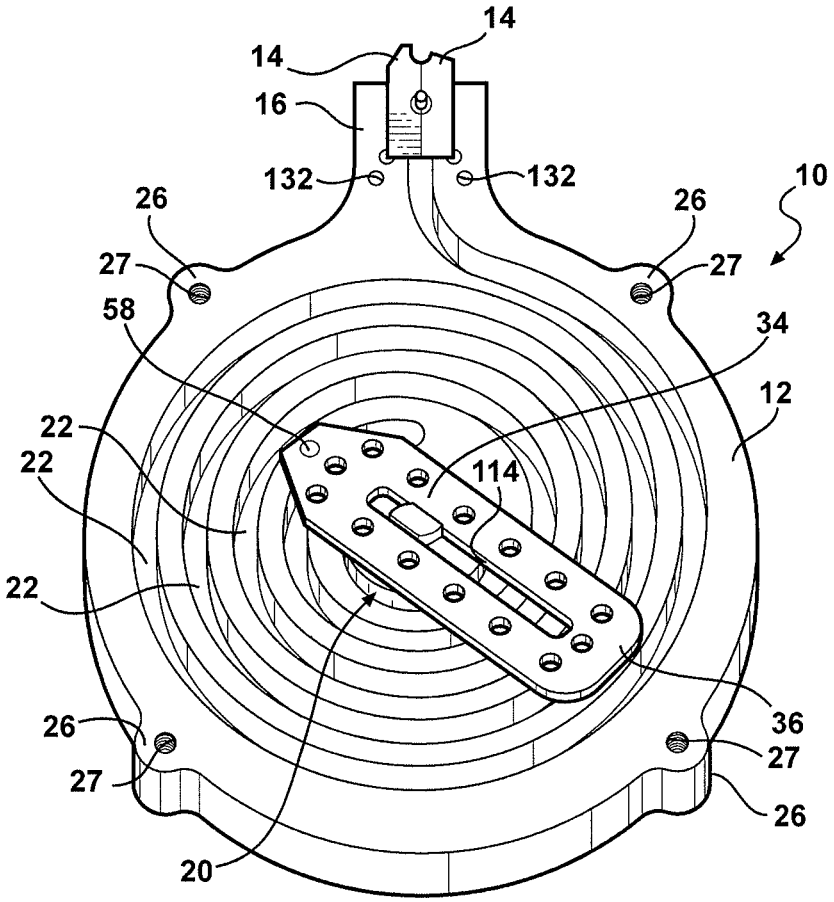
FIG. 7 is a perspective view of a body portion of a firearm ammunition feeding system with a spiral following cartridge drive arm in a fully retracted position, according to the present invention.
Figure 10:
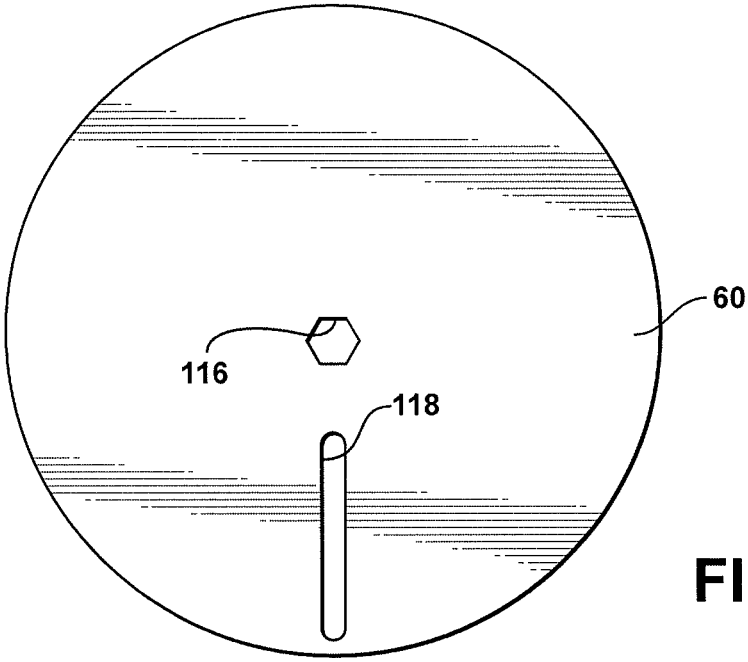
FIG. 10 is a top view of a cartridge cover plate used in a firearm ammunition feeding system, according to the present invention.

Referring to FIGS. 6 and 7, the encapsulated spring clutch mechanism 20, the encapsulated spring clutch mechanism secondary drive shaft 34, the spiral following cartridge drive arm 36, and the spiral following cartridge drive arm pin 58 are shown assembled to the body 12. The feed system 10 also includes a cartridge cover plate 60 (shown in FIGS. 8 and 10), which has been omitted in FIG. 6 so that the relationship of the encapsulated spring clutch mechanism 20 to the spiral following cartridge drive arm 36 is better understood. FIG. 6 shows the spiral following cartridge drive arm 36 fully extended and at the end of it's travel when pushing cartridges 24 out of the system 10. FIG. 7 shows the firearm ammunition feeding system 10 having the spiral following cartridge drive arm 36 and spiral following cartridge drive arm pin 58 in the fully retracted position (this position is normal when the system 10 is fully loaded with firearm cartridges 24 or ready to be loaded with firearm cartridges 24).

It should also be noted that in FIG. 7 the encapsulated spring clutch mechanism 20 is slightly elevated to be seen more clearly, however the normal position for the encapsulated spring clutch mechanism 20 is fully seated in the encapsulated spring clutch mechanism pocket 18.

Figure 8:
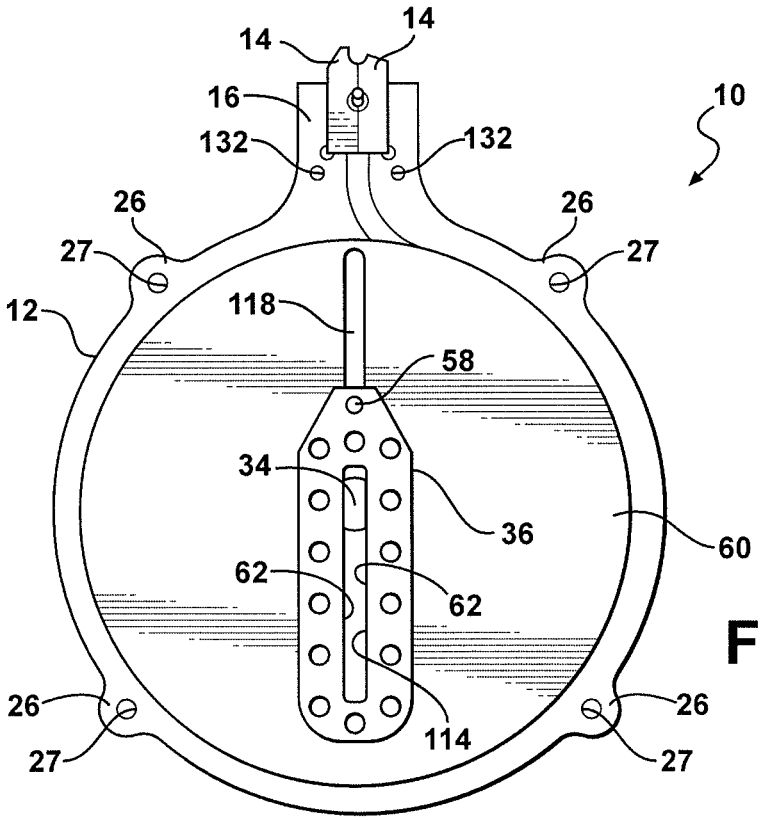
FIG. 8 is a perspective view of a body portion of a firearm ammunition feeding system with a spiral following cartridge drive arm in a fully retracted position and a cartridge cover plate assembled to the body portion, according to the present invention.
Figure 9A:
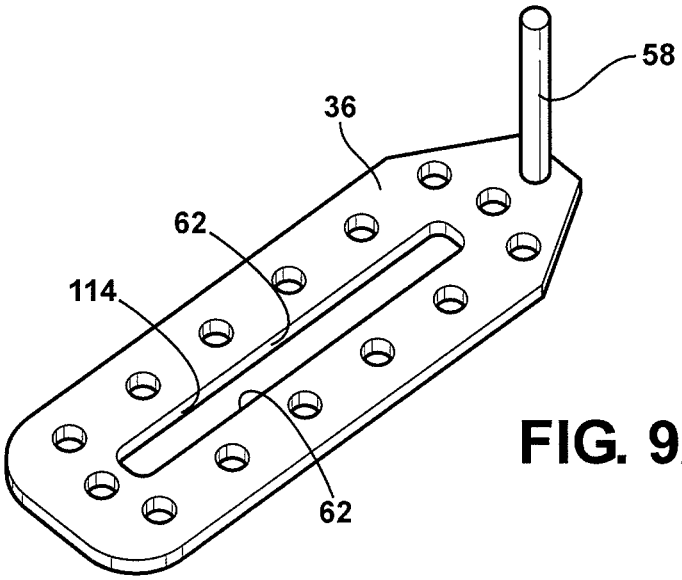
FIG. 9A is a first perspective view of a spiral following cartridge drive arm used in a firearm ammunition feeding system, according to the present invention.
Figure 9B:
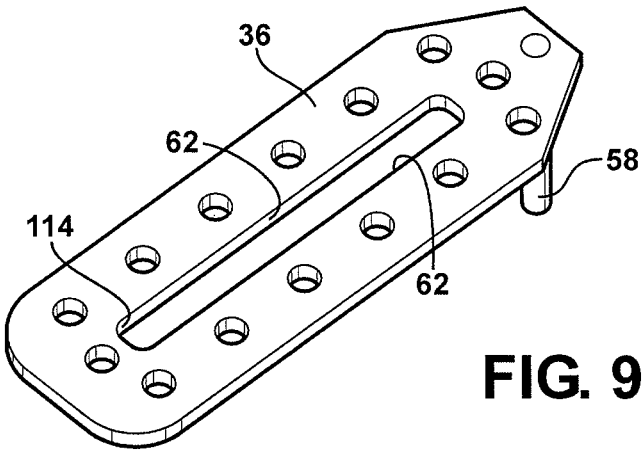
FIG. 9B is a second perspective view of a spiral following cartridge drive arm used in a firearm ammunition feeding system, according to the present invention.

It can be seen in FIG. 8 that the cartridge cover plate 60 is installed in the correct position under the spiral following cartridge drive arm 36. Referring again to the Figures generally, the plate 60 includes a cartridge cover plate secondary drive shaft center or central aperture 116 through which the secondary drive shaft 34 extends, and an elongated aperture 118 which the spiral following cartridge drive arm pin 58 extends through when the plate 60 is installed. In this embodiment, the aperture 116 is of the same shape as the cross-section as the hex end 52 of the shaft 34 such that the plate 60 rotates with the shaft 34. However, in alternate embodiments, the cartridge cover plate secondary drive shaft center 116 is of any desired shape, and does not have to be driven by the encapsulated spring clutch mechanism secondary drive shaft 34.

The plate 60 retains firearm cartridges 24 in the spiral channel 22 of the body 12, while allowing the spiral following cartridge drive arm pin 58 to protrude through the elongated aperture 118 into the spiral channel 22 for pushing firearm cartridges 24 through the spiral channel 22. The aperture 118 of the drive arm 36 has two bearing surfaces 62 left and right of the longitudinal axis (longitudinally slotted). When placed on and driven by the encapsulated spring clutch mechanism secondary drive shaft 34, the arm 36 travels outwardly or inwardly (depending on clockwise or counterclockwise rotation) when guided by the spiral following cartridge drive arm pin 58, as the pin 58 moves in the spiral channel 22 of the spiral housing 12.

As previously discussed, a spiral cover 28 is attached to the body 12. The spiral cover 28 retains the firearm cartridges 24, the cartridge cover plate 60, the spiral following cartridge drive arm 36, the spiral following cartridge drive arm pin 58, the encapsulated spring clutch mechanism secondary drive shaft 34, the encapsulated spring clutch mechanism 20, and feed lips 14 attached and assembled correctly to the housing 12. The secondary drive shaft 34 is of a length where the shaft 34 contacts with the inner surface of the spiral cover 28 when the system 10 is completely assembled. However, the inner surface of the spiral cover 28 only functions to provide a bearing surface against the double flat key end 56, and is located to permit free rotation of the shaft 34, and preventing any binding of the shaft 34.

Figure 11:
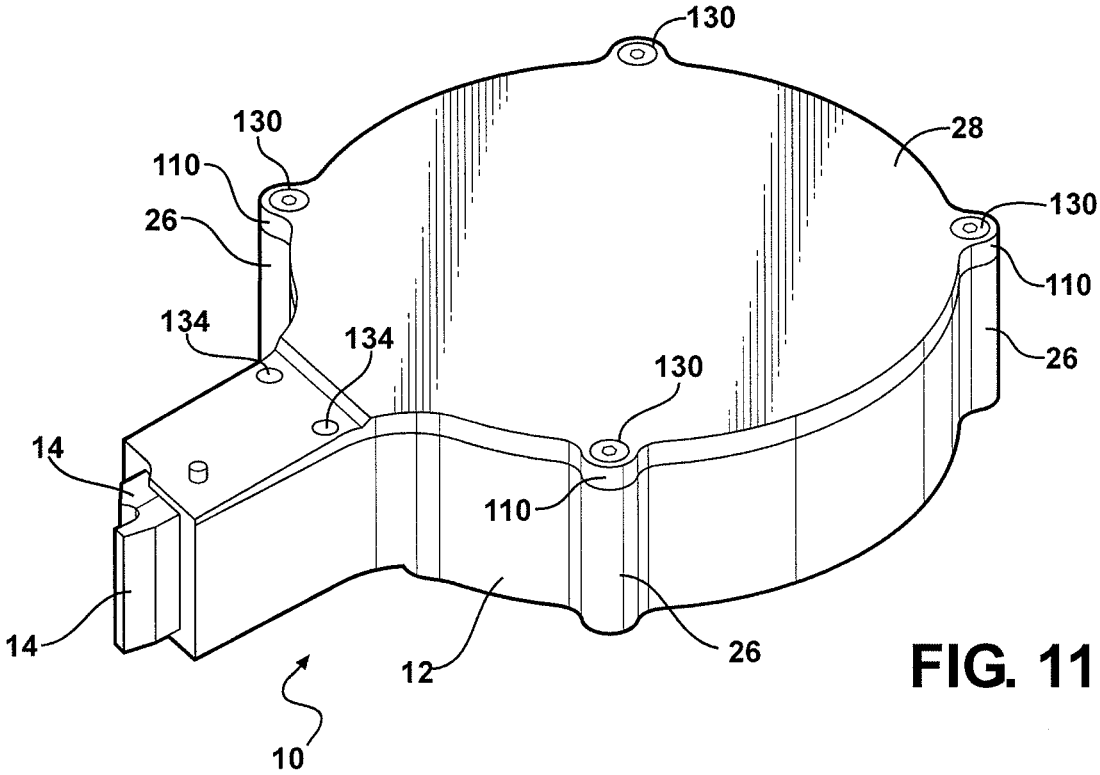
FIG. 11 is a perspective view of a spiral cover attached to a body portion used in a firearm ammunition feeding system, according to the present invention.
Figure 12:
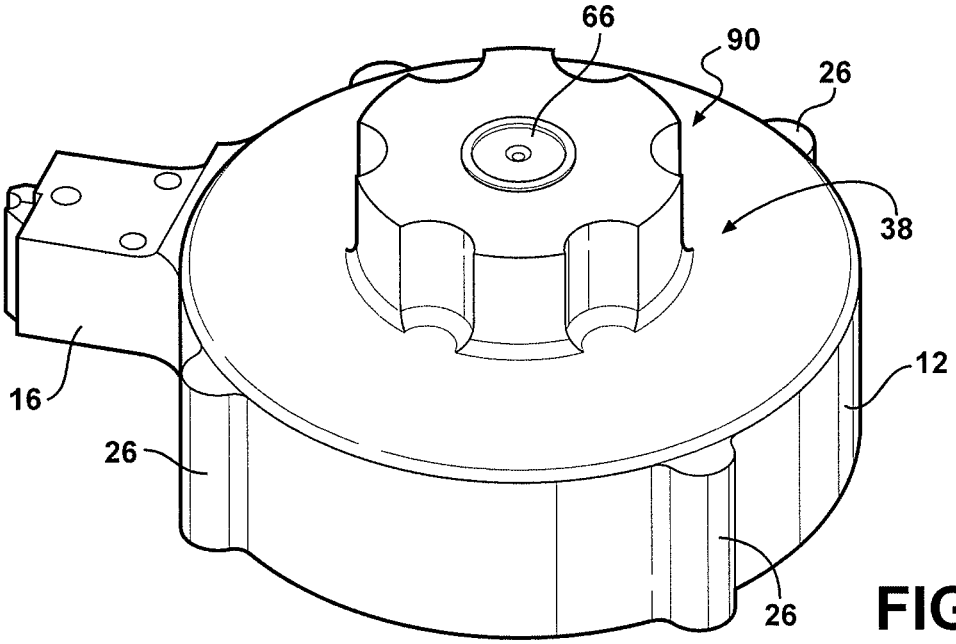
FIG. 12 is a first perspective view of a body portion having a cam stop winding knob attached to the body portion, used in a firearm ammunition feeding system, according to the present invention.
Figure 13:
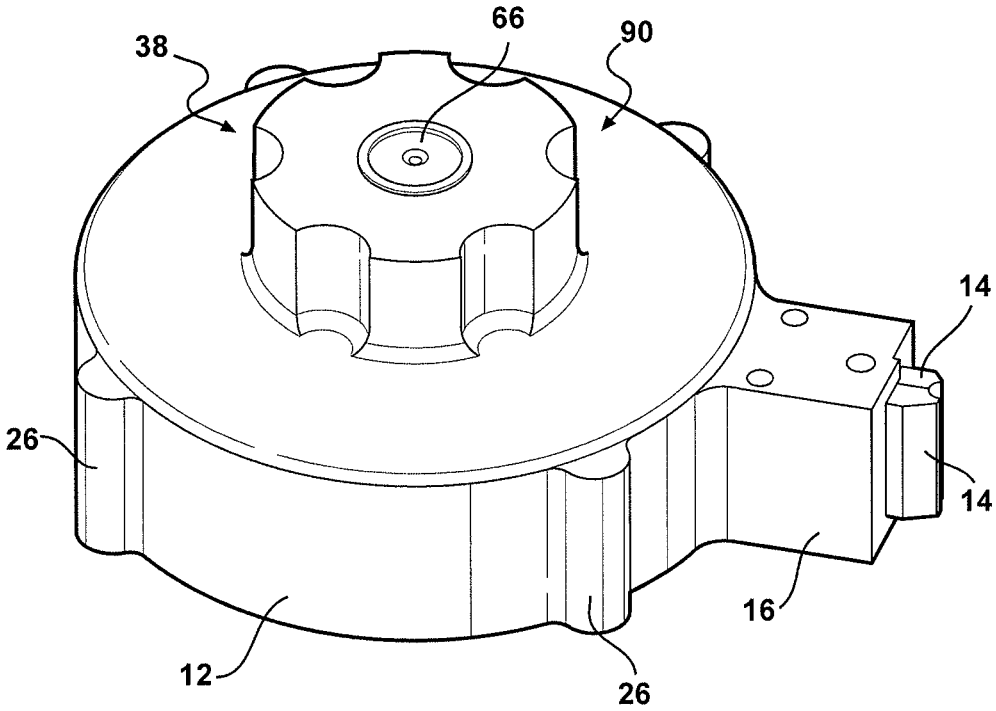
FIG. 13 is a second perspective view of a body portion having a cam stop winding knob attached to the body portion, used in a firearm ammunition feeding system, according to the present invention
Figure 14:
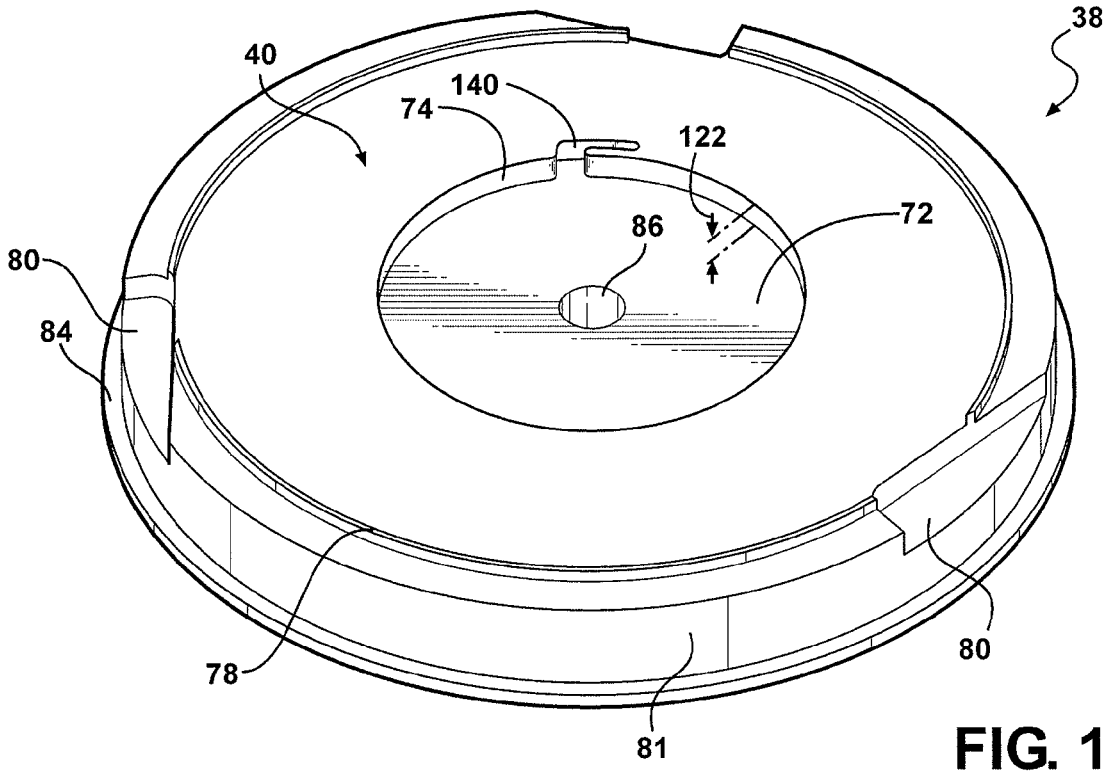
FIG. 14 is a first perspective view of the inner surface of a cam stop winding knob used in a firearm ammunition feeding system, according to the present invention.
Figure 15:
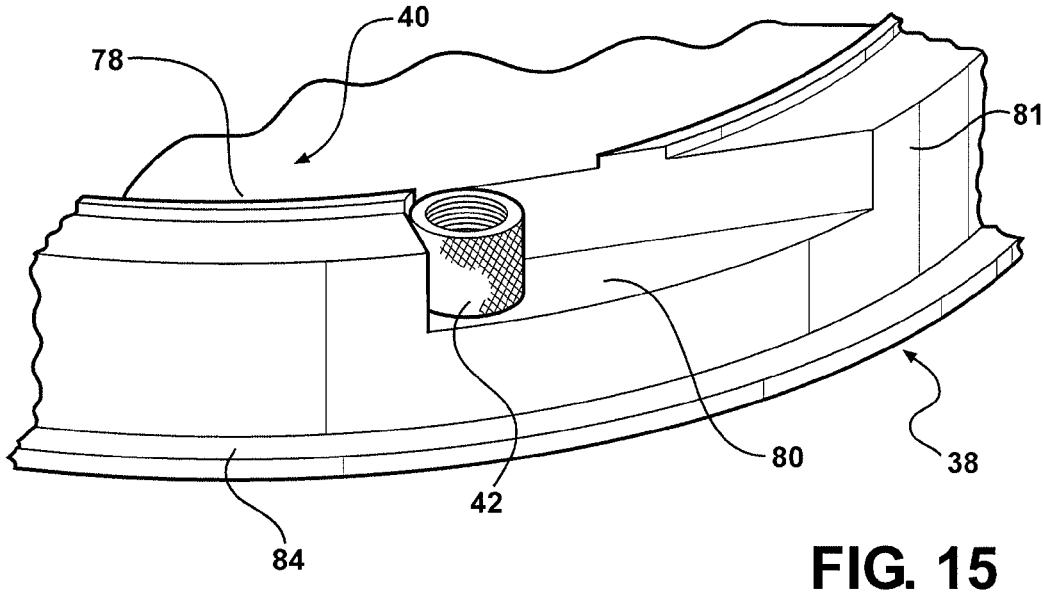
FIG. 15 is an enlarged perspective view of a cam stop winding knob and a cam stop bearing disposed in a cam bearing pocket used in a firearm ammunition feeding system, according to the present invention.

The spiral cover 28 attaches to the housing 12 through the use of a set of fasteners 130, which in this embodiment are screws 130, which extend through the spiral cover 28 as shown in FIG. 11 and into the threaded apertures 27 formed as part of the projections 26. There are also threaded apertures 132 formed as part of the neck 16, and more screws 130 are inserted through apertures 134 formed in the spiral cover 28 and into the threaded apertures 132 to further secure the spiral cover 28 to the body 12. While the spiral cover 28 is shown as a single piece, in an alternate embodiment the cover 28 is split into any number of pieces for functionality or mounting to the housing or body 12.

A clutch release push-button 66 is installed in the clutch release push-button pocket 68, and the clutch release push-button pocket 68 is integral to the cam stop winding knob 38. The cam stop winding knob 38 is characterized by a knob-like protrusion and is centrally located, so that an operator of the firearm ammunition feeding system 10 easily winds a biasable member or power spring 64 for system 10 use. The depth 122 of the cam stop winding knob 38 being the cam stop winding knob power spring pocket ceiling 72 and the inside circumference being the cam stop winding knob power spring pocket retainer 74. When the spring mechanism or power spring 64 is installed into the power spring drive compartment 48, the power spring 64 is captured between the cam stop winding knob power spring pocket ceiling 72 and the firewall 30 of the power spring drive compartment 48. The spring 64 is contained laterally by the cam stop winding knob power spring pocket retainer 74. The firewall 30 separates the power spring drive compartment 48 from the portion of the body 12 having the spiral channel 22.

In alternate embodiments, the cam stop winding knob power spring pocket retainer 74 is of different sizes to allow power springs 64 of different sizes to be used. In this embodiment, the cam stop winding knob power spring pocket retainer 74 is substantially round in shape and the thickness of the cam stop winding knob power spring pocket retainer 74 is less than the depth 122 of the power spring pocket 40. The cam stop winding knob power spring pocket retainer 74 includes a slot 140 for receiving a first end or hook end 142 of the spring 64; the slot 140 and hook end 142 provide an anchor for the spring 64. Cam stop winding knob power spring pocket retainers 74 of various sizes along with various power springs 64 of different spring constants are used, depending upon the caliber of the firearm. Alternatively, if a large power spring 64 is used, the slot 140 may be integrally formed as part of the inner wall of the power spring pocket 40, and there is no need for a cam stop winding knob power spring pocket retainer 74.

The power spring 64 also includes a looped portion 144 which during assembly, moves through a groove 146 formed as part of the power spring drive shaft 50. When assembled, the looped portion 144 abuts and is anchored by a notch 148, which increases the tension in the spring 64 as the cam stop winding knob 38 is rotated.

When the cam stop winding knob 38 is inserted into the power spring drive compartment 48 and assembled with the cam stop bearings 42, the cam stop winding knob 38 turns only in one direction and locks if turned in the opposite direction. This cam configuration acts as a linear, noiseless pawl. The slightly raised narrow race midway between the cam stop winding knob power spring pocket retainer 74 and the outer circumference 76 of the cam stop winding knob power spring pocket 40 is the cam stop friction race 78. The purpose of the race 78 is to minimize the amount of contact surface between the cam stop winding knob 38 and the firewall 30 of the power spring drive compartment 48, thereby reducing operating friction. While the race 78 shown in the figures is shown as a continuous race, in alternate embodiments friction may be further reduced by changing the race 78 to a few short intermittent points.

Figure 16:
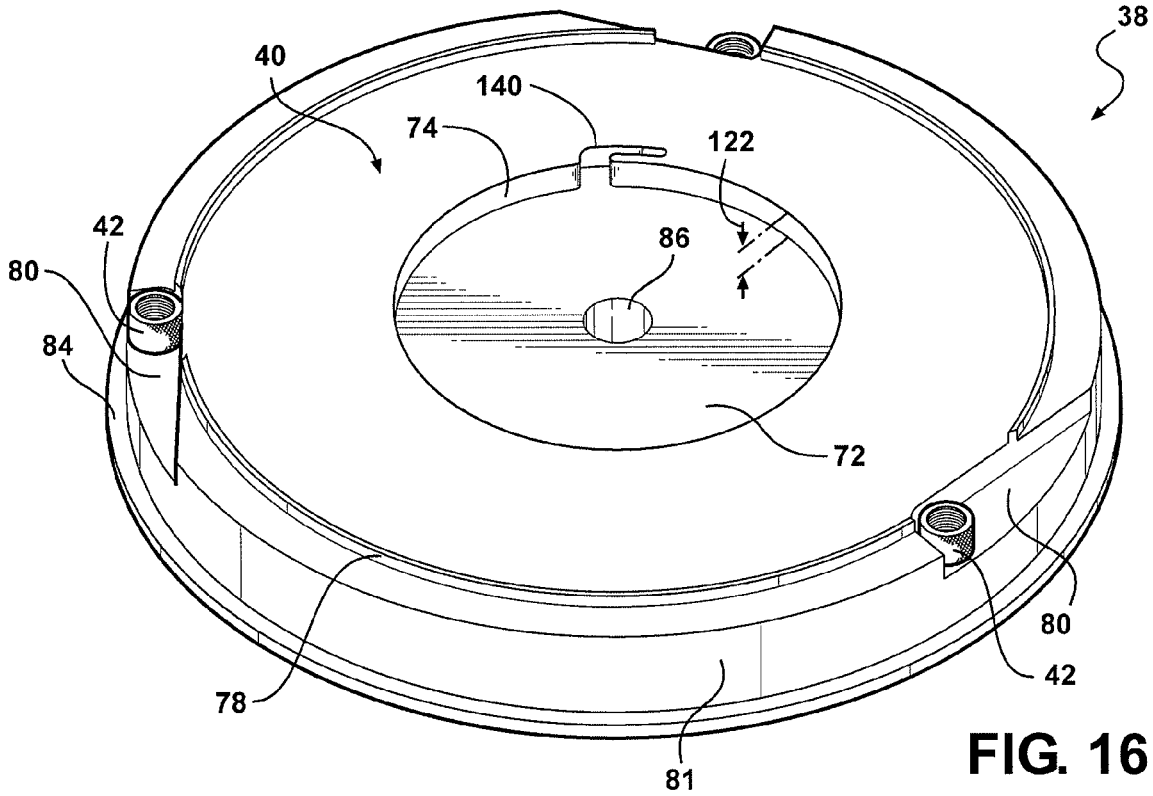
FIG. 16 is a second perspective view of the inner surface of a cam stop winding knob, with cam stop bearings disposed in respective cam stop bearing pockets used in a firearm ammunition feeding system, according to the present invention.

FIG. 16 shows the cam stop bearings 42 located in a correct position of a respective cam stop bearing pocket 80 formed on an outer wall 81 of the power spring pocket 40. While one cam stop bearing 42 may be used to create the pawl action, in this embodiment multiple cam stop bearings 42 which are evenly spaced function to distribute forces placed on an inner wall 83 along the diameter 82 of the power spring compartment 48. In other embodiments, any number of cam stop bearing pockets 80 and cam stop bearings 42 are used. Also shown in FIG. 16 is the cam stop winding knob outer lip 84. The lip 84 contacts the body 12 when the system 10 is assembled, and serves as a barrier to prevent large particles and debris from obstruction of the cam stop winding knob 38, as well as preventing the collection of particles of debris in the power spring compartment 48.

In this embodiment, there are three cam stop bearing pockets 80 with three cam stop bearings 42 correctly located on the outer circumference of the cam stop winding knob power spring pocket 40. The cam stop winding knob 38 also includes a power spring drive shaft push-button opening 86, which receives the power spring drive shaft 50 when the system 10 is assembled. When the cam stop winding knob 38 is correctly assembled to the housing or body 12 of the power spring compartment 48 side of the system 10, the power spring primary drive shaft push-button end 88 is seen in the cam stop winding knob push-button pocket 90.

The clutch release push-button 66 attaches directly to the power spring primary drive shaft push-button end 88, with a clutch release push-button return spring 92 directly under the clutch release push-button 66. The power spring drive shaft 50 includes a first set of flats 150 which are in contact with a second set of flats 152 formed as part of a small diameter portion 154 of the clutch release push-button 66. The small diameter portion 154 includes a hollowed portion, generally shown at 156, which is of a corresponding shape to the power spring primary drive shaft push-button end 88, including having the second set of flats 152. The small diameter portion 154 also has a bottom surface 158 which is part of a large diameter portion 160. The bottom surface 158 includes an aperture 162 which extends through the large diameter portion 160, and when the push button 66 is assembled, the aperture 162 is in substantial alignment with a threaded aperture 164 formed as part of the power spring primary drive shaft push-button end 88. To attach the push button 66 to the shaft 50, the button 66 is slid onto the push-button end 88 such that the first set of flats 150 are in sliding contact with the second set of flats 152, the bottom surface 170 of the small diameter portion 154 contact a set of shoulders 172, and the push-button end 88 is disposed in the hollowed portion 156. A fastener in the form of a screw 166 is then inserted through the aperture 162 and into the threaded aperture 164 of the shaft 50, securing the push-button 66 to the shaft 50.

When the clutch release push-button 66 is attached to the shaft 50, the clutch release push-button return spring 92 is disposed between and is in contact with a lower surface 168 formed as part of the large diameter portion 160 and a contact surface 174 formed as part of the clutch release push-button pocket 68. When the screw 166 is tightened, the clutch release push-button 66 is disposed in the clutch release push-button pocket 68. The cam stop winding knob 38 is held attached to the body 12 by the fastener 166 attaching the clutch release push button 66 to the shaft 50. The return spring 92 then applies a force to the contact surface 174 of the push button pocket 68, thereby maintaining the assembly of the cam stop winding knob 38 to the body 12.

Figure 17:
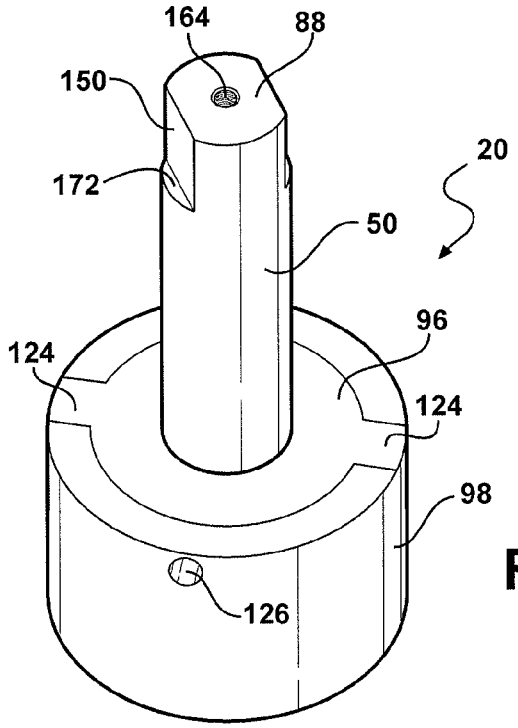
FIG. 17 is a first perspective view of an encapsulated spring clutch mechanism assembly used in a firearm ammunition feeding system, according to the present invention.
Figure 18:
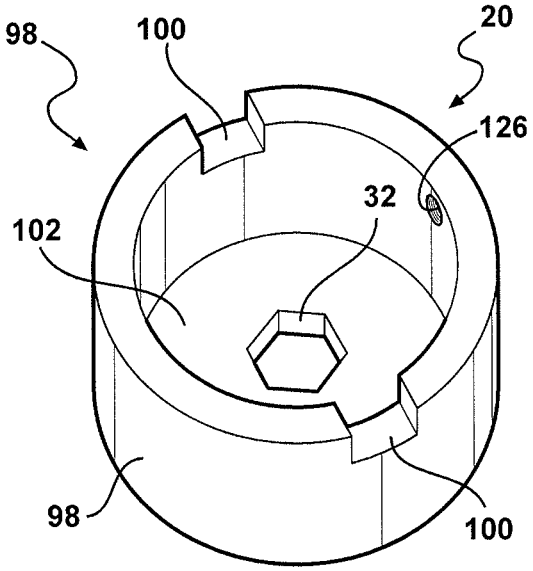
FIG. 18 is a perspective view of an encapsulated spring clutch mechanism, used in a firearm ammunition feeding system, according to the present invention.
Figure 30:
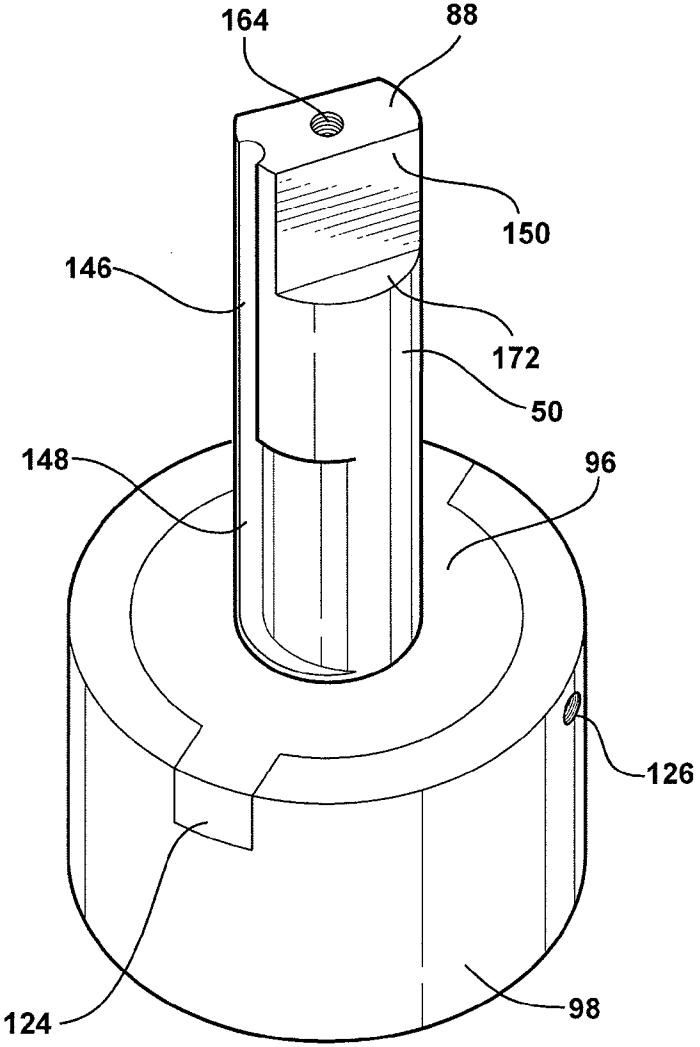
FIG. 30 is a second perspective view of an encapsulated spring clutch mechanism used for a firearm ammunition feeding system, according to the present invention.
Figure 33:
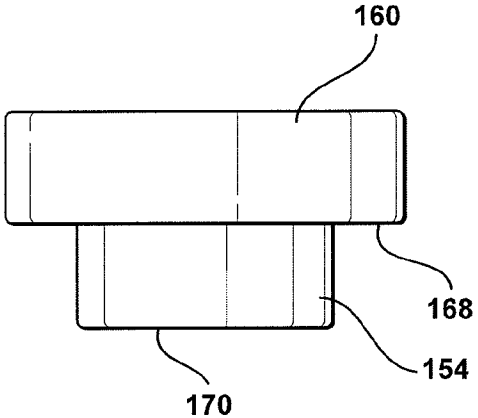
FIG. 33 in an enlarged side view of a clutch release push button used in a firearm ammunition feeding system, according to the present invention.
Figure 34:
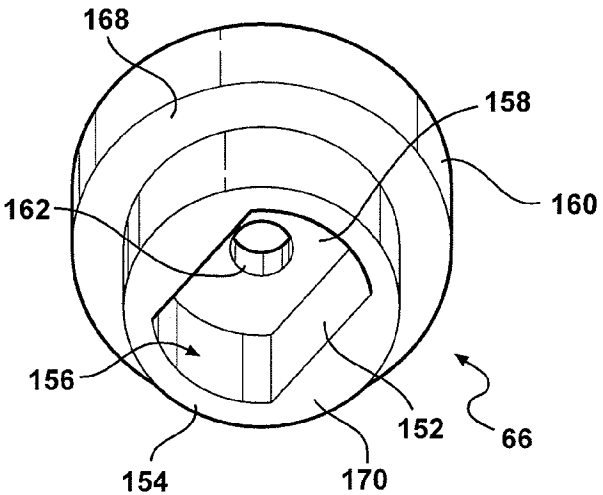
FIG. 34 is a perspective bottom view of a clutch release push button used in a firearm ammunition feeding system, according to the present invention.
Figure 32:
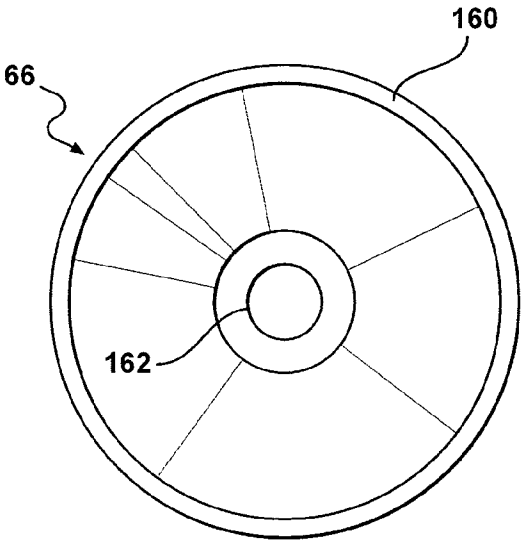
FIG. 32 is an enlarged top view of a clutch release push button used in a firearm ammunition feeding system, according to the present invention.

The encapsulated spring clutch mechanism 20 transfers energy from the power spring assembly 94, or more specifically, the power spring 64, to the encapsulated spring clutch mechanism secondary drive shaft 34, which turns the spiral following cartridge drive arm 36. The encapsulated spring clutch mechanism 20 is shown assembled in FIGS. 17 and 30, and disassembled in FIGS. 18-21. The encapsulated spring clutch mechanism 20 includes the power spring primary drive shaft 50 having the power spring primary drive shaft push-button end 88, an encapsulated spring clutch mechanism castle cover 96, and the encapsulated spring clutch mechanism cup 98. When assembled, the power spring primary drive shaft 50 extends through a central aperture 176 formed as part of the castle cover 96.

Figure 19:
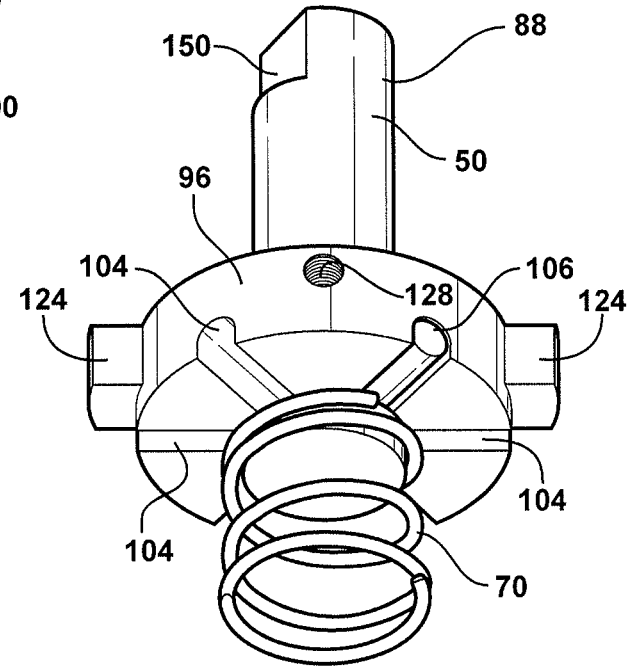
FIG. 19 is a perspective view of a power spring drive shaft and an encapsulated spring clutch mechanism compression spring assembled to an encapsulated spring clutch mechanism castle cover which are part of an encapsulated spring clutch mechanism, used in a firearm ammunition feeding system, according to the present invention.
Figure 20:
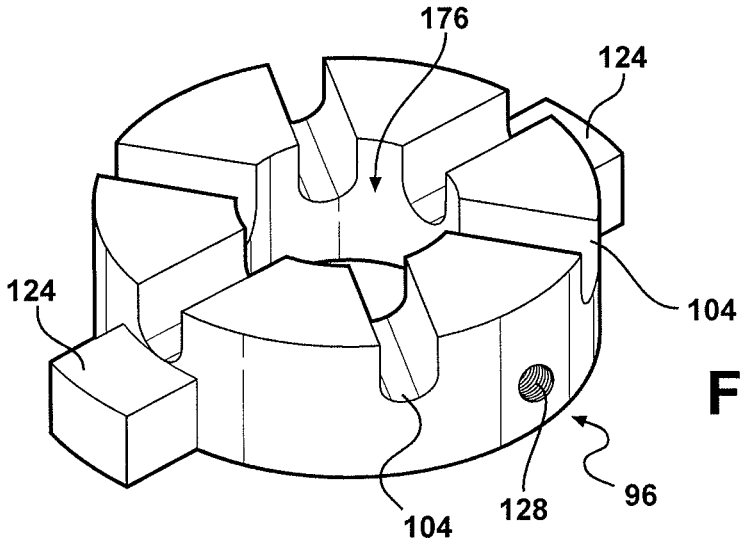
FIG. 20 is a perspective view of a encapsulated spring clutch mechanism castle cover which is part of an encapsulated spring clutch mechanism used in a firearm ammunition feeding system, according to the present invention.
Figure 21:
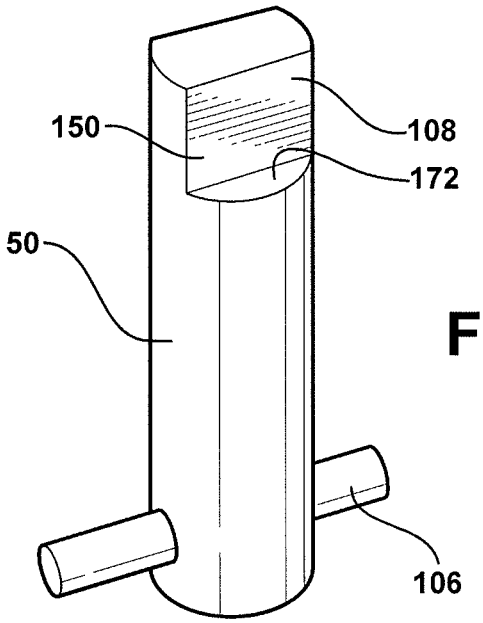
FIG. 21 is a first perspective view of a power spring primary drive shaft, which is a part of an encapsulated spring clutch mechanism used in a firearm ammunition feeding system, according to the present invention.
Figure 22:
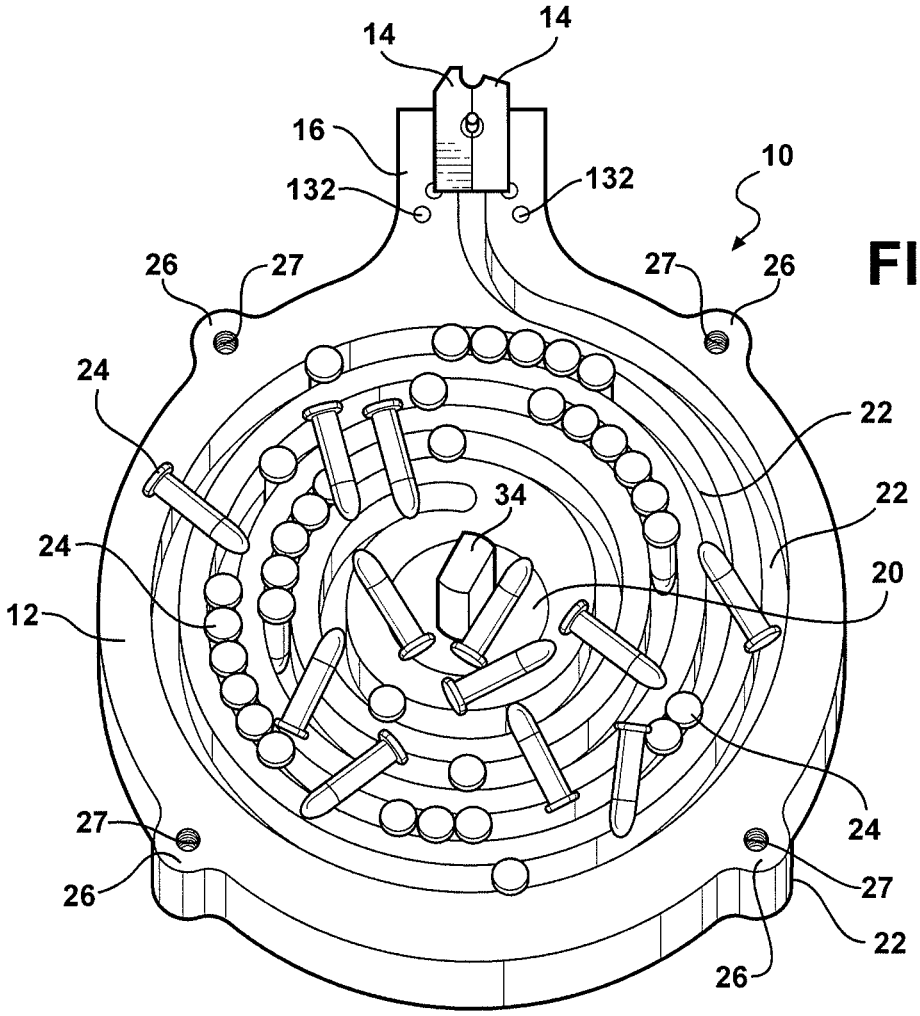
FIG. 22 is a front view of a body portion having several firearm cartridges loaded in a spiral channel used in a firearm ammunition feeding system, according to the present invention.

Also included are encapsulated spring clutch mechanism castle cover ear notches 100 which are formed on adjacent sides of the cup 98, and there are corresponding castle cover ears 124 formed on adjacent sides of the encapsulated spring clutch mechanism castle cover 96. Also shown in FIG. 18, the encapsulated spring clutch mechanism hex drive opening 32 is located approximately in the center of the encapsulated spring clutch mechanism cup floor 102. As seen in FIG. 19, the power spring primary drive shaft 50, the encapsulated spring clutch mechanism castle cover 96, and the encapsulated spring clutch mechanism compression spring 70 are shown in the assembled state, and the cup 98 is removed.

The encapsulated spring clutch mechanism castle cover 96 mates to the encapsulated spring clutch mechanism cup 98. The castle cover ears 124 are selectively received into the ear notches 100, and screw fasteners extend into apertures 126 formed as part of the cup 98 and threaded apertures 128 formed as part of the castle cover 96. The encapsulated spring clutch mechanism castle cover locking notches 104 are internal to the encapsulated spring clutch mechanism cup 98 when assembled.

In an alternate embodiment, the encapsulated spring clutch mechanism castle cover notches 104 are placed in the floor 102 of the encapsulated spring clutch mechanism cup 98. Also, there are many methods of attaching the encapsulated spring clutch drive mechanism castle cover 96 to the encapsulated spring clutch mechanism cup 98. An alternate embodiment includes the encapsulated spring clutch mechanism castle cover 96 assembled to the encapsulated spring clutch mechanism cup 98 by any means that do not interfere with the intended rotation of the encapsulated spring clutch mechanism cup 98 or clutch action of the encapsulated spring clutch mechanism 20. The alternate embodiments include a stab lock, glue, pinning, welding, etc in place of a fastener used with the apertures 126,128.

The power spring primary drive shaft 50 when assembled into the encapsulated spring clutch mechanism 20 engages the encapsulated spring clutch mechanism castle cover locking notches 104 through the use of a power spring primary drive shaft castle pin 106, and is held in an engaged position by the encapsulated spring clutch mechanism compression spring 70. When the clutch release push-button 66 is pressed, the power spring primary drive shaft 50 moves to disengage or remove the power spring primary drive shaft castle pin 106 from the encapsulated spring clutch mechanism castle cover locking notches 104. The compression spring 70 is disposed between the encapsulated spring clutch mechanism cup floor 102 and the encapsulated spring clutch mechanism castle cover 96.

In operation, when it is desired to load and use the system 10 and the system 10 is in an assembled state, the user simply removes the fasteners 130 from the spiral cover 28, and then removes the spiral cover 28 from the body 12. The spiral following cartridge drive arm 36 and the cartridge cover plate 60 are removed as well. Firearm cartridges 24 are placed into the spiral channel 22 after the removal of the spiral cover 28, the spiral following cartridge drive arm 36, the encapsulated spring clutch mechanism secondary drive shaft 34, and the cartridge cover plate 60. While some firearm cartridges 34 self-locate in the spiral channel 22, other firearm cartridges are easily located in the spiral channel 22 by the user. After completely filling the spiral channel 22 partially or completely with firearm cartridges 24, the various components are reassembled and the spiral cover 28 attaches to the housing or body 12.

Once the feeding system 10 of the present invention has been loaded with cartridges 24, the cam stop winding knob 38 is rotated. Rotational force is transferred through the cam stop winding knob 38 to the power spring 64 and then to the drive shaft 50. However, the drive shaft 50 is prevented from rotating because the spiral following cartridge drive arm pin 58 receives a reactionary force from the cartridges 24, which is transferred through the spiral following cartridge drive arm pin 58, the spiral following cartridge drive arm 36, the secondary drive shaft 34, the encapsulated spring clutch mechanism 20, and the power spring drive shaft 50. The power spring drive shaft 50 does not rotate as the cam stop winding knob 38 is rotated, and therefore tension builds in the power spring 64. The rotation of the cam stop winding knob 38 applies a rotational force to the hook end 142 of the power spring 64 because of the hook end 142 being located in the slot 140, and the looped portion 144 being adjacent the notch 148 on the power spring drive shaft 50. As the cam stop winding knob 38 is rotated, it is prevented from rotating in the opposite direction due to the pawl action generated by the cam stop bearings 42 and cam bearing pockets 80 described above.

Once the user has rotated the cam stop winding knob 38 to generate the desired amount of tension in the power spring 64, the cam stop winding knob 38 does not move, and the firearm is ready for use. As the user fires the firearm, the cartridges 24 are discharged one at a time, and a new cartridge 24 is fed through the feed lips 14 into the firearm. The cartridges 24 are fed into the firearm because of the tension in the power spring 64. The tension in the power spring 64 causes the power spring drive shaft 50 to rotate because of rotational force applied to the shaft 50 from the spring 64. This rotational force is transferred to the power spring primary drive shaft castle pin 26, to the encapsulated spring clutch mechanism castle cover 96, the castle cover ears 124, the castle cover ear notches 100, the encapsulated spring mechanism cup 98, the encapsulated spring mechanism cup floor 102, the hex drive opening 32, the hex end 52 of the secondary drive shaft 34, the secondary drive shaft 34, the spiral following cartridge drive arm 36, spiral following cartridge drive arm pin 58, and then to the cartridges 24. This causes the remaining cartridges 24 to move in the spiral channel 22 as the cartridges 24 moved from the feed lips 14 into the firearm are discharged from the firearm.

If the user decides to stop using the firearm, but wishes to have the cartridges 24 remain in the feed system 10 for future uses, the user simply presses the clutch release push button 66. Pushing the clutch release push button 66 also applies a force to the power spring drive shaft 50. The user must press the push button 66 with enough force to overcome the force of the clutch release push button return spring 92 and the encapsulated spring clutch mechanism compression spring 70. As force is applied to the power spring drive shaft 50 from the push button 66, the power spring primary drive shaft castle pin 106 is removed from the encapsulated spring clutch mechanism castle cover locking notches 104. This allows the clutch release push button 66, the power spring drive shaft 50, and the compression spring 70 to rotate relative to the encapsulated spring clutch mechanism castle cover 96 and the encapsulated spring clutch mechanism cup 98. The remaining tension in the power spring 64 causes the power spring drive shaft 50 to rotate and relieve the tension in the power spring 64. This prevents the power spring 64 from permanently deforming, or developing a "set," improving the life of the power spring 64.

If the user decides to use the firearm again, the cam stop winding knob 38 is wound to generate tension in the power spring 64 as described above. If the castle pin 106 is not disposed in one of the notches 104, there are multiple notches 104 that the pin 106 can be received into such that when the cam stop winding knob 38 is rotated, if the pin 106 is not disposed in one of the notches 104, then as the cam stop winding knob 38 is rotated, the rotational force applied to the power spring 64 by the cam stop winding knob 38 as described above causes the power spring 64 to rotate the power spring drive shaft 50 until the castle pin 106 is in alignment with one of the notches 104. The castle pin 106 then slides into the respective notch 104; rotational force is then transferred through the various components as described above to build tension in the power spring 64.

Figure 23A:
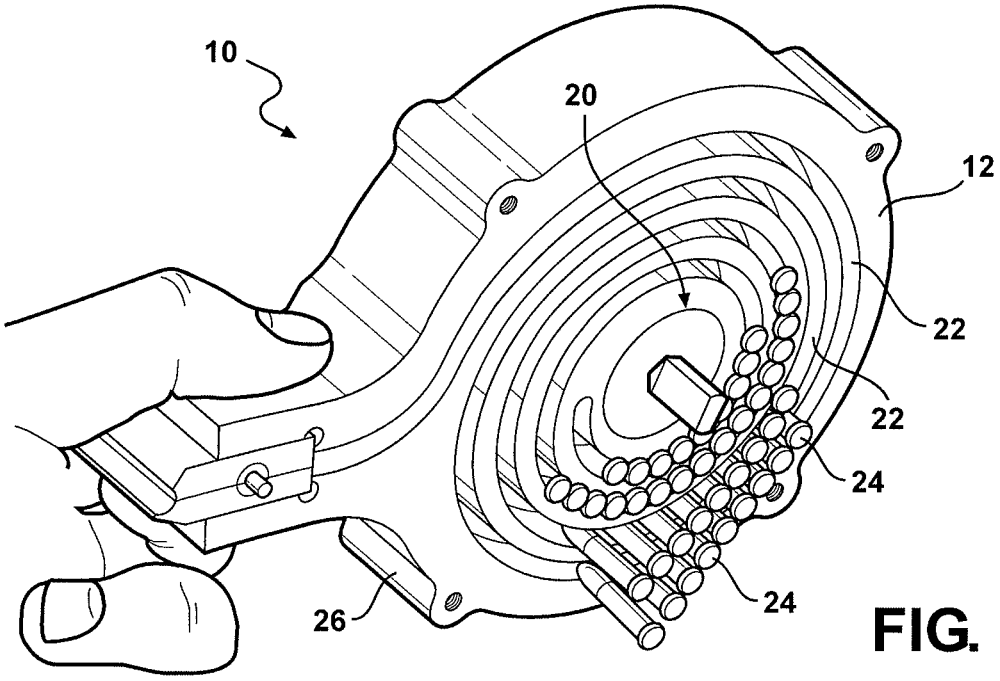
FIG. 23A is a first perspective view of cartridges being removed from a spiral channel formed as part of a body portion of a firearm cartridge feeding system, according to the present invention.
Figure 23B:
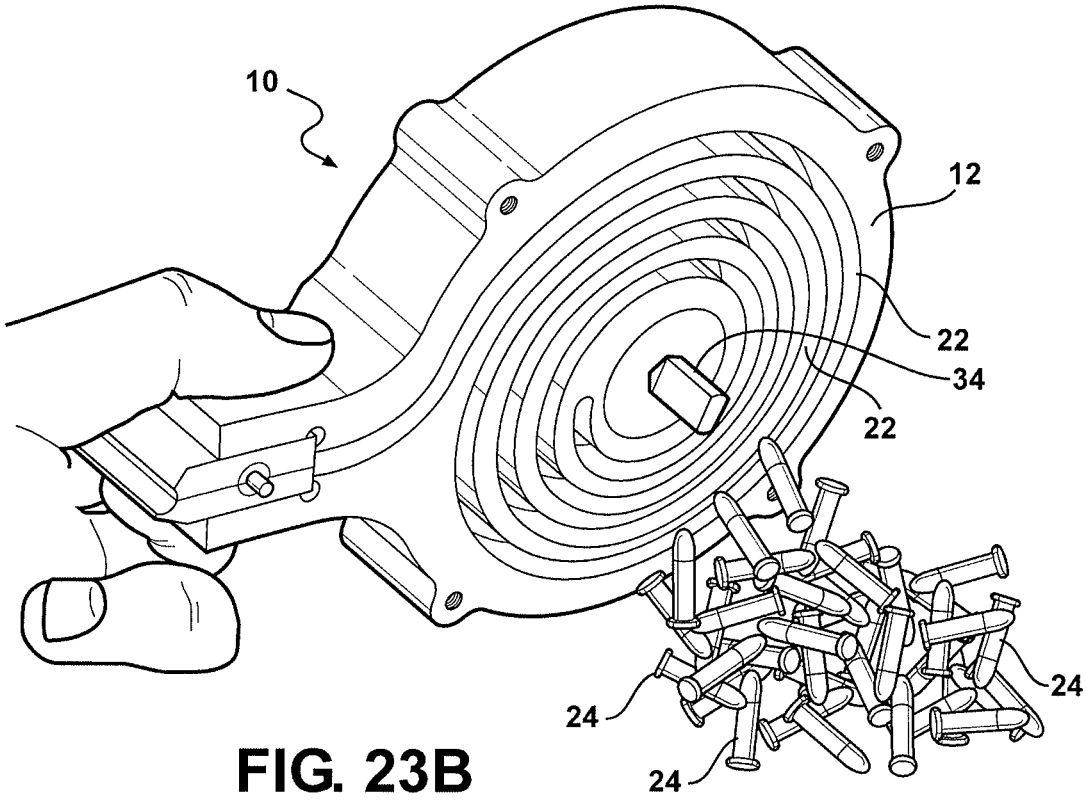
FIG. 23B is a second perspective view of cartridges being removed from a spiral channel formed as part of a body portion of a firearm cartridge feeding system, according to the present invention.
Figure 25:
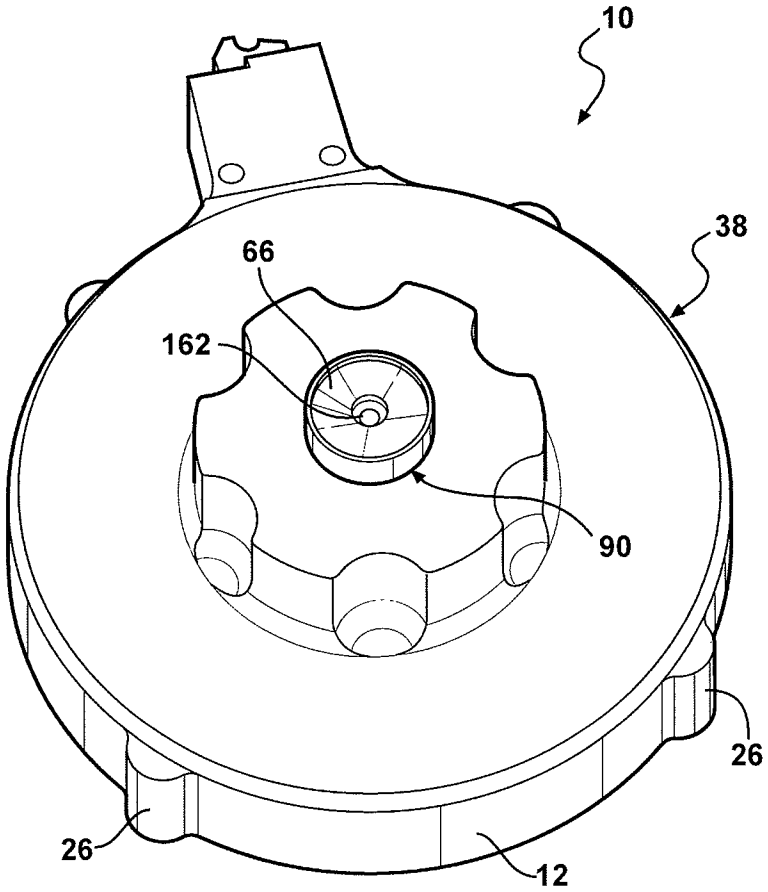
FIG. 25 is a perspective view of an ammunition feeding system with the fastener for the clutch release push button removed, according to the present invention.
Figure 24:
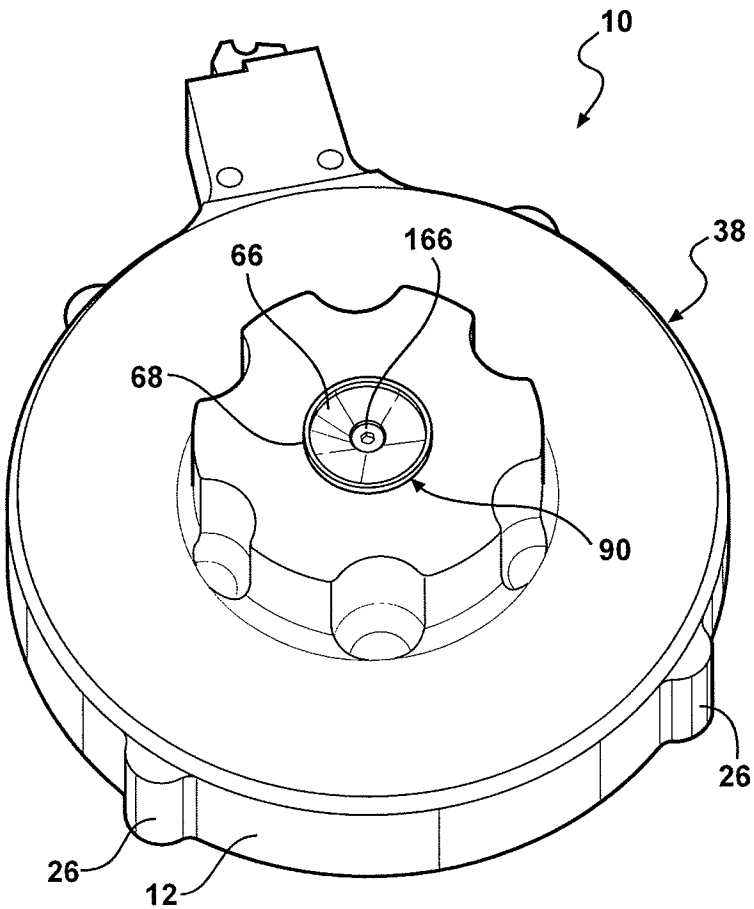
FIG. 24 is a perspective view of an ammunition feeding system in an assembled state, according to the present invention.
Figure 27:
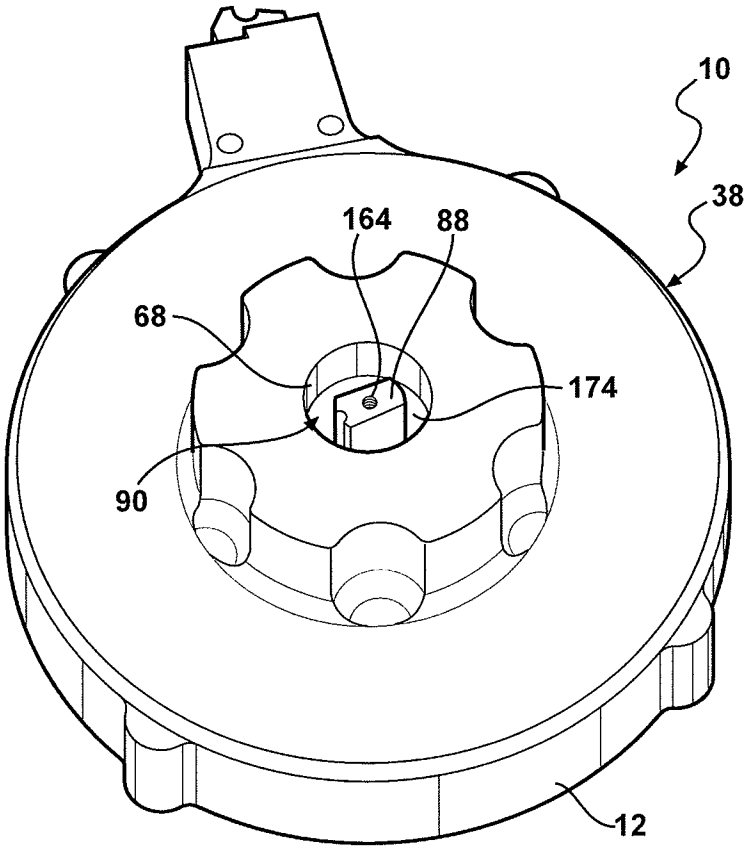
FIG. 27 is a perspective view of an ammunition feeding system with the clutch release push button and clutch release push button return spring removed, according to the present invention.
Figure 26:
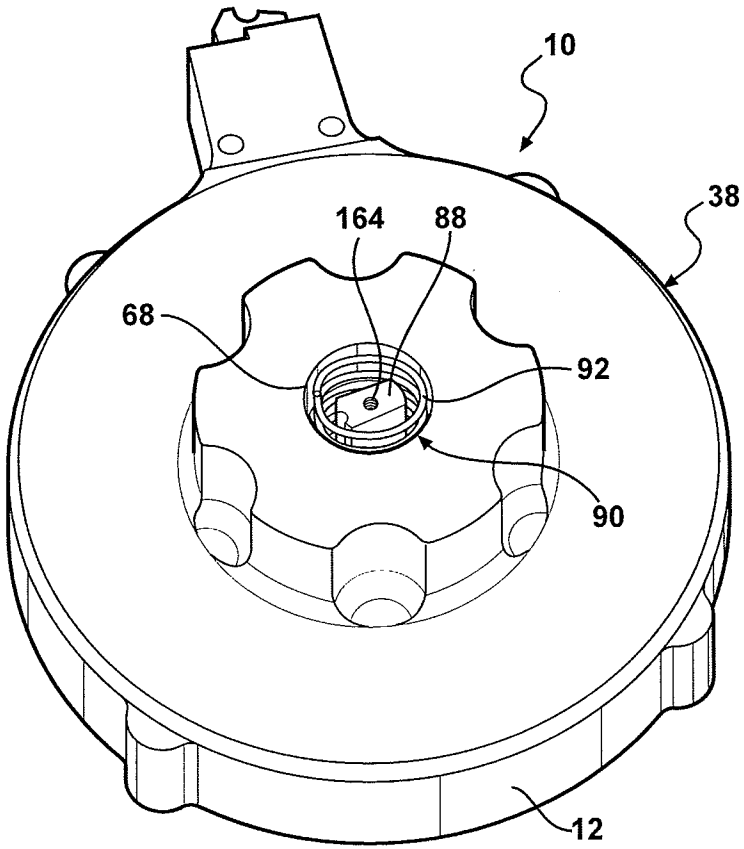
FIG. 26 is a perspective view of an ammunition feeding system with the clutch release push button removed and the clutch release push button return spring exposed, according to the present invention.
Figure 29:
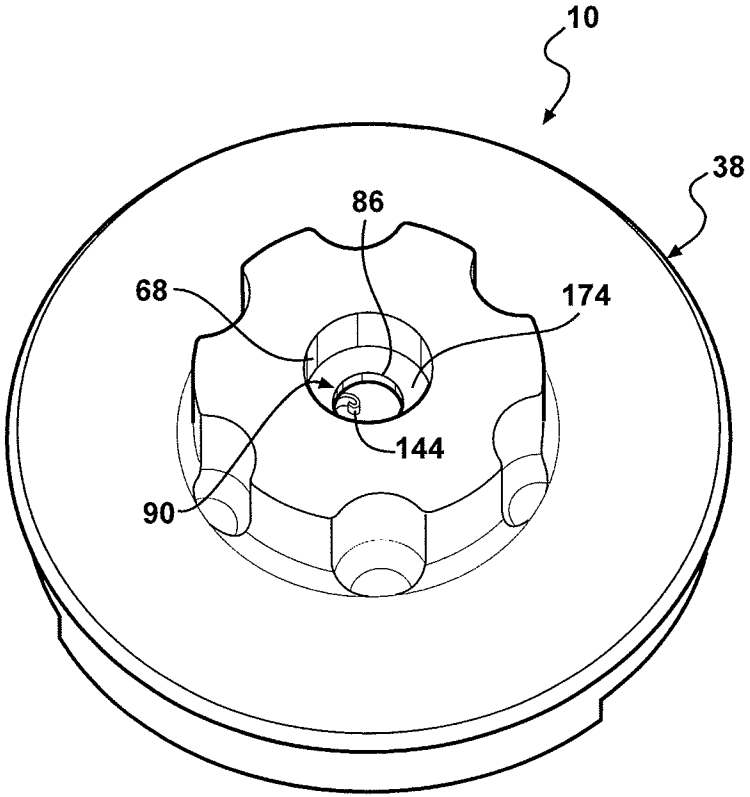
FIG. 29 is a top view of a cam stop winding knob removed from an ammunition feeding system, according to the present invention
Figure 28:
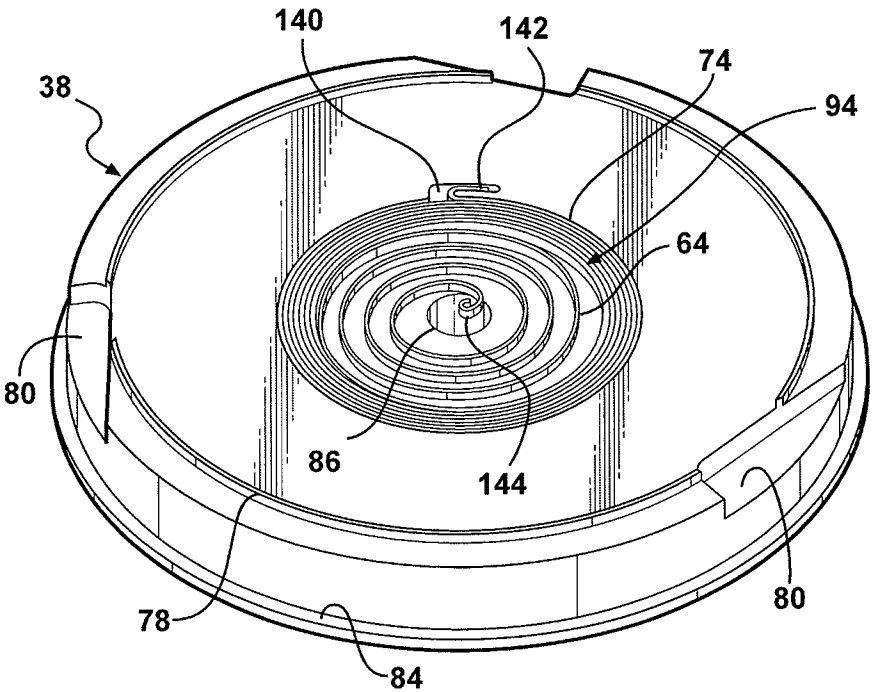
FIG. 28 is a bottom view of a cam stop winding knob used for an ammunition feeding system, according to the present invention.
Figure 31:
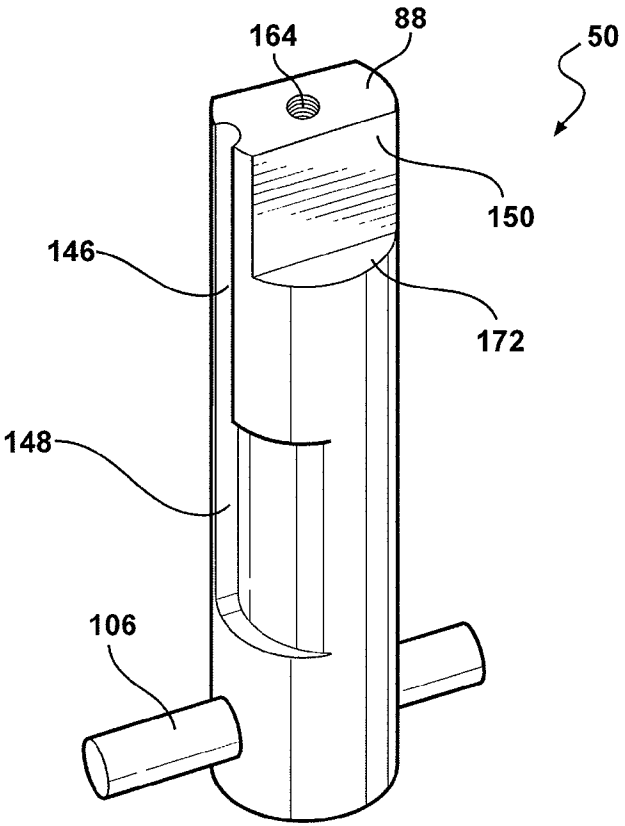
FIG. 31 is a second perspective view of a power spring primary drive shaft, which is a part of the encapsulated spring clutch mechanism used in a firearm ammunition feeding system, according to the present invention.

After the firearm cartridge feeding system 10 has been loaded, and if it is desired to remove the cartridges 24 from the system 10 (for the purpose of long term storage, for example), the system 10 is easily unloaded by removing the spiral cover 28, the spiral following cartridge drive arm 36, the encapsulated spring clutch mechanism secondary drive shaft 34, and the cartridge cover plate 60. Once the components have been removed from the system 10, the firearm cartridges 24 are spilled out, best shown in FIGS. 23A and 23B.

Figure 35:
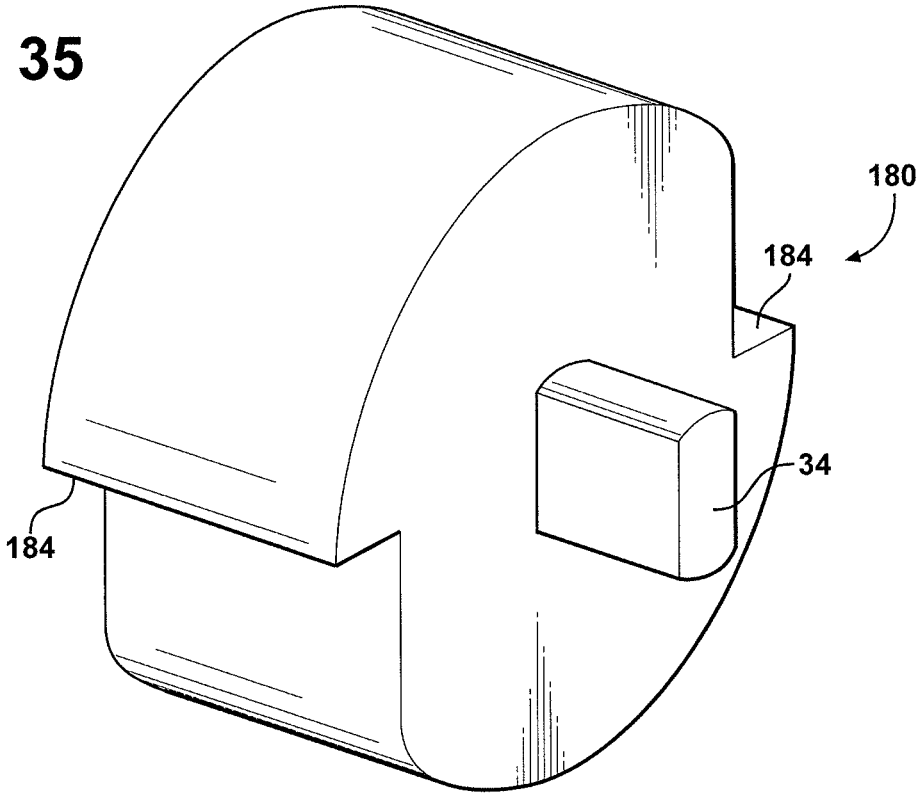
FIG. 35 is a first perspective view of an alternate embodiment of an encapsulated spring clutch mechanism cup which is part of an encapsulated spring clutch mechanism used in a firearm ammunition feeding system, according to the present invention.
Figure 36:
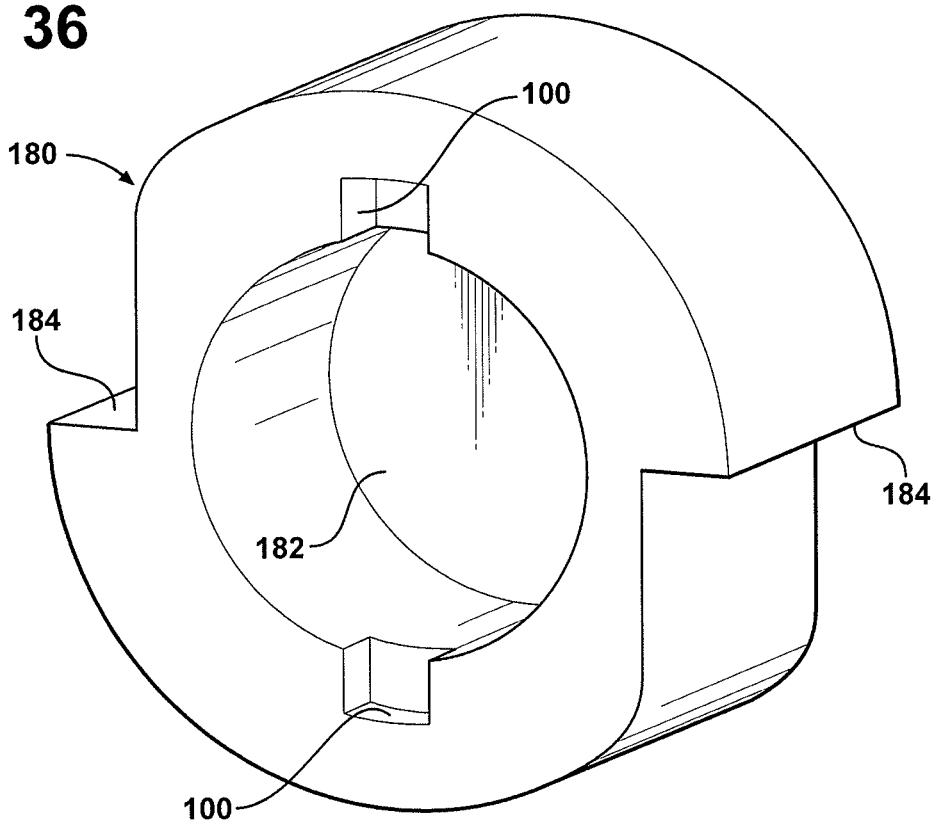
FIG. 36 is a second perspective view of an alternate embodiment of an encapsulated spring clutch mechanism cup which is part of an encapsulated spring clutch mechanism used in a firearm ammunition feeding system, according to the present invention.
Figure 37:
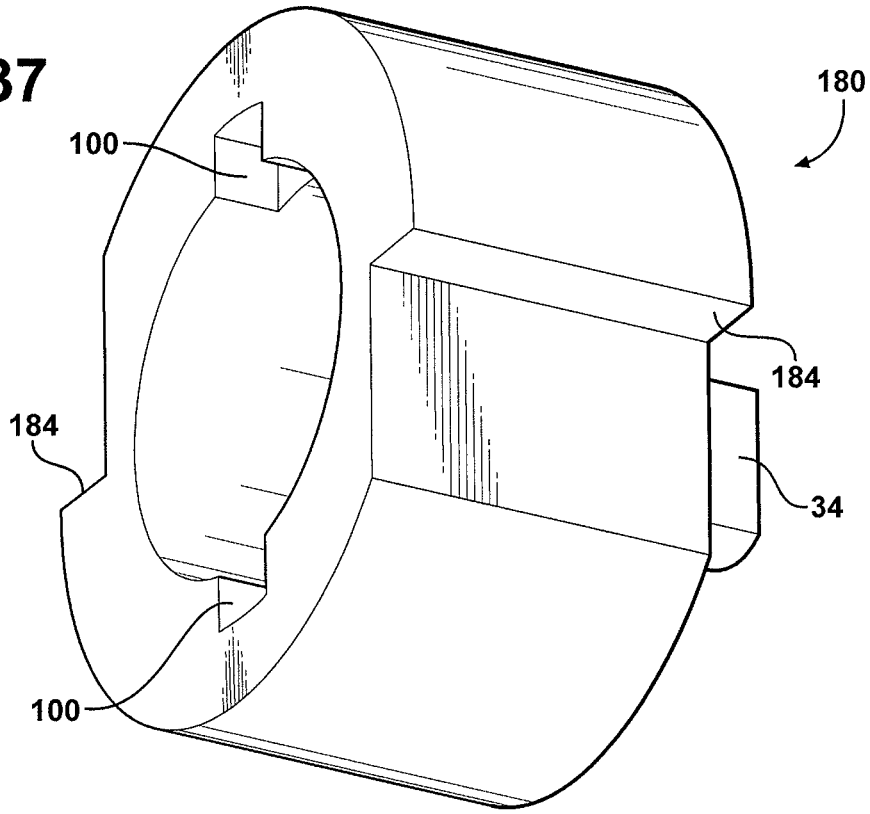
FIG. 37 is a third perspective view of an alternate embodiment of an encapsulated spring clutch mechanism cup which is part of an encapsulated spring clutch mechanism used in a firearm ammunition feeding system, according to the present invention.

Another embodiment of the encapsulated spring clutch mechanism cup 98 is shown in FIGS. 35-37, with like numbers referring to like elements. In this embodiment, the encapsulated spring clutch mechanism cup, generally shown at 180, is integral with the secondary drive shaft 34. More specifically, the secondary drive shaft 34 is formed as part of the encapsulated spring clutch mechanism cup floor 182. The cup 180 also includes a plurality of cam bearing pockets 184 formed as part of the cup 180, instead of being formed as part of the cam stop winding knob 38, as discussed with regard to the previous embodiment. There are also cam stop bearings (not shown) which are received into the cam bearing pockets 184 and operate in substantially the same manner as the cam stop bearings 42 described in the previous embodiment.

Figure 38:
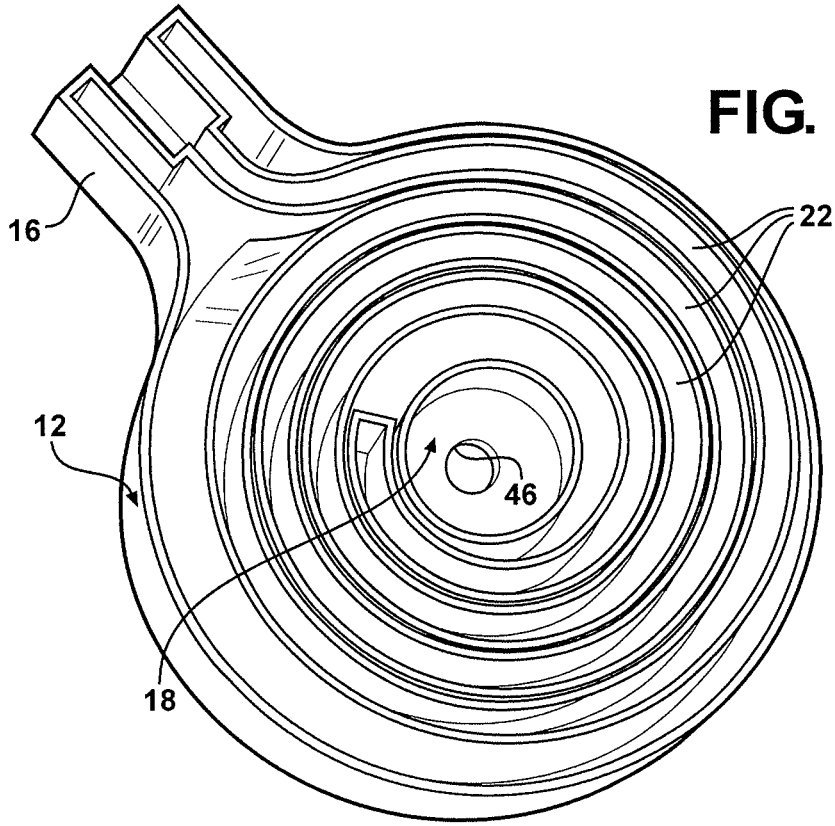
FIG. 38 is a perspective view of an alternate embodiment of a housing used in a firearm ammunition feeding system, according to the present invention.
Figure 40:
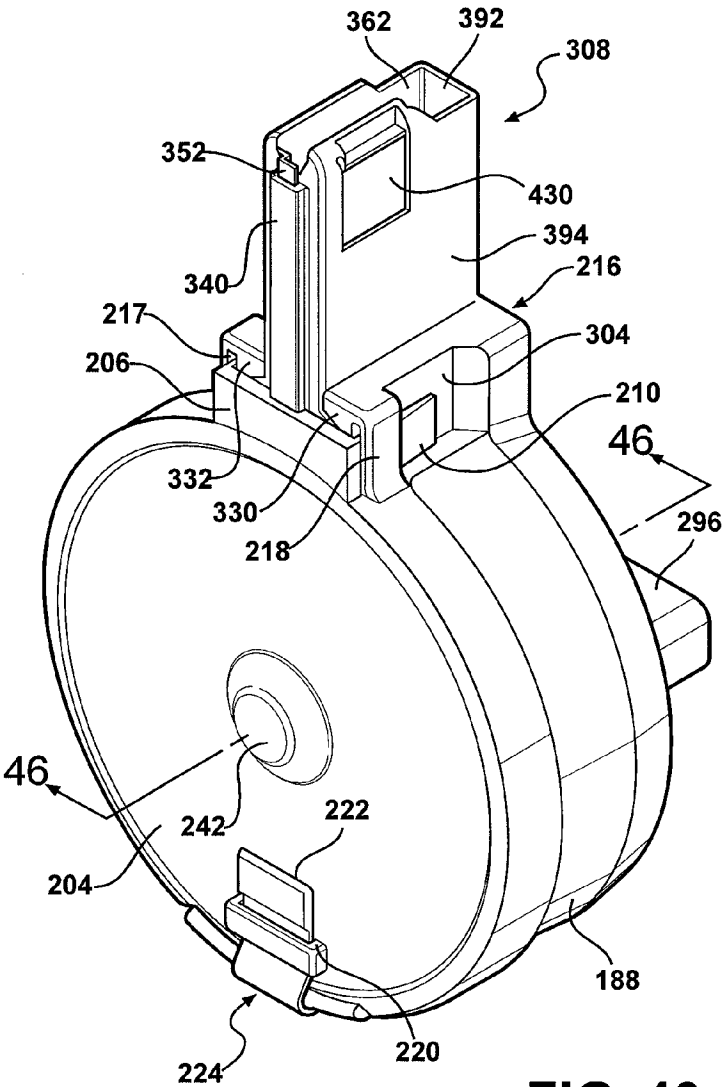
FIG. 40 is a second perspective view of a second alternate embodiment of a firearm ammunition feeding system, according to the present invention.
Figure 39:
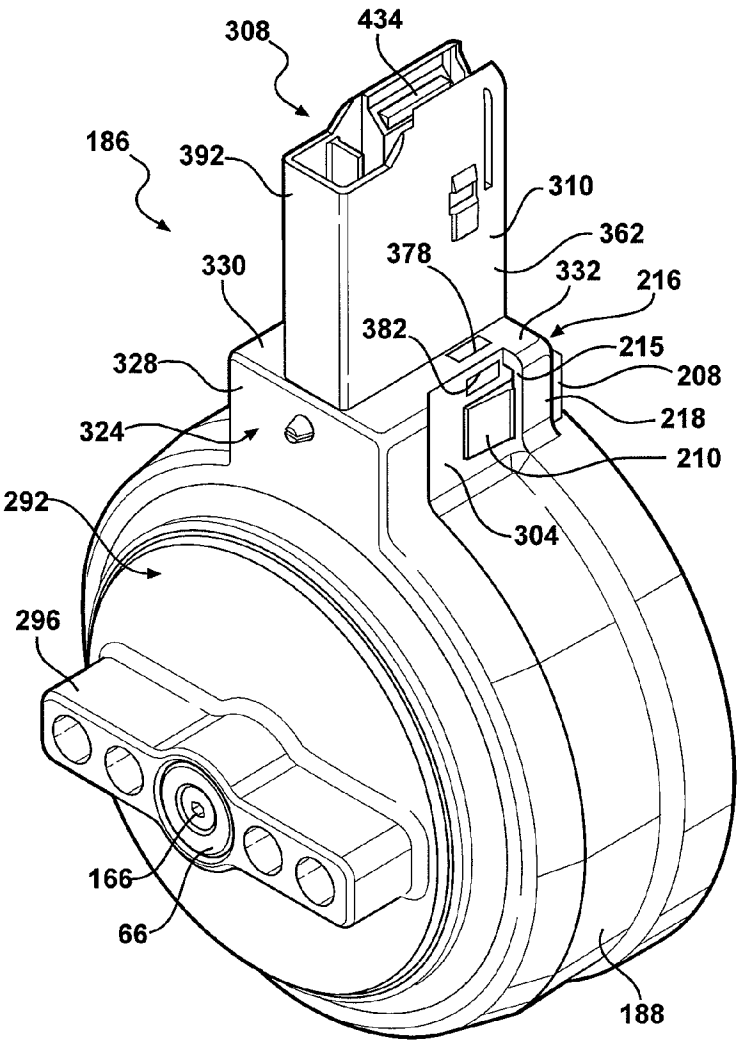
FIG. 39 is a first perspective view of a second alternate embodiment of a firearm ammunition feeding system, according to the present invention.

Another embodiment of the housing 12 is shown in FIG. 38, with like numbers referring to like elements. This embodiment is similar to the housing 12 shown in the other Figures, with the exception that unneeded material has been removed surrounding the spiral groove 22 to make the housing 12 lighter, thereby reducing the overall weight of the ammunition feeding system 10.

It should be noted that the various components of the ammunition feeding system 10 are made of various types of polymers to reduce friction between the various components, as well as prevent any deterioration from exposure to moisture due to various weather conditions. The ammunition feeding system 10 is completely submersible in a liquid, such as water, and is completely operational after being removed from the liquid. The components that are made of the various polymers are the housing 12, the cam stop winding knob 38, and the encapsulated spring clutch mechanism cup 98.

Another embodiment of an ammunition feed system according to the present invention is shown in FIGS. 39-52C generally at 186, with like numbers referring to like elements. This embodiment includes a body 188, which is generally similar to the body 12 described in the previous embodiments, but also includes some distinguishable features. The body 188 also includes a spiral channel 190, and a clutch pocket, generally shown at 192. This embodiment does not have an encapsulated spring clutch mechanism 20, but rather includes a clutch assembly, generally shown at 194, the function of which will be described later.

The body 188 also includes a sidewall 196 which protrudes outwardly from the sides of the spiral channel 190, and functions as a loading bowl to facilitate the loading of the cartridges 24 into the spiral channel 190. Connected to the sidewall 196 is a plurality of pedestal stops 198. Each of the pedestal stops 198 includes a ledge 200 used for supporting the cartridge cover plate 60 when the ammunition feed system of the present invention is assembled. The cartridge cover plate 60 is substantially the same as described in the previous embodiments, but as shown in FIGS. 41-42, 46-47, and 51C, also includes a pair of tabs 202, and the spiral following clutch drive arm 36 is disposed between the tabs 202 when the ammunition feed system 186 is assembled. In this embodiment, the cartridge cover plate 60 is not only driven for rotation by the spiral following clutch drive arm pin 58, as with the previous embodiment, but is also driven for rotation by the spiral following clutch drive arm 36 applying rotational force to the tabs 202. The spiral following clutch drive arm pin 58 still extends through the elongated aperture 118 and into the spiral channel 190, and the elongated aperture 114 is in substantial alignment with the cartridge cover plate secondary drive shaft center 116.

This embodiment also includes a spiral cover plate 204 which has an upper flange 206 and a pair of upper locking tabs 208, each of the upper locking tabs 208 having a tapered surface 210 which is adjacent a shoulder 212. When connected to the body 188, each of the upper locking tabs 208 are received into a respective slot 214 formed as part of a shortened neck portion, shown generally at 216, and the shortened neck portion 216 is formed as part of the body 188. The upper locking tabs 208 are substantially rigid, but are also biasable in that during assembly, the upper locking tabs 208 are initially inserted into the slots 214, and as the tabs 208 are pushed further into the slots 214, the tapered surfaces 210 are in contact with and move along the respective outer surfaces 217 of the slots 214, and the outer surfaces 217 bias the tabs 208 inwardly until the tabs 208 are pushed far enough into the slots 214 that that tapered surfaces 210 have completely moved through the slots 214. The bias on the tabs 208 is then relieved, and the tabs 208 return to their initial position, causing the shoulders 212 to be in contact with a ledge 215 adjacent the slot 214, preventing the removal of the tabs 208 from the slots 214. Each of the slots 214 is formed as part of a protrusion 218, with the protrusion 218 being part of the shortened neck portion 216.

To remove the tabs 208 from the slots 214, the user simply applies pressure to the tapered surfaces 210, thereby moving the tabs 208 in a direction toward one another, to allow the tabs 208 to move back through the slots 214, the user then pulls on the cover plate 204. This causes the tabs 208 to move back through the slots 214 in the opposite direction.

The spiral cover plate 204 also includes a spiral cover retaining strap slot 220 which is able to receive a first portion 222 of a spiral cover retaining strap, generally shown at 224. The strap 224 also includes a second portion 226 operable for extending into a bottom slot 228 formed as part of the body 188. The first portion 222 includes a tapered surface 230 which terminates into a shoulder 232. During assembly, the first portion 222 is pushed through the slot 220, and the tapered surface 230 contacts the inside of the slot 220, causing the first portion 222 to deflect. When the first portion 222 is pushed through the slot 220 far enough that the tapered portion 210 of the first portion 222 is completely through the slot 220, the tapered surface 210 is no longer in contact with the inner surface of the slot 220, and the first portion 222 returns to its original position. When assembled, the first portion 222 extends through the slot 220 until the shoulder 232 is adjacent and in contact with a ledge 234 to prevent the first portion 222 from being pulled out of the slot 220. To remove the first portion 222 from the slot 220, force is applied to the tapered surface 230 such that the first portion 222 moves toward the cover plate 204 until the shoulder 232 is no longer in contact with the ledge 234, allowing the first portion 222 to be pulled from the slot 220.

The second portion 226 also includes a folded portion 236 which terminates into a shoulder 238. When assembled, the second portion 226 is inserted through the bottom slot 228 until the folded portion 236 is completely through the slot 228, this allows the shoulder 238 to contact a ledge 240 of the bottom slot 228. The folded portion 236 does not have a tapered surface as described above with reference to the other tabs 208 or the first portion 222, and is intended to provide a permanent connection between the strap 224 and the body 12.

To further secure the spiral cover plate 204 to the body 188, the spiral cover plate 204 includes a lower fastening tab 233 which when assembled extends into a bottom fastening tab slot 235.

The spiral cover plate 204 also includes a recessed portion 242 which receives at least part of the tabs 202 protruding from the cartridge cover plate 60, preventing any interference between the rotation of the tabs 202 and the spiral cover plate 204 as the cartridge cover plate 60 rotates. As previously mentioned, the spiral following clutch drive arm 36 and the spiral following clutch drive arm pin 58 transfer rotational force to the tabs 202 and the slot 118, respectively. The spiral following clutch drive arm pin 58 receives rotational force from the clutch assembly 194. More particularly, the clutch assembly 194 includes a drive shaft 244 which combines features of both the secondary drive shaft 34 and the power spring drive shaft 50 of the previous embodiments. The drive shaft 244 (similarly to the secondary drive shaft 34 of the previous embodiment) has a double flat key end 246 which extends through the cartridge cover plate secondary drive shaft center 116, through the elongated aperture 114, and is in contact with the bearing surfaces 62 for transferring rotational force to the spiral following clutch drive arm 36. Additionally, the arm 36, and therefore the pin 58, travels outwardly (toward the outer diameter of the cartridge cover plate 60) or inwardly (toward the cartridge cover plate secondary drive shaft center 116), depending on whether there is clockwise or counterclockwise rotation, as the pin 58 moves in the spiral channel 190 of the body 188. This causes the arm 36 to move across the double flat key end 246 of the shaft 244, while still receiving rotational force from the shaft 244.

The drive shaft 244 also includes a power spring primary drive shaft push-button end, generally shown at 248 (similar to the power spring drive shaft push button end 88 as described in the first embodiment), having a first set of flats 250 which are in contact with the second set of flats 152 formed on the small diameter portion 154 of the clutch release push button 66. The push-button end 248 also includes a threaded aperture 252. To attach the push button 66 to the push-button end 248, the button 66 is slid onto the push-button end 248 such that the push-button end 248 is disposed in the hollowed portion 156, the first set of flats 250 contact the second set of flats 152, and the bottom surface 170 of the small diameter portion 154 contacts a set of shoulders 254. The screw 166 is then inserted through the aperture 252 and into the threaded aperture 164 of the shaft 244, securing the push button 66 to the shaft 244.

The shaft 244 also includes an aperture 256 which receives a drive pin 258. The drive pin 258 is positioned in the aperture 256 such that a substantially equal amount of the drive pin 258 protrudes out of the aperture 256 on each side of the drive shaft 244, best shown in FIGS. 43A and 46-47. When assembled, the drive pin 258 is selectively received into one or more of a plurality of locking notches 260 formed as part of a castle end 262 of a power spring drive sleeve, shown generally at 264. The castle end 262 is part of a larger diameter portion 266, and part of the larger diameter portion 266 is adjacent an outer lip 268. The power spring drive sleeve 264 also includes a small diameter portion 270, and a power spring eyelet notch 272. This embodiment also incorporates the same power spring 64 used with the previously described embodiments, and the power spring eyelet notch 272 is used for anchoring the looped portion 144 of the power spring 64 in a similar manner as compared to the notch 148 of the previously described embodiments.

Figure 46:
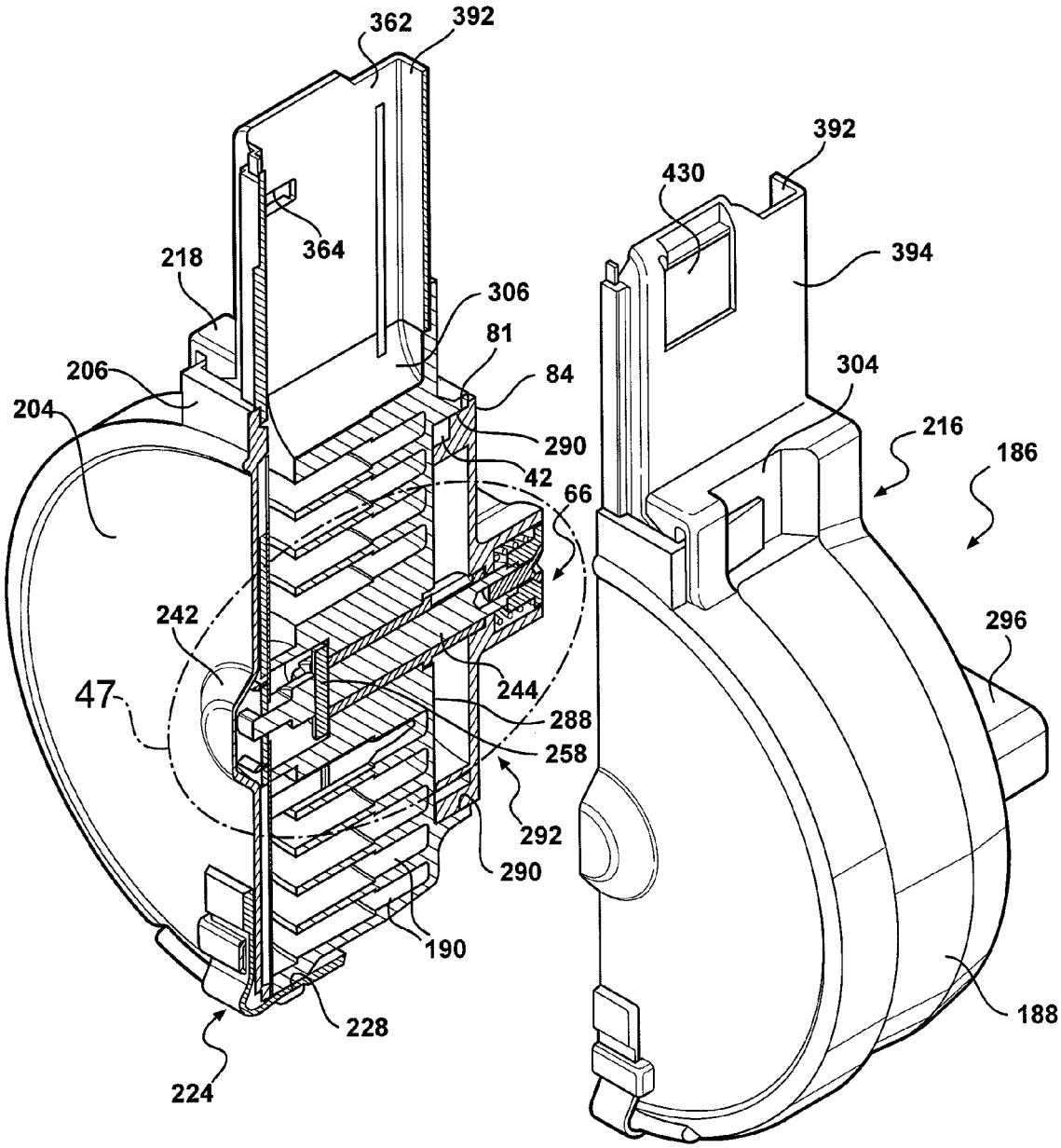
FIG. 46 is a sectional view taken along lines FIG. 46 of FIG. 40.
Figure 47:
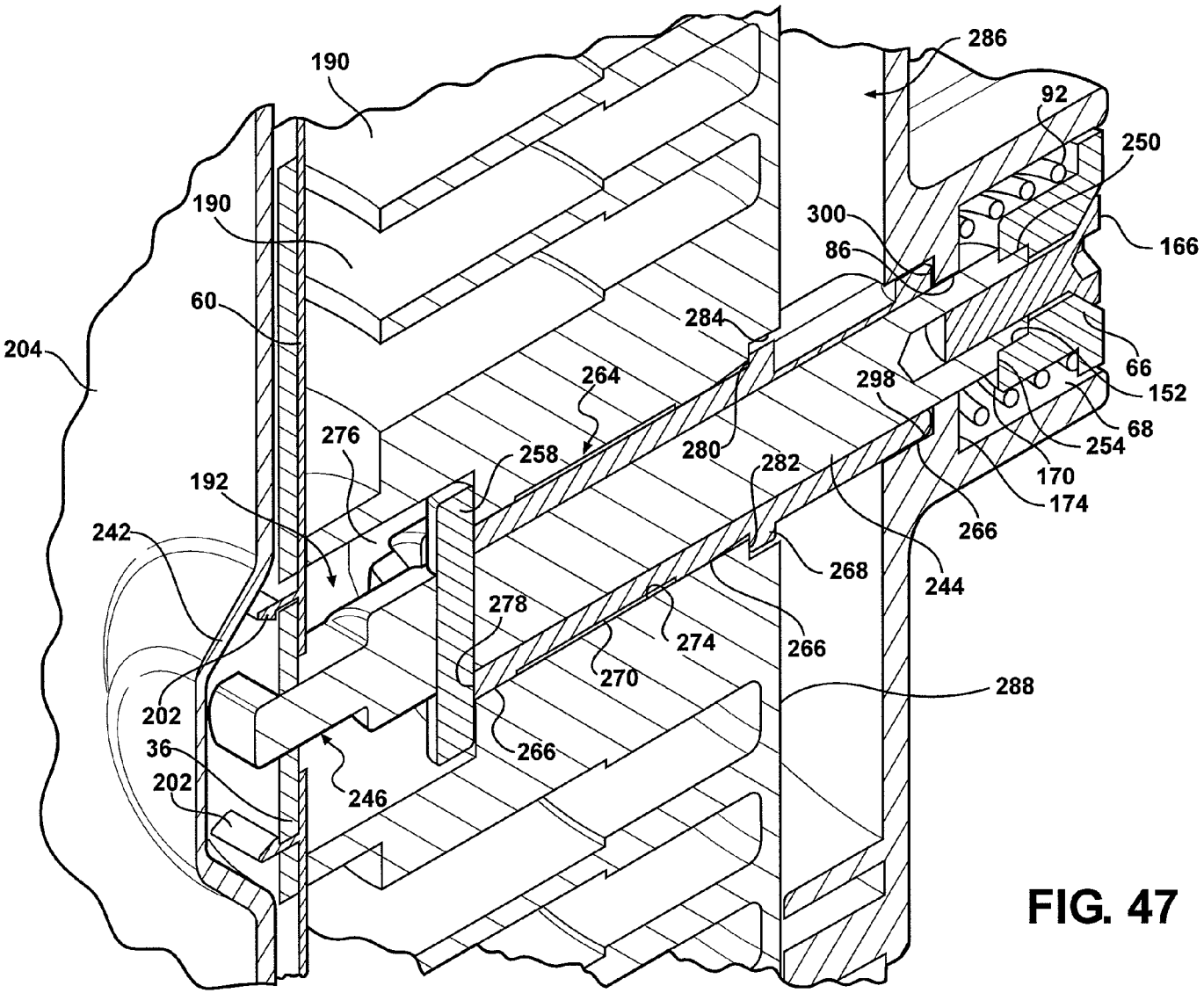
FIG. 47 is an enlarged sectional view of the circled portion shown in FIG. 46.

As best shown in FIGS. 46-47, a portion of the drive shaft 244 extends through the drive shaft opening 274 of the body 188 into the pocket 192 such that the double flat key end 246, the pin 258, and the castle end 262 are disposed in the pocket 192, and the drive pin 258 is selectively in contact with a bottom surface 276 of the pocket 192. The maximum depth 278 of each of the locking notches 260 is in substantial alignment with the bottom surface 276 of the pocket 192 when the feed system 186 is assembled. The large diameter portion 266 of the drive sleeve 264 is selectively in contact with the drive shaft opening 274 because the large diameter portion 266 is of a smaller diameter compared to the drive shaft opening 274. The large diameter portion 266 is of a size to allow the drive shaft sleeve 264 to rotate as freely as possible within the drive shaft opening 274, while still maintaining the proper position of the drive shaft sleeve 264 within the opening 274. This rotation is further facilitated by the small diameter portion 270. Because the small diameter portion 270 is not in contact with the opening 274, there is less overall friction between the drive sleeve 264 and the drive shaft opening 274. The inner surface 280 of the lip 268 is also in contact with the bottom surface 282 of a recess 284 formed in the power spring drive shaft compartment, shown generally at 286.

The power spring drive shaft compartment 286 also includes a firewall 288 and a sidewall 290. The firewall 288 separates the compartment 286 from the spiral channel 190, essentially performing the same function as the firewall 30 described in the previous embodiments. This embodiment of the invention also includes a cam stop winding knob, shown generally at 292. The cam stop winding knob 292 of this embodiment is substantially similar to the cam stop winding knob 38 of the previous embodiment, but also has several different features as well. The cam stop winding knob 292 includes the same cam stop bearings 42, cam stop bearing pockets 80, outer lip 84, power spring pocket 40, and clutch release push button pocket 68. Also similar to the previous embodiment, the clutch release push button pocket 68 includes the power spring drive shaft push-button opening 86 and the contact surface 174.

However, in this embodiment, the cam stop friction race 78 has several hollowed sections 294 where material has been removed, reducing the weight of the cam stop winding knob 292, and therefore reducing the overall weight of the ammunition feeding system 186. Also included is a lever portion 296 which provides the user with leverage for rotating the cam stop winding knob 292. The power spring drive shaft push-button opening 86 also includes a recessed portion 298 having an inner surface 300. When assembled, part of the large diameter portion 266 of the drive sleeve 264 is disposed in the recessed portion 298 and is adjacent the inner surface 300. This embodiment also uses the same power spring 64 used for the previous embodiments, but the cam stop winding knob 292 in this embodiment also includes a slot 302 formed as part of the inner wall 305 of the power spring pocket 40 (which in this embodiment performs the same function as the slot 140 and the cam stop winding knob power spring pocket retainer 74 of the previous embodiments). The slot 302 receives the hook end 142 of the power spring 64, and the looped portion 144 selectively contacts the power spring eyelet notch 272 of the drive sleeve 264.

Figures 43A, 43B:
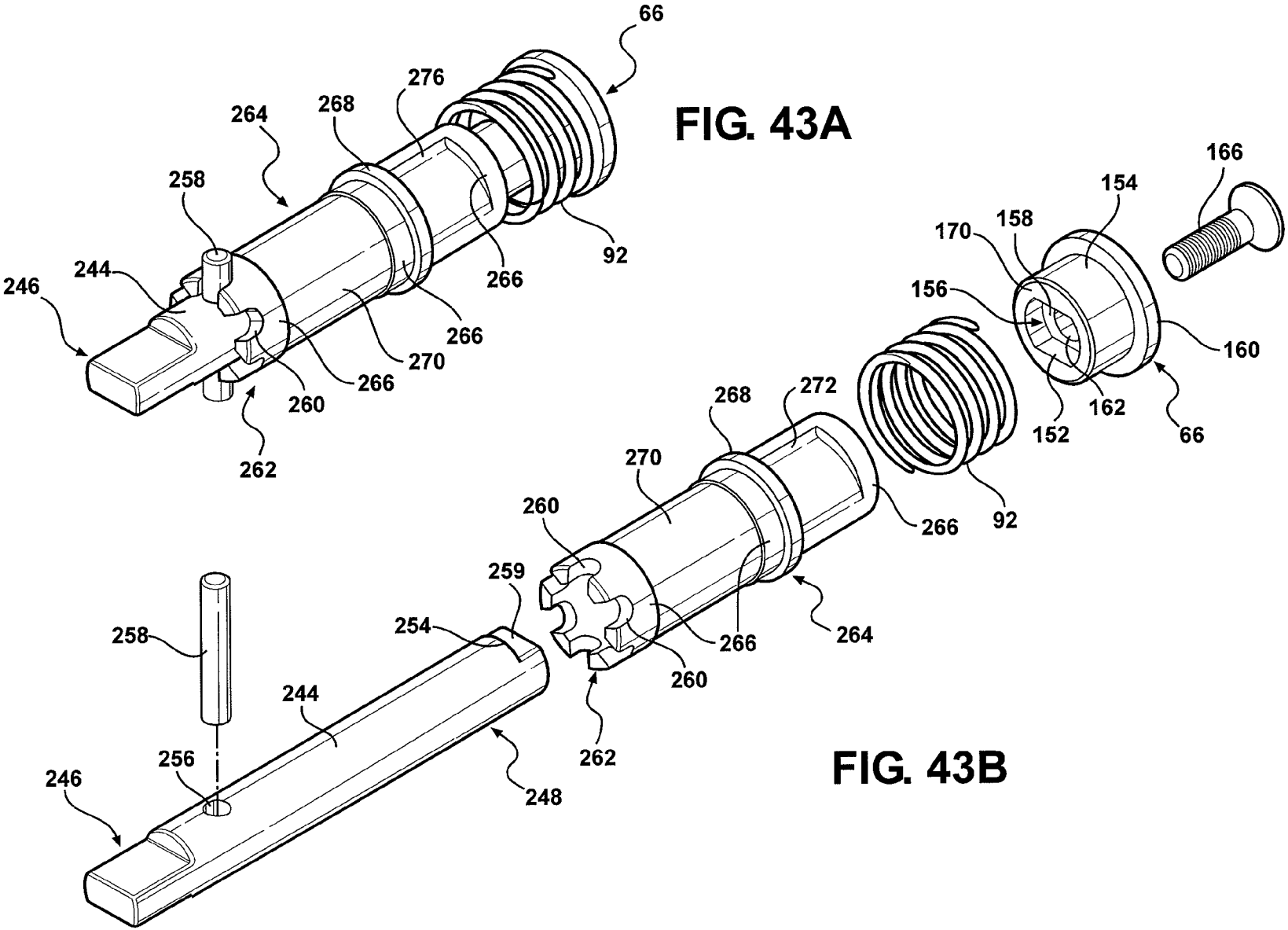
FIG. 43A is a perspective view of a clutch-drive assembly used in a second alternate embodiment of a firearm ammunition feeding system, according to the present invention.
FIG. 43B is an exploded view of a clutch-drive assembly used in a second alternate embodiment of a firearm ammunition feeding system used in, according to the present invention.
Figure 44A:
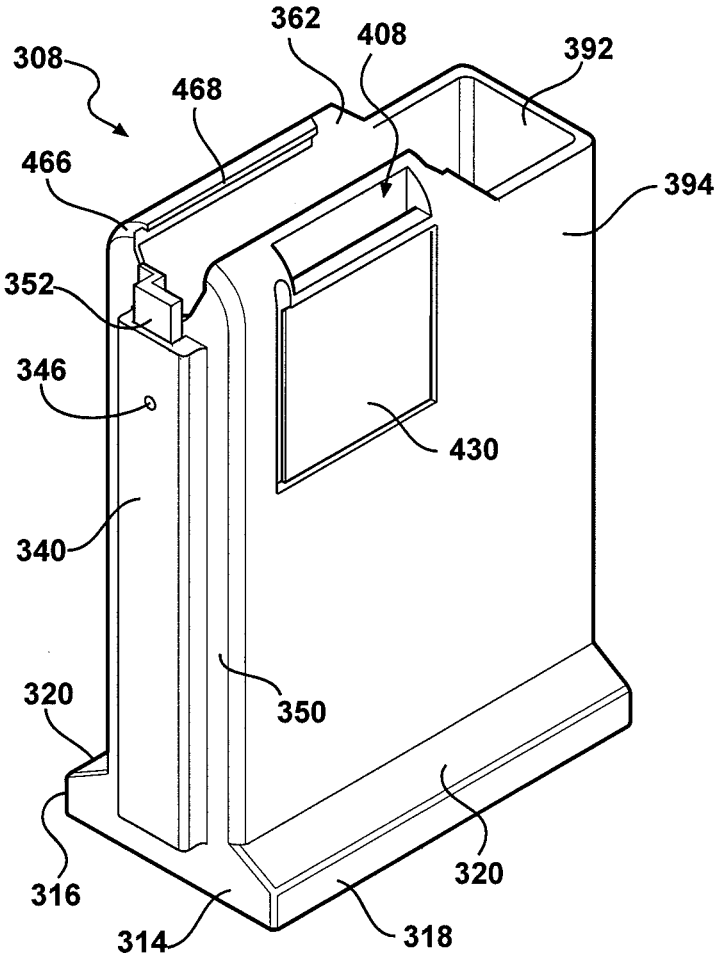
FIG. 44A is a perspective view of a feedneck extension used in a second alternate embodiment of a firearm ammunition feeding system, according to the present invention.

When assembled, the drive sleeve 264 is pushed through the recess 284 of the drive shaft opening 274 until the castle end 262 protrudes out of the pocket 192. The drive shaft 244 is then inserted through the drive sleeve 264 until the drive pin 258 is positioned in two of the locking notches 260 as shown in FIGS. 43A and 46-47. The drive pin 258 prevents the drive shaft 244 from being pushed through the sleeve 264 any further. The cam stop winding knob 292 is then assembled to the body 188, and part of the large diameter portion 266 of the drive sleeve 264 is disposed in the recessed portion 298 and is adjacent the inner surface 300, best shown in FIG. 47. The power spring primary drive shaft push-button end 248 protrudes out of the drive sleeve 264, through the power spring drive shaft push-button opening 86, and into the clutch release push button pocket 68, also shown in FIG. 47. The clutch release push button return spring 92 is positioned in the pocket 68 and contacts the contact surface 174. The clutch release push button 66 is then placed on the push-button end 248 of the shaft 244 such that the first set of flats 250 are in contact with the second set of flats 152, the bottom surface 170 is in contact with the shoulders 254, and the clutch button return spring 92 is positioned between the contact surface 174 and the lower surface 168 of the clutch release push button 66. The screw 166 is then inserted through the aperture 162 of the clutch release push button 66 and into the threaded aperture 252 of the drive shaft 244, securing the clutch release push button 66 to the drive shaft 244. The first set of flats 250 and second set of flats 152 to prevent relative rotation between the drive shaft 244 and the clutch release push button 66.

When the cam stop winding knob 292 is assembled to the body 188, the outer lip 84 is in contact with the outer periphery of the sidewall 290, and the outer wall 81 is adjacent the sidewall 290, best seen in FIG. 46. When the power spring 64 is installed into the power spring drive compartment 286, the power spring 64 is captured between the cam stop winding knob power spring pocket ceiling 72 and the firewall 288 of the power spring drive compartment 286. The spring 64 is contained laterally by the inner wall 305.

As stated above, the body 188 has a shortened neck portion 216, instead of being shaped like the neck 16 described in the previous embodiments. The slots 214, ledges 215, and protrusions 218 are all formed as part of the shortened neck portion 216. Adjacent each of the protrusions 218 is a recessed portion 304, which is where the portion of the locking tabs 208 having the tapered surfaces 210 are located respectively, when the spiral cover plate 204 is attached to the body 188. The spiral channel 190 is connected to a cartridge channel 306, which is also formed as part of the neck portion 216. When in operation, the cartridges 24 are fed from the spiral channel 190 through the cartridge channel 306, and through a feed neck extension, shown generally at 308.

The feed neck extension 308 has a body portion 310 which is correspondingly shaped to be received into a magazine well, shown generally at 312. Connected to the body portion 310 is a rear flange 314. Also connected to the body portion 310 and substantially perpendicular to the rear flange 314 is a first side flange 316 and a second side flange 318. Each of the side flanges 316,318 includes a diagonal portion 320 which positions the side flanges 316,318 at a wider location relative to the body portion 310. Also connected to the body portion 310 and the side flanges 316,318 is a front flange 322, and connected to the front flange 322 is a darted feed neck latch, shown generally at 324. The darted feed neck latch 324 is selectively inserted through an aperture 326 formed as part of a front wall 328.

The neck portion 216 includes a first sidewall 330 and a second sidewall 332. Each sidewall 330,332 includes a slot 214, a recessed portion 304, and a protrusion 218. Formed on the inside of the first sidewall 330 is a first feed neck extension channel 334, and formed on the inside of the second sidewall 332 is a second feed neck extension channel 336. The first feed neck extension channel 334 is complementary in shape to the first side flange 316, and the second feed neck extension channel 336 is complementary in shape to the second side flange 318 such that the feed neck extension 308 is operable to be connected to the neck portion 216. When the feed neck extension 308 is connected to the neck portion 216, there are a pair of angled surfaces 338 which are in contact with the diagonal portions 320, best seen in FIG. 45A, preventing the feed neck extension 308 from becoming detached from the neck portion 216 when assembled together.

The feed neck extension 308 is also held in place by the upper flange 206 when the spiral cover plate 204 is attached to the body 188. When assembled, the upper flange 206 is in contact with a feed neck extension guide rail 340 formed as part of the feed neck extension 308. The feed neck extension guide rail 340 helps to properly position the feed neck extension 308 when connecting the feed neck extension 308 to the firearm, and includes a slot 342 and an aperture 344 which receives a roll pin 346. The feed neck extension 308 also includes a channel 348 which extends along an outer sidewall 350. The channel 348 is offset from the center of the slot 342, and there is a bolt stop actuator 352 having a first flat portion 354, a second flat portion 356, and a third flat portion 358. The first flat portion 354 is connected to the third flat portion 358, and the second flat portion 356 is also connected to the third flat portion 358, with the third flat portion 358 being substantially perpendicular to both the first flat portion 354 and the second flat portion 356. The first flat portion 354 is disposed in the slot 342 and the third flat portion 358 extends through the channel 348. The second flat portion 356 is positioned along the inner surface of the sidewall 350.

When assembled, a portion of the roll pin 346 is disposed in the aperture 344, and a portion of the roll pin 346 extends into the slot 342. The portion of the roll pin 346 that extends into the slot 342 also extends into an elongated aperture 360 formed as part of the first flat portion 354. This limits the range of movement of the bolt stop actuator 352 in the slot 342 to movement between a retracted position (when the actuator 352 is completely disposed in the slot 342) and an extended position (when a portion of the actuator 352 protrudes out of the slot 342), the function of which will be descried later. The range of motion is determined by the length of the elongated aperture 360, which may be different lengths if desired.

Also formed as part of one of the sidewalls 362 of the feed neck extension 308 is a release aperture 364 which, when the feed neck extension 308 is correctly inserted into the magazine well 312, is substantially aligned with the magazine catch channel 366 of the magazine well 312. The magazine catch channel 366 has a lower ledge 368 which is selectively in contact with a corresponding shoulder surface 370 of a double lock latch hook 372.

Figure 48:
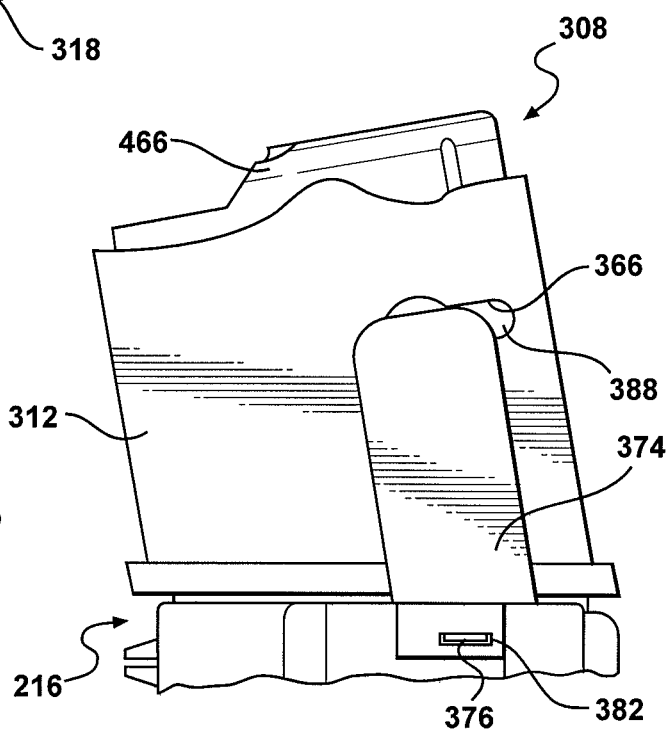
FIG. 48 is a side view of a feedneck extension and a double lock latch attached to a body used in a second alternate embodiment of a firearm ammunition feeding system, with the feedneck extension inserted into a magazine well, according to the present invention.
Figure 44B:
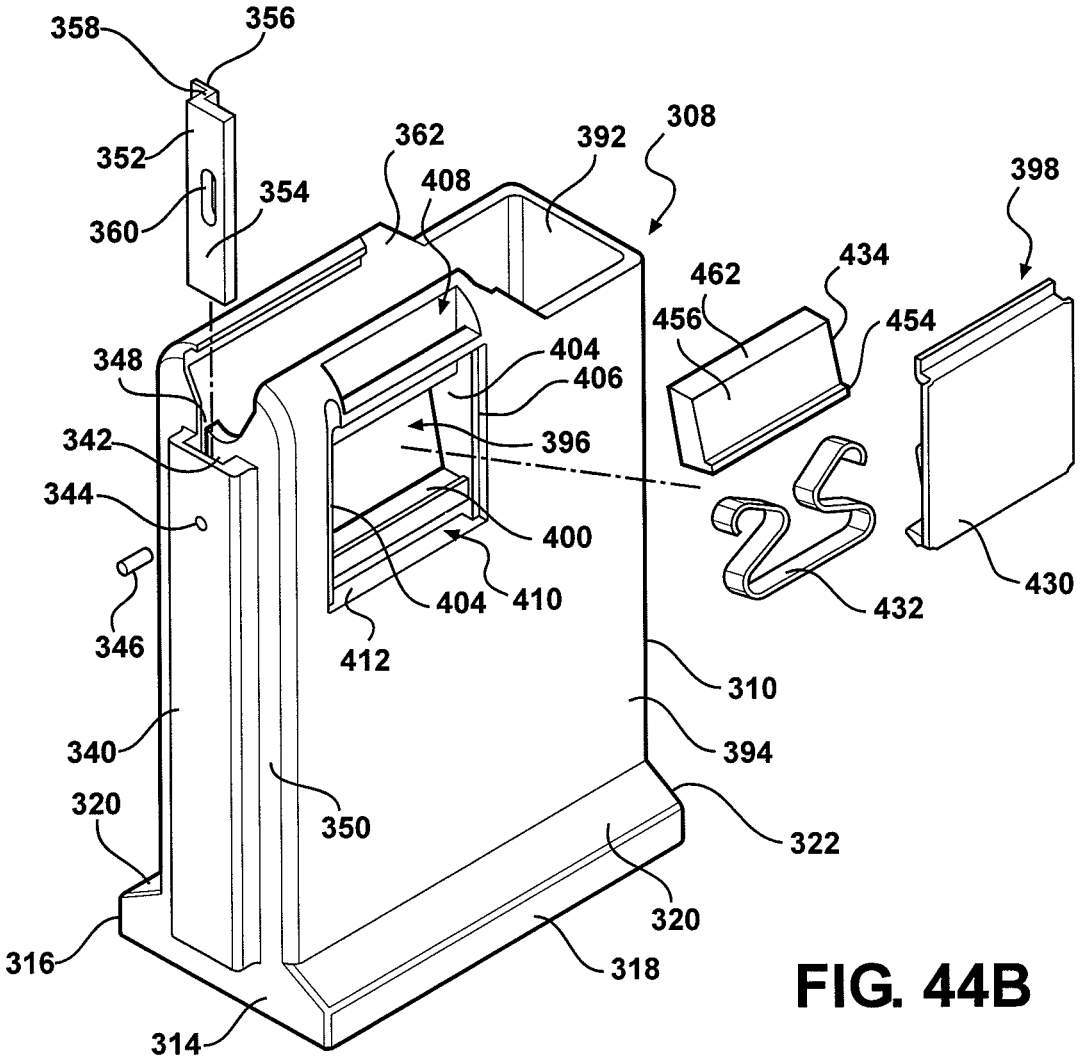
FIG. 44B is an exploded view of a feedneck extension used in a second alternate embodiment of a firearm ammunition feeding system, according to the present invention.
Figure 45A:
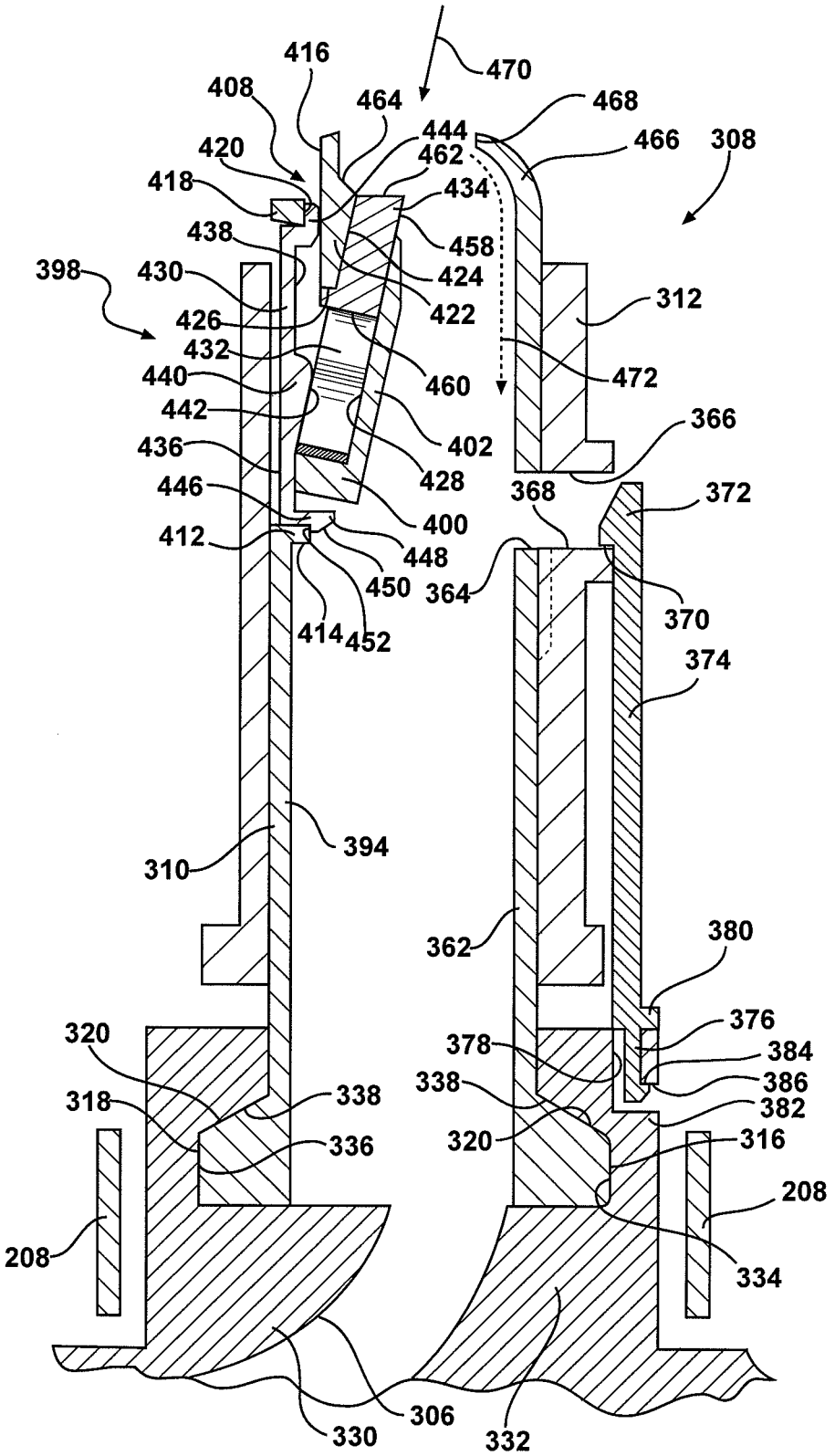
FIG. 45A is a sectional view taken along lines 45A shown in FIG. 45B.
Figure 45B:
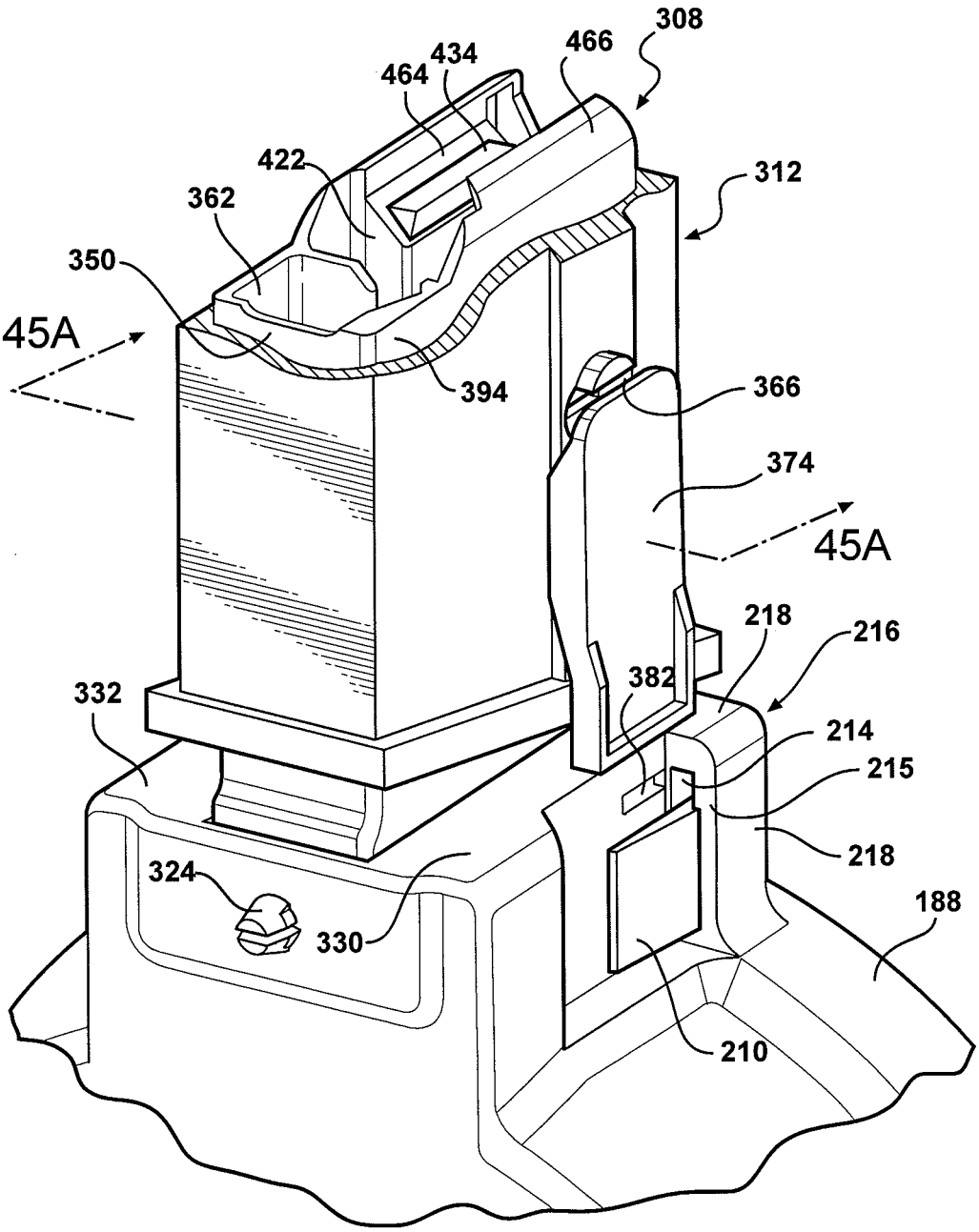
FIG. 45B is a perspective view of a feedneck extension and a double lock latch attached to a body used in a firearm ammunition feeding system, with the feedneck extension inserted into a section of a magazine well, according to the present invention.
Figure 51B:
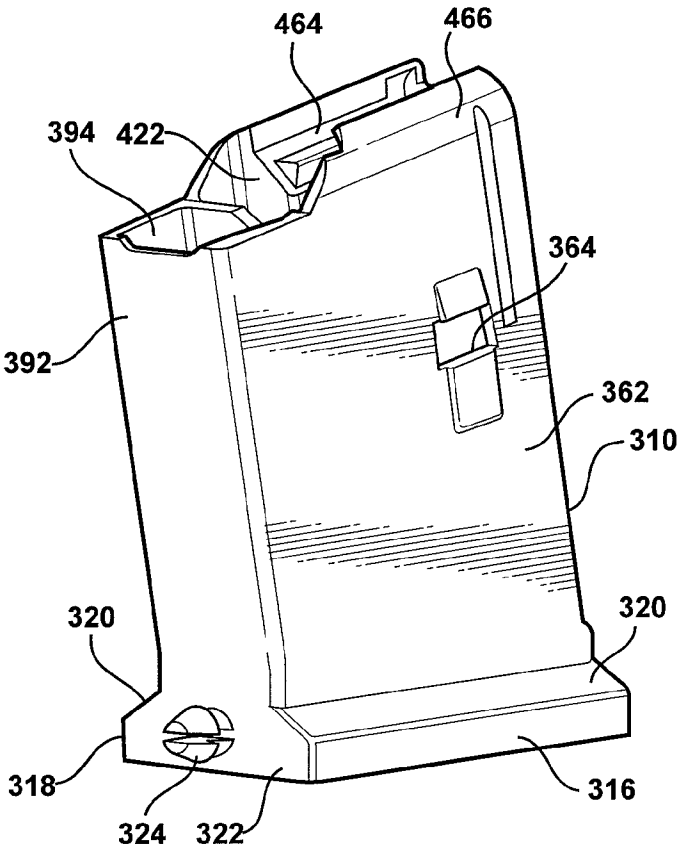
FIG. 51B is the ten-degree angled feedneck extension shown in FIG. 51A removed from the body portion.
Figure 51A:
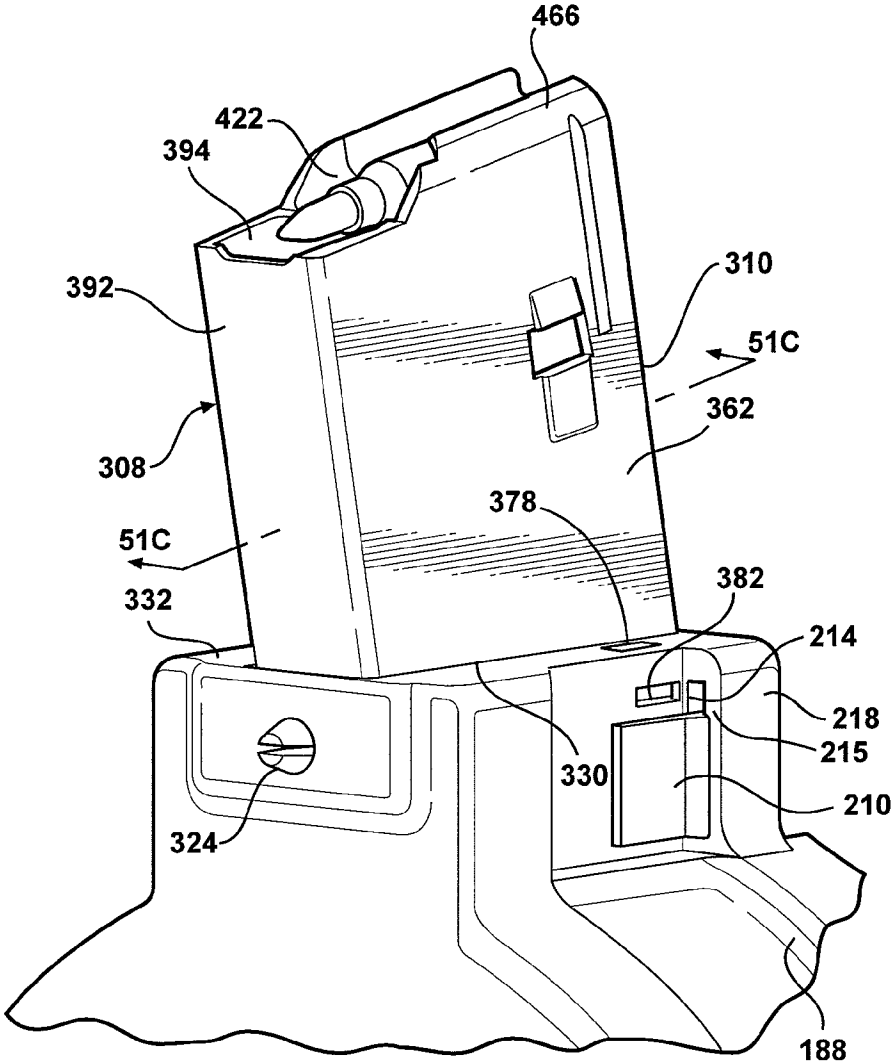
FIG. 51A is a first perspective view of a ten-degree angled feedneck extension connected to a body portion according to the embodiment shown in FIG. 50A.
Figure 51C:
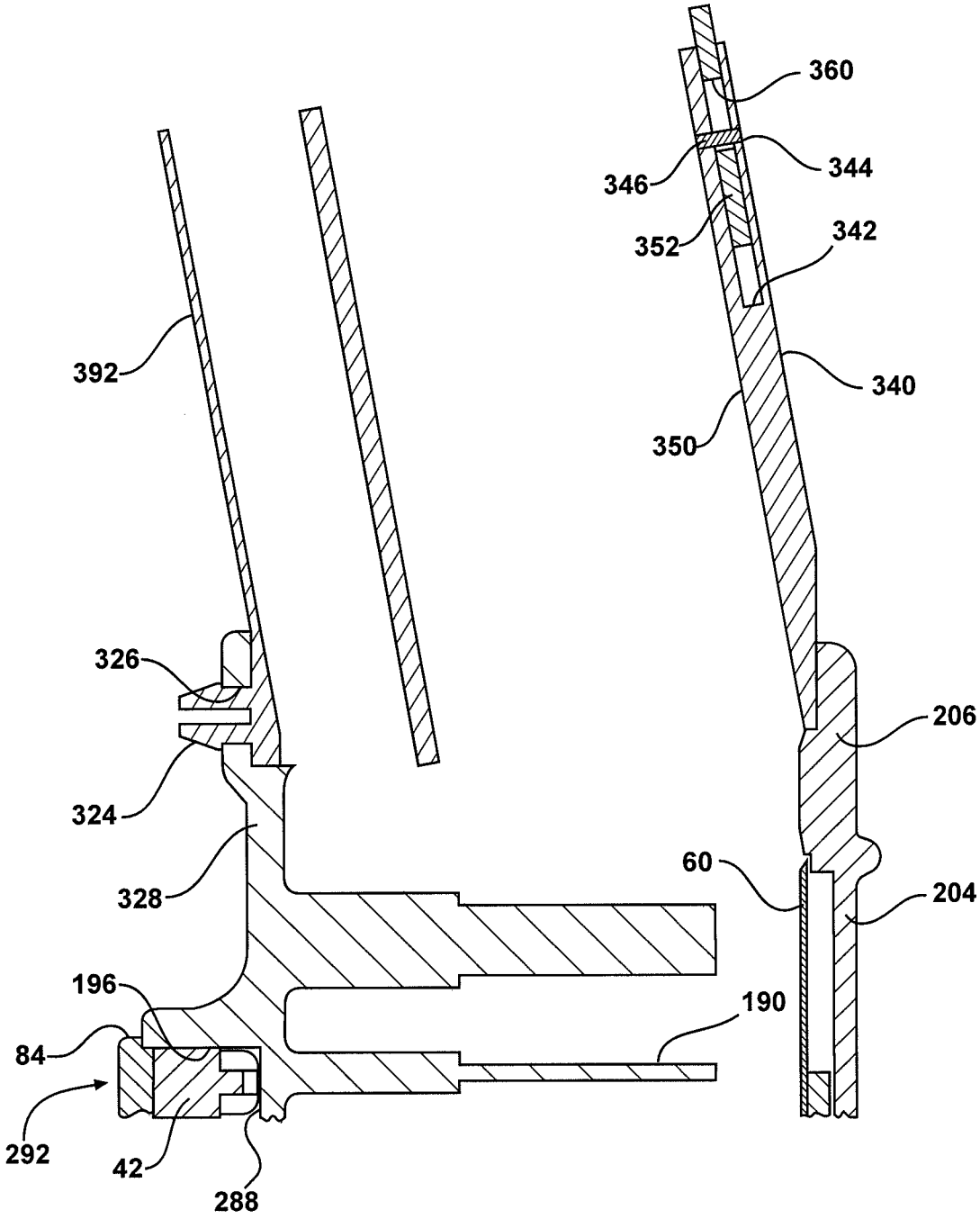
FIG. 51C is a sectional side view taken along lines 51C of FIG. 51B.
Figure 52C:
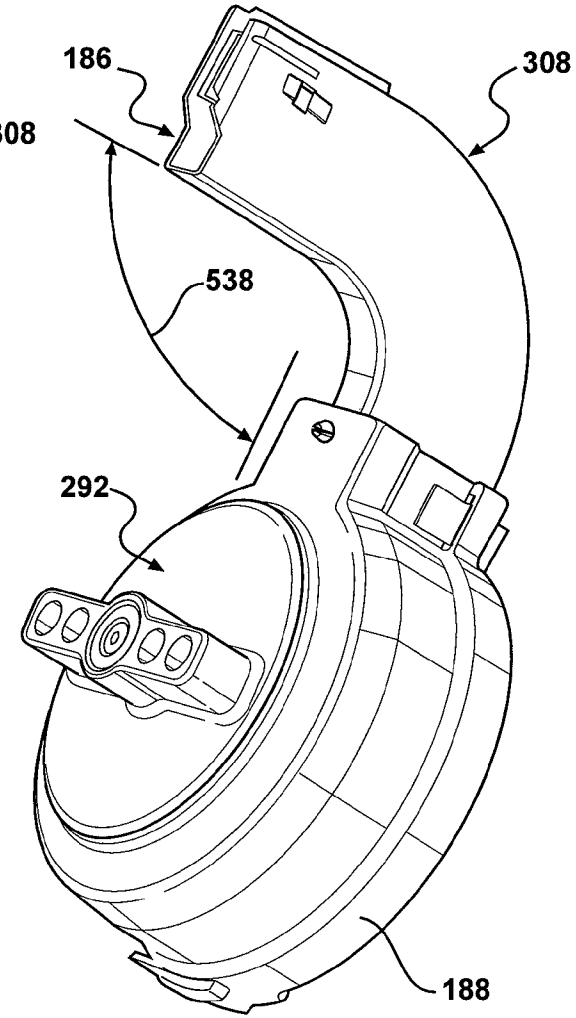
FIG. 52C is a perspective view of yet another alternate embodiment of a firearm ammunition feeding system having a feedneck extension which configures the body to be at an angle of ninety degrees relative to the feedneck extension, according to the present invention.
Figure 52B:
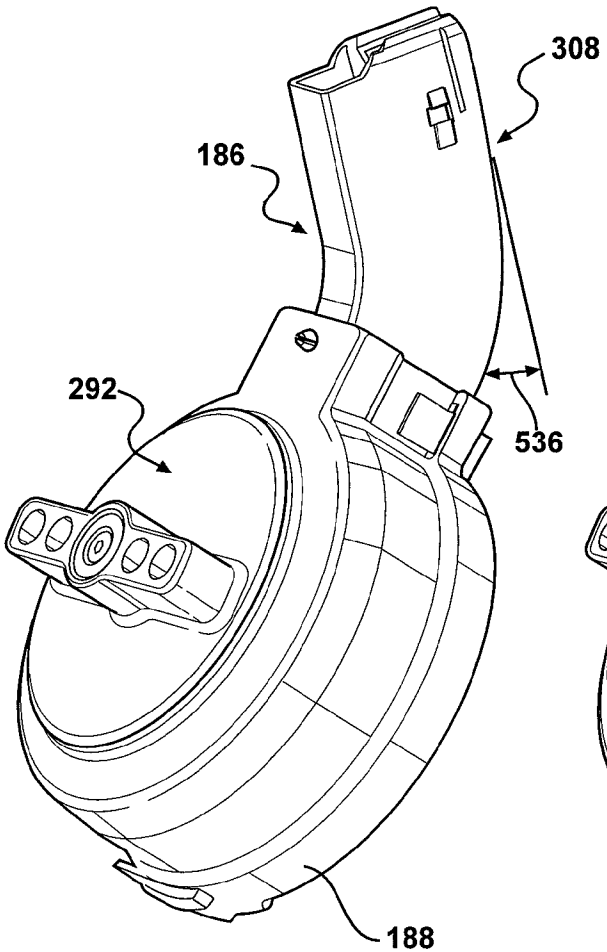
FIG. 52B is a perspective view of another alternate embodiment of a firearm ammunition feeding system having a feedneck extension which configures the body to be at an angle of forty-five degrees relative to the feedneck extension, according to the present invention.
Figure 52A:
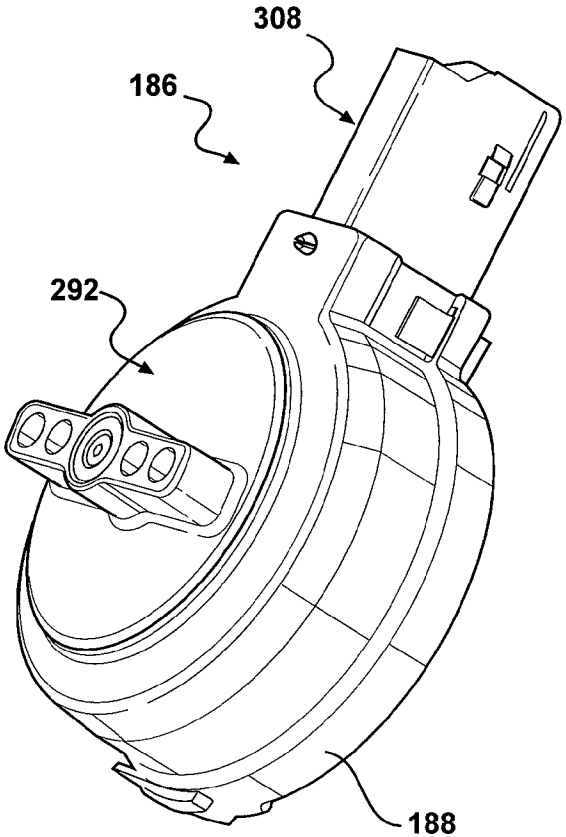
FIG. 52A is a third perspective view of a second alternate embodiment of a housing used in a firearm ammunition feeding system, according to the present invention.

The double lock latch hook 372 is part of a double lock latch 374. The double lock latch 374 also has a double latch retainer hook 376, and the double latch retainer hook 376 is located in a lower channel 378 formed as part of the second sidewall 332. The double lock latch 374 also has a lower flange 380 in contact with the upper surface of the second sidewall 332 as shown in FIGS. 45A, 48, and 51A. There is also a double lock latch disassembly opening 382 formed as part of the lower channel 378. The double latch retainer hook 376 also includes a shoulder surface 384 in contact with an upper surface 386 of the double lock latch disassembly opening 382, preventing the removal of the double lock latch 374 from the double lock latch disassembly opening 382. The distance between the lower flange 380 and the shoulder surface 384 provides for a close fit with the upper surface 386 and the upper surface of the second sidewall 332.

In order to remove the double lock latch 374, the feed neck extension 308 must be removed from the magazine well 312. The end of a screw driver is inserted into the double lock latch disassembly opening 382, and a force is applied to the portion of the double latch retainer hook 376 exposed in the double lock latch disassembly opening 382. Then, the double lock latch 374 is moved to the left when looking at FIG. 45A such that the shoulder surface 384 is no longer in contact with the upper surface 386, and the lower flange 380 is no longer in contact with the upper surface of the second sidewall 332, allowing the double latch retainer hook 376 to be pulled upwardly through the lower channel 378, and therefore allowing the double lock latch 374 to be removed from the neck portion 216, if desired.

The magazine well 312 has an elongated sliding mechanism 388 which is disposed in magazine catch channel 366, and is selectively in contact with the double lock latch hook 372. The elongated sliding mechanism 388 is connected to the release mechanism associated with the firearm for releasing a typical magazine from the magazine well 312. When the body portion 310 of the feed neck extension 308 is disposed in the magazine well 312, the double lock latch hook 372 provides additional support for preventing the feed neck extension 308 from becoming dislodged from the magazine well 312. When it is desired to remove the feed neck extension 308 from the magazine well, the release mechanism of the firearm is actuated, the elongated sliding mechanism 388 moves from left to right when looking at FIG. 45A, and therefore moves in the magazine catch channel 366, but also applies a force to the double lock latch hook 372, causing the double lock latch 374 to deflect, and the shoulder surface 370 to no longer be in contact with the lower ledge 368. The feed neck extension 308 is then removable from the magazine well 312.

The elongated sliding mechanism 388 is a commonly known part used with most conventional firearms. The ammunition feeding system 186 of the present embodiment expands on the use of the elongated sliding mechanism 388 by using the elongating sliding mechanism 388 to actuate and release the double lock latch 374 as described above. The use of the double lock latch 374 helps to additionally secure the feed neck extension 308 to the magazine well 312, but since the double lock latch 374 does not require any additional actuation (other than using the release mechanism), the user of the firearm still uses the release mechanism of the firearm in a known manner.

The body portion 310 also includes another sidewall 392 which is substantially parallel to the sidewall 350 having the slot 342 and channel 348, and yet another sidewall 394 which is substantially parallel to the sidewall 362 having the release aperture 364. The sidewall 394 also includes a pocket, generally shown at 396, in which is located a cartridge stop assembly, generally shown at 398. The pocket 396 includes an angled ledge 400 which terminates into an angled wall portion 402. Adjacent and connected to the angled ledge 400 and the angled wall portion 402 are a pair of pocket sidewalls 404, each of which has a sidewall lip 406. There is also an upper gap, shown generally at 408, and a lower gap, shown generally at 410. Below the lower gap 410 is a sidewall ledge 412 formed as part of the sidewall 394, and the sidewall ledge 412 has a lipped portion 414.

When looking at FIG. 45A, to the right of the upper gap 408 is a back wall 416, and to the left of the upper gap 408 is a beam portion 418 having an inner surface 420. The back wall 416 is also formed as part of a cartridge stop guide section or feed lip 422 having a first cartridge stop guide surface 424 and an angled cartridge stop surface 426. The first cartridge stop guide surface 424 is substantially parallel to a second cartridge stop guide surface 428 formed as part of the angled wall portion 402.

The cartridge stop assembly 398 includes a stop cover 430, a biasable member, which in this embodiment is a flat spring 432, and a cartridge stop 434. The stop cover 430 has an outer surface 436 which is substantially parallel to the sidewall 394 when the cartridge stop assembly 398 is assembled in the pocket 396. The stop cover 430 also has an inner surface 438, and formed as part of the inner surface is a stop cover guide section 440, which has a spring guide surface 442. An upper tab 444 is also formed as part of the stop cover 430, and is substantially parallel to and offset from the inner surface 438. A lower tab 446 is formed as part of the stop cover 430 and is substantially perpendicular to the inner surface 438. The lower tab 446 includes a shoulder 448 having a tapered surface 450 and a contact surface 452.

The cartridge stop 434 includes a stop ledge 454 which is selectively in contact with the cartridge stop surface 426 when the cartridge stop 434 is in an extended position. The stop ledge 454 is adjacent an outer guide surface 456, and the outer guide surface 456 is in sliding contact with the first cartridge stop guide surface 424. The cartridge stop 434 also includes an outer guide surface 458 in sliding contact with the second cartridge stop guide surface 428, and a biasing surface 460 which is in contact with the flat spring 432. The flat spring 432 is also disposed in the pocket 396, and is located between the second cartridge stop guide surface 428 and the spring guide surface 442. The flat spring 432 is also located on the angled ledge 400, and the angled ledge 400 is substantially perpendicular to the spring guide surface 442 and the cartridge stop guide surfaces 424,428.

The cartridge stop 434 is designed to be a width that allows the cartridge stop 434 to fit between the pocket sidewalls 404. The cartridge stop 434 is shown in the extended position in FIGS. 39, 45A-45B, and 51B, and when in the extended position, the cartridge stop 434 is designed to prevent the removal of the cartridges 24 from the feed neck extension 308 (other than through the use of the forward stripping action of a firearm slide, bolt, or feeding method; cartridges 24 may also be manually stripped from the lips by the user). The cartridge stop 434 also includes an outer contact surface 462 which is angled in relation to the biasing surface 460. The outer contact surface 462 is also adjacent an angled outer contact surface 464 formed as part of the cartridge stop guide section 422.

To assemble the cartridge stop assembly 398, the cartridge stop 434 is placed between the cartridge stop guide surfaces 424,428, and the flat spring 432 is positioned in the pocket 396 underneath the cartridge stop 434 such that the flat spring 432 is located between the cartridge stop 434 and the angled ledge 400. The first cartridge stop guide surface 424 is in contact with the inner guide surface 456, and the outer guide surface 458 is in contact with the second cartridge stop guide surface 428.

To assemble the stop cover 430 to the body portion 310, initially the upper tab 444 is inserted into the upper gap 408 such that the upper tab 444 is disposed between the back wall 416 and the inner surface 420 of the beam portion 418, and the stop cover 430 is then pushed towards the pocket 396 such that the tapered surface 450 slides along the sidewall ledge 412 and the lower tab 446 moves into the lower gap 410. The contact between the tapered surface 540 and the sidewall ledge 412 causes the lower tab 446 to deflect, generating a tension in the lower tab 446. Once the lower tab 446 has moved far enough into the lower gap 410, and the tapered surface 540 is no longer in contact with the sidewall ledge 412, the tension in the lower tab 446 is released, and the lower tab 446 returns to its normal position, causing the shoulder 448 to be in contact with the contact surface 452 of the lipped portion 414, thereby preventing the removal of the stop cover 430 from the pocket 396. The lower tab 446 having the shoulder 448 being used in combination with the lower gap 410 and the lipped portion 414 provides for a "snap fit" connection.

Formed as part of the sidewall 362 having the release aperture 364 is a feed lip or curved section 466. Cartridges 24 may optionally be loaded into the spiral channel 190 through the feed neck extension 308 by placing the cartridges 24 (one at a time) on the contact surfaces 462,464 and in contact with the outer edge 468 of the curved section 466. Force is applied to the cartridge 24 by pressing on the cartridge 24 in the direction of the arrow 470, and this force is transferred to the cartridge stop 434. Once enough force is applied to the cartridge 24, the force applied to the cartridge stop 434 by the flat spring 432 is overcome, and the cartridge stop 434 retracts and moves in a direction towards the angled ledge 400. Once the cartridge stop 434 has retracted enough, the cartridge 24 moves down into the feed neck extension 308 and follows the path indicated by the arrow 472. Once inside the feed neck extension 308, each cartridge 24 is supported by a cartridge follower assembly, shown generally at 474.

The cartridge follower assembly 474 is operable for movement through the spiral channel 190, the cartridge channel 306, and portions of the cartridge follower assembly 474 are able to move through the feed neck extension 308. The cartridge follower assembly 474 has a lead follower 476, a plurality of shell followers 478, and a bolt stop actuator follower 480. While it is shown in the drawings that the cartridge follower assembly 474 has ten shell followers 478, it is within the scope of the invention that more or less shell followers 478 may be used.

The lead follower 476 is made up of a lead follower top 482 having a follower top aperture 484 which receives a portion of a lead follower dowel 486. Another portion of the lead follower dowel 486 is received into a follower bottom aperture 488 formed as part of a lead follower bottom 490. The lead follower bottom 490 also has a tapered section 492.

Each of the shell followers 478 has a shell follower top 494 having a shell follower top aperture 496 which receives a portion of a shell follower dowel 498. The shell follower dowel 498 is also partially received into a shell follower bottom aperture 500 formed as part of a shell follower bottom 502. In an alternate embodiment, the construction of the shell followers 478 may be simplified by integrating the shell follower dowel 498 with the shell follower top 494, and manufacturing them as a single component.

The bolt stop actuator follower 480 includes an actuator follower top 504 and an actuator follower top aperture 506. The actuator follower top aperture 506 receives part of an actuator follower dowel 508, and part of the actuator follower dowel 508 is received into an actuator follower bottom aperture 510 formed as part of an actuator follower bottom 512. Also received into the actuator follower bottom aperture 510 is a dowel spring 514 and a plunger 516. The plunger 516 includes a stopper portion or enlarged diameter portion 518 and a shaft portion 520. The actuator follower bottom aperture 510 also includes a large diameter portion 522 and a small diameter portion 524, which terminates into a retainer surface 526. During assembly, the plunger 516 is inserted into the actuator follower bottom aperture 510, followed by the dowel spring 514. The actuator follower dowel 508 is then inserted into the aperture 510, and the spring 514 is therefore positioned between the actuator follower dowel 508 and the enlarged diameter portion 518. The plunger 516 is movable within the aperture 510 between a retracted position (where the shaft portion 520 is completely retracted into the small diameter portion 524, and the enlarged diameter portion 518 is not in contact with the retainer surface 526) and an extended position (where the spring 514 biases the plunger 516 outwardly, the shaft portion 520 protrudes out of the small diameter portion 524, and the enlarged diameter portion 518 is in contact with the retainer surface 526).

Figure 41:
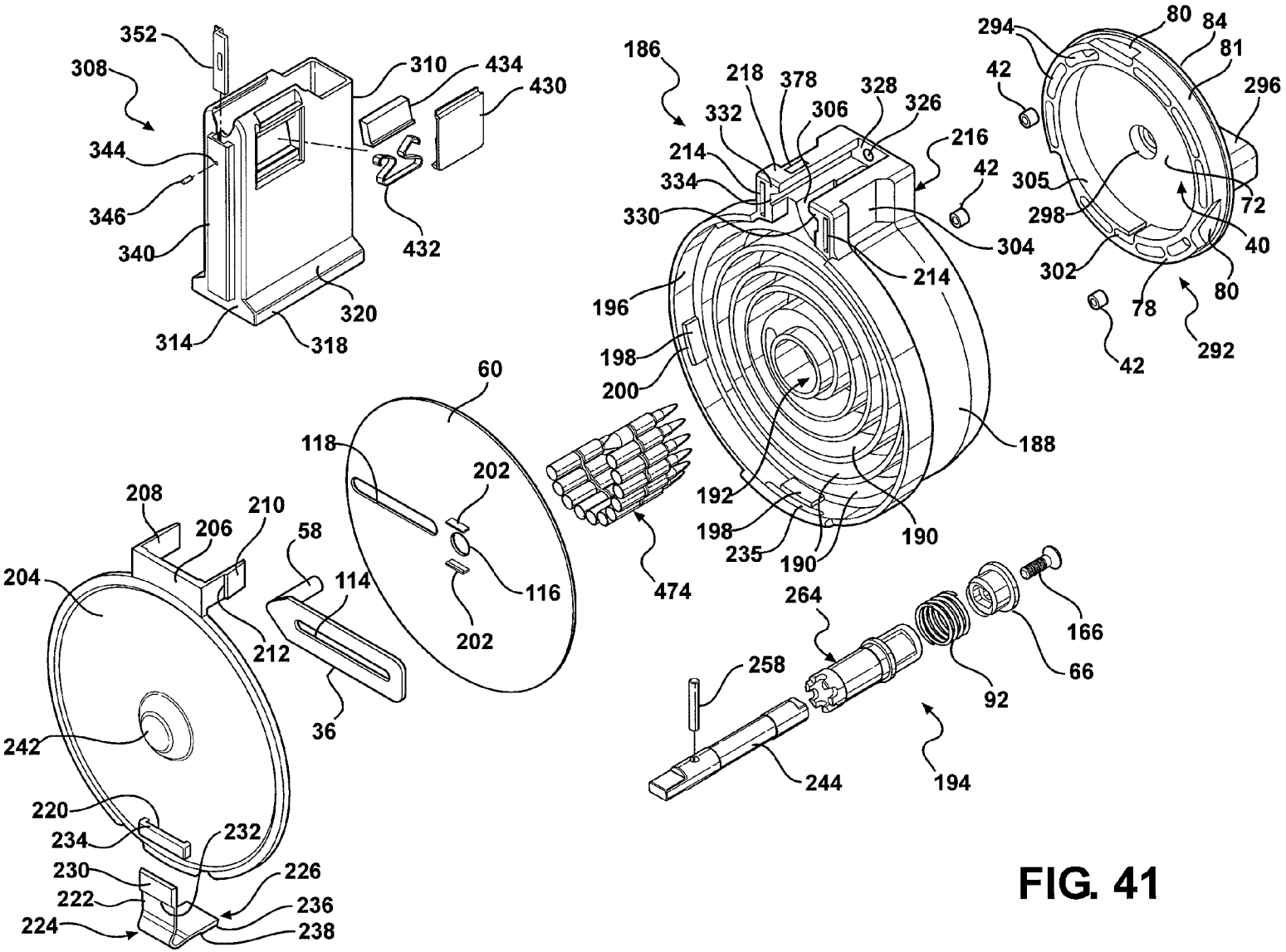
FIG. 41 is a first exploded view of a second alternate embodiment of a firearm ammunition feeding system, according to the present invention.
Figure 42:
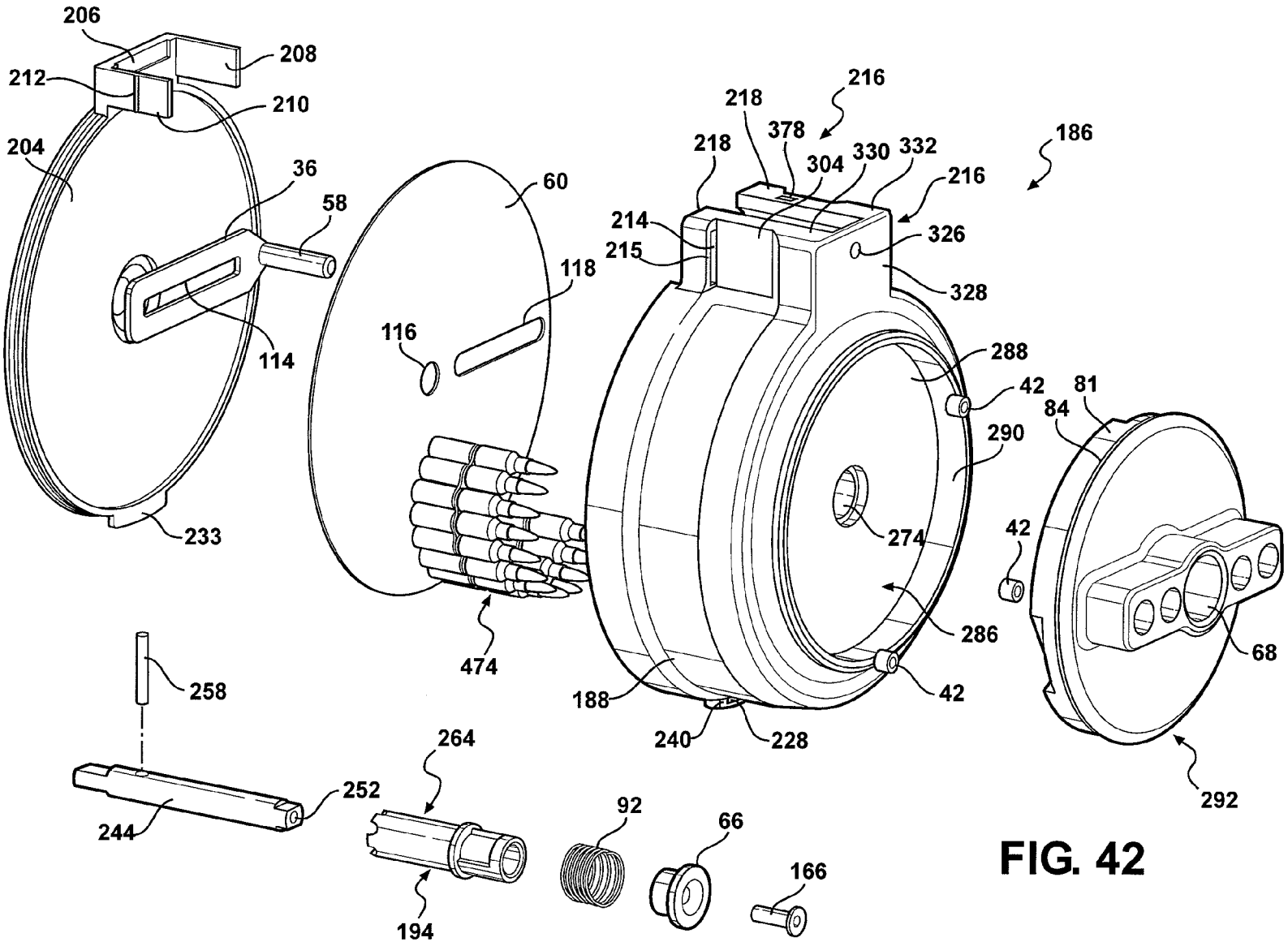
FIG. 42 is a second exploded view of a second alternate embodiment of a firearm ammunition feeding system, according to the present invention.
Figure 49A:
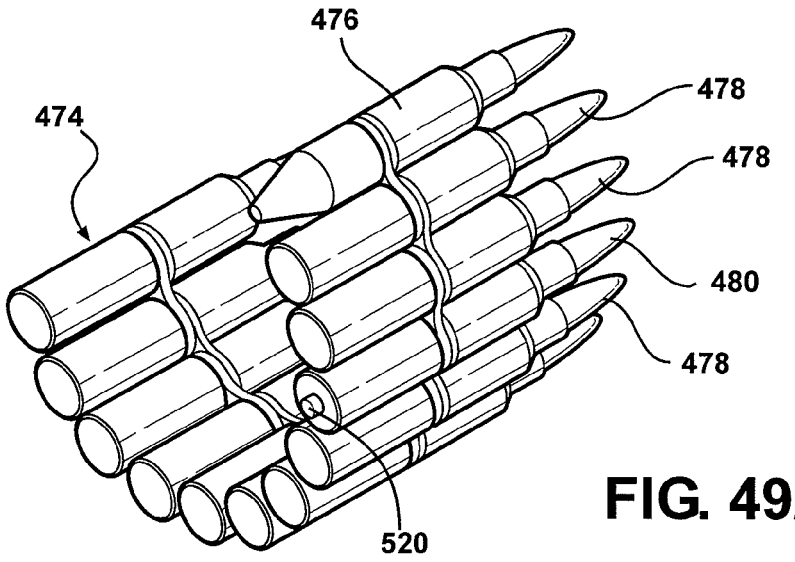
FIG. 49A is a perspective view of a cartridge follower assembly used in a second alternate embodiment of a firearm ammunition feeding system, according to the present invention.
Figure 49B:
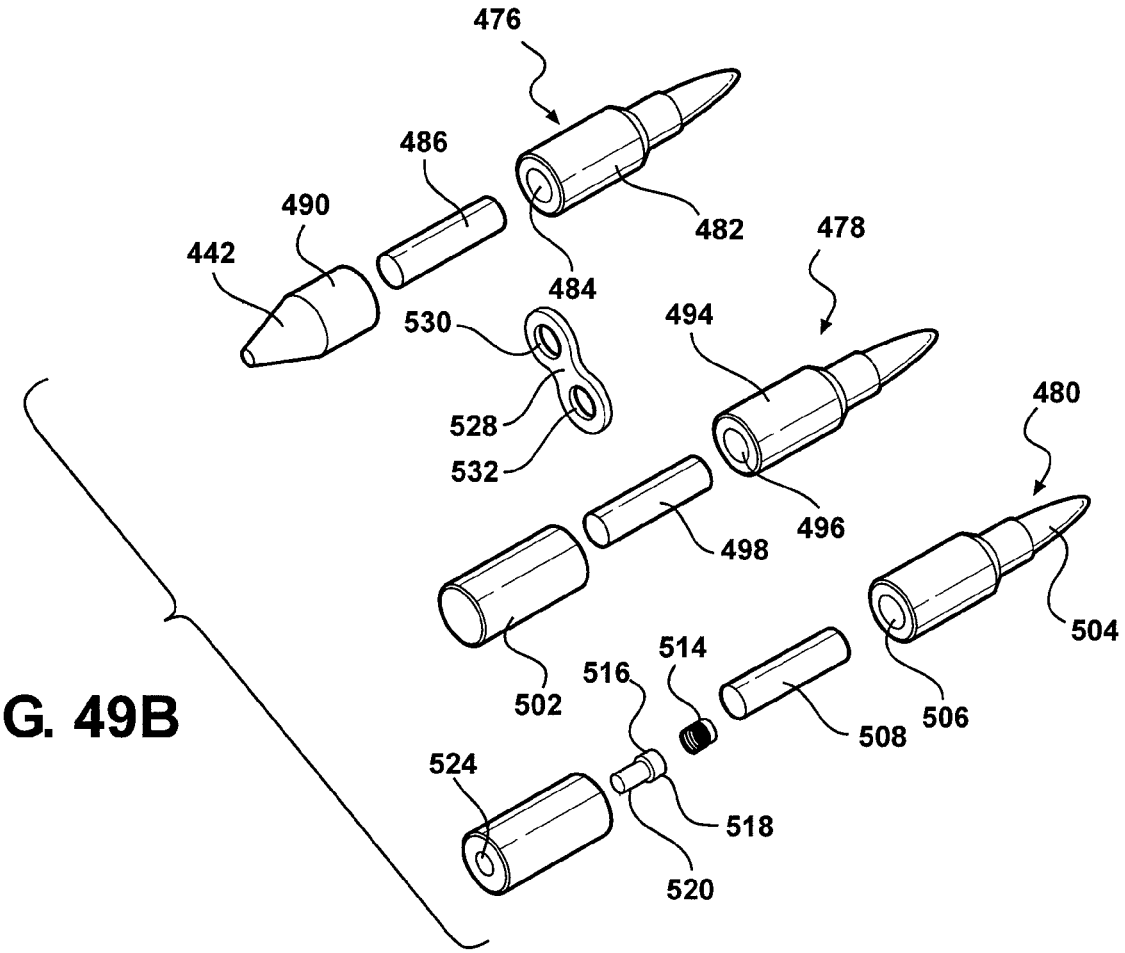
FIG. 49B is a first exploded view of a lead follower, a shell follower, and a bolt stop actuator follower used in a cartridge follower assembly for a second alternate embodiment of a firearm ammunition feeding system, according to the present invention.
Figure 49C:
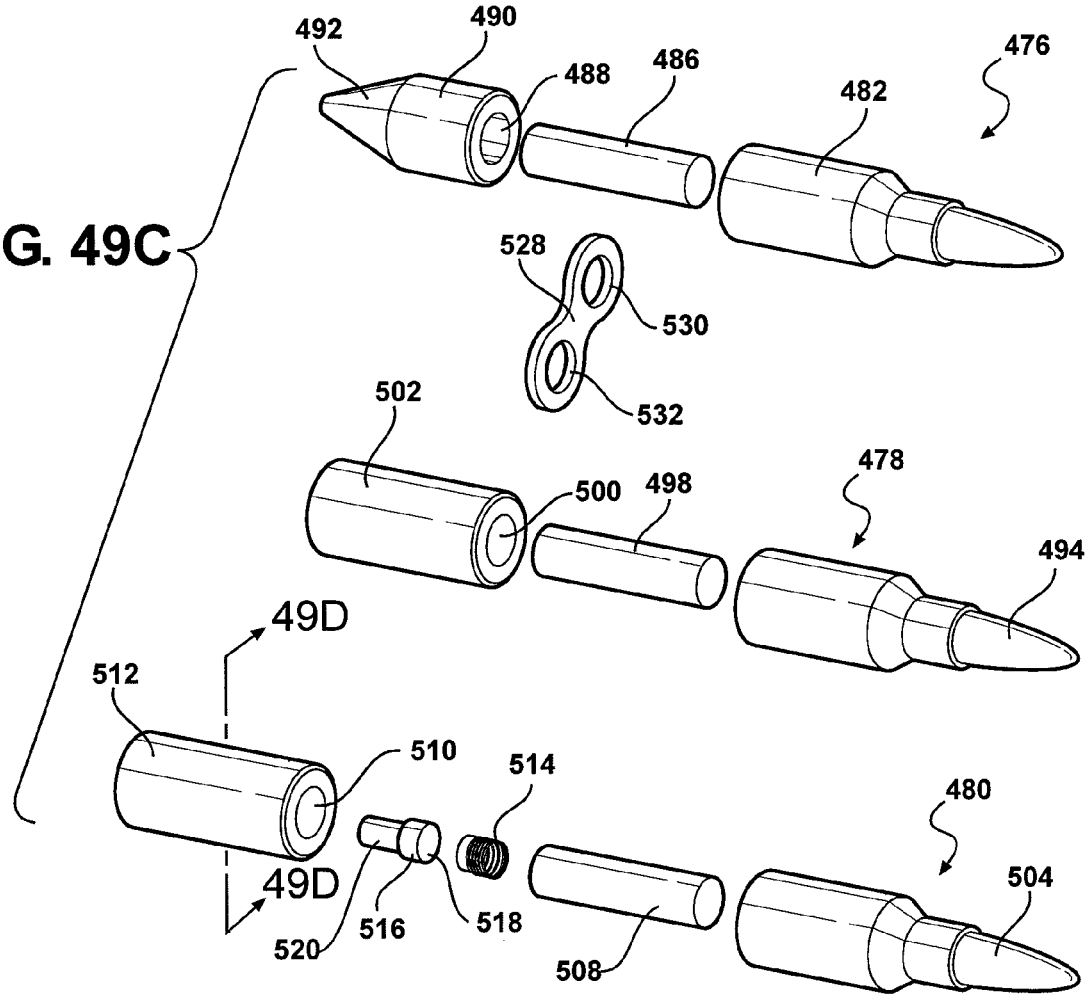
FIG. 49C is a second exploded view of a lead follower, a shell follower, and a bolt stop actuator follower used in a second alternate embodiment of a firearm ammunition feeding system, according to the present invention.
Figure 49D:
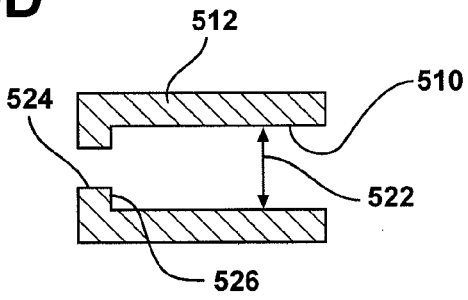
FIG. 49D is a sectional view taken along lines 49D of FIG. 49C.
Figure 50B:
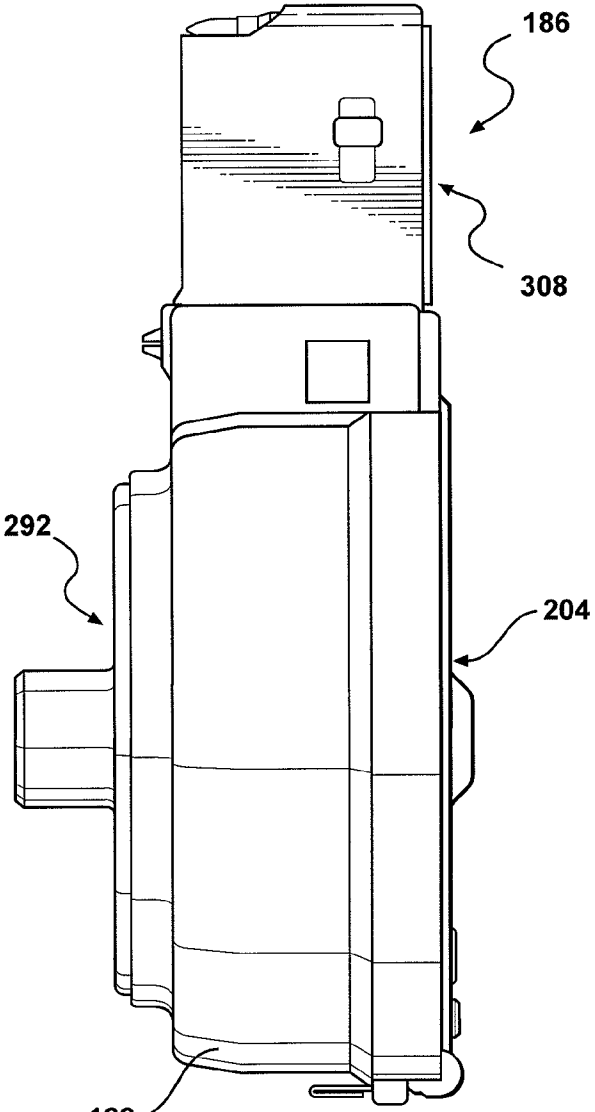
FIG. 50B is a side view of a second alternate embodiment of a firearm ammunition feeding system, according to the present invention.
Figure 50A:
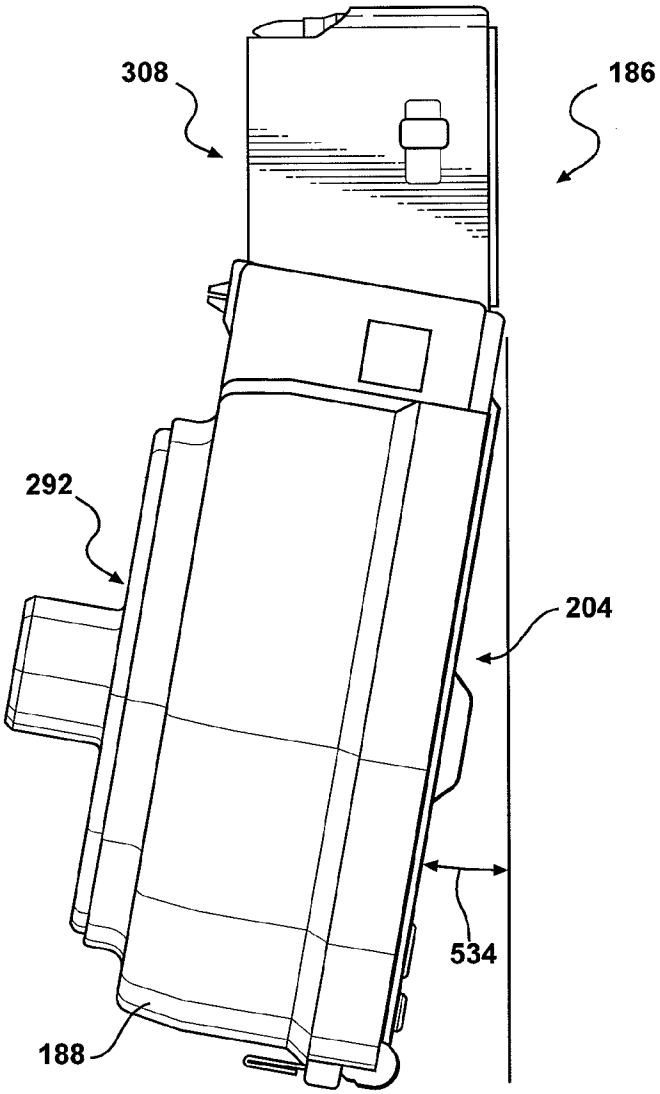
FIG. 50A is a side view of another alternate embodiment of a firearm ammunition feeding system having a feedneck extension which configures the body to be at an angle of ten degrees relative to the feedneck extension, according to the present invention.

The followers 476,478,480 are connected together through the use of a plurality of follower links 528, each having a first dowel aperture 530 and a second dowel aperture 532. The follower links 528 are positioned in a staggered fashion, best shown in FIGS. 41-42, and 49A. During assembly, the lead follower dowel 486 is inserted through the first dowel aperture 530 of the first of the plurality of links 528 prior to the lead follower dowel 486 being inserted into one of the apertures 484,488. The shell follower dowel 498 is then inserted through the second dowel aperture 532 as well as the first dowel aperture 530 of a subsequent link 528 prior to being inserted into one of the apertures 496,500. This process is repeated for each of the shell followers 478 and the bolt stop actuator follower 480 until the cartridge follower assembly 474 is assembled as shown in FIGS. 41-42 and 49A.

In operation, and referring generally again to FIGS. 39-52C, when it is desired to load and use the system 186 of the present invention, and the system 186 is in an assembled state as shown in FIGS. 39-40, 46-47, 50A-50B, and 52A-52C, the user simply applies a force to the tapered surfaces 210 of each of the locking tabs 208 to remove each shoulder 212 from the respective ledges 215, allowing the tabs 208 to move through the slots 214 as the user pulls on the cover plate 204. Because of the strap 224, the cover plate 204 may be folded away from the body 188, without being completely disconnected from the body 188, which helps prevent the cover plate 204 from becoming lost or misplaced. However, if it is desired to completely remove the cover plate 204 from the body 188, the user simply applies a force to the tapered surface 230 of the first portion 222 of the strap 224, to allow the first portion 222 to be pulled through the slot 220. Once the tabs 208 have been pulled through the slots 214 and the first portion 222 of the strap 224 has been pulled through the slot 220, the cover plate 204 is completely detached from the body 188.

Once the cover plate 204 is removed, the spiral following cartridge drive arm 36 and the cartridge cover plate 60 are removed as well. This allows the user to place the cartridges 24 in the spiral channel 190 individually. The cartridge cover plate 60, spiral following cartridge drive arm 36, and cover plate 204 are then reassembled to the body 188. Alternatively, the cartridges 24 may be dumped into the body 188 and surrounded by the sidewall 196. The cartridge cover plate 60, spiral following cartridge drive arm 36, and cover plate 204 are then reassembled to the body 188; the body 188 is then shaken, and the cartridges 24 self-locate into the spiral channel 190. To fully load the spiral channel 190 with cartridges 24, the cartridge follower assembly 474 and the spiral following cartridge drive arm pin 58 are optimally placed at the centermost part of the spiral channel 190, which is substantially adjacent to the pocket 192. Additional cartridges 24 may be loaded into the feed neck extension 308 as described above.

Once the spiral channel 190 is loaded with cartridges 24, and the cartridge cover plate 60, spiral following cartridge drive arm 36, and cover plate 204 are then reassembled to the body 188, the cam stop winding knob 292 is rotated using the lever 296, generating tension in the power spring 64. As the cam stop winding knob 292 is rotated, the cam stop winding knob 292 is prevented from rotating in the opposite direction because of the cam stop bearings 42 and the cam bearing pockets 80 generating the pawl action in the same manner as described with reference to the previous embodiments. Rotational force is transferred from the cam stop winding knob 292 to the slot 302 formed as part of the cam stop winding knob power spring pocket retainer 305, the hook end 142 of the power spring 64, the power spring 64, the looped portion 144 of the power spring 64, and then to the power spring eyelet notch 272 of the drive sleeve 264.

However, the drive sleeve 264 does not rotate, thereby generating the aforementioned tension in the power spring 64. The drive sleeve 264 receives a reactionary force from the drive pin 258. The cartridges 24 are prevented from exiting the feed neck extension 308 by the cartridge stop 434 and the feed lip 466. This generates the reactionary force that is transferred through the cartridges 24, the cartridge follower assembly 474, the spiral following cartridge drive arm pin 58, the spiral following cartridge drive arm 36, the double flat key end 246 of the drive shaft 244, the drive shaft 244, the drive pin 258, the locking notches 260 formed as part of the castle end 262 of the drive sleeve 264, and the drive sleeve 264. Therefore, the drive sleeve 264 does not rotate when the cam stop winding knob 292 is rotated, and tension builds in the power spring 64.

Once the user has rotated the cam stop winding knob 292 to generate the desired amount of tension in the power spring 64, the cam stop winding knob 292 does not move, and the firearm is ready for use. As the user fires the firearm, the cartridges 24 are discharged one at a time, and the remaining cartridges 24 are sequentially fed through the feed neck extension 308 into the firearm. The cartridges 24 are fed into the firearm by the tension in the power spring 64 because as each cartridge 24 is discharged from the firearm, there is space left in the feed neck extension 308 for the remaining cartridges 24 to move. The tension in the power spring 64 causes the drive sleeve 264 to rotate because of the rotational force applied to the power spring eyelet notch 272 from the spring 64. This rotational force is transferred to from the castle end 262 of the drive sleeve 264 to the drive pin 258, the drive shaft 244, the double flat key end 246 of the drive shaft 244, the spiral following cartridge drive arm 36, the spiral following cartridge drive arm pin 258, the cartridge follower assembly 474, and then to the cartridges 24. This causes each of the remaining cartridges 24 to move in the spiral channel 190 as the cartridges 24 moved from the feed neck extension 308 into the firearm by the bolt stop are discharged from the firearm.

Once all of the cartridges 24 are discharged, at least a portion of the cartridge follower assembly 474 moves into the feed neck extension 308. However, as the cartridge follower assembly 474 moves into the feed neck extension 308, the bolt stop actuator follower 480 moves into the feed neck extension 308 as well. The plunger 516 is biased by the dowel spring 514 to move away from the actuator follower dowel 508, but the plunger 516 is held inside the actuator follower bottom aperture 510 by the cartridge cover plate 60, a portion of the spiral cover plate 204 near the shortened neck portion 216, and the sidewall 350 of the feed neck extension 308. Once the bolt stop actuator follower 480 moves into the feed neck extension 308, and the small diameter portion 524 of the actuator follower bottom aperture 510 is in alignment with the channel 348, the shaft portion 520 of the plunger 516 moves into the channel 348 underneath the bolt stop actuator 352 because of the biasing force generated by the dowel spring 514.

Once the shaft portion 520 of the plunger 516 is located in the channel 348, and is underneath the first flat portion 354 of the bolt stop actuator 352, the shaft portion 520 moves the bolt stop actuator 352 upwardly as the cartridge follower assembly 474 moves upwardly in the feed neck extension 308. The bolt stop actuator 352 moves upwardly, but is limited in its upward movement by the roll pin 346 contacting the bottom of the elongated aperture 360. There are also two shell followers 478 between the bolt stop actuator follower 480 and the lead follower 476. The spacing created by the shell followers 478 between the bolt stop actuator follower 480 and the lead follower 476 is designed as such that when the bolt stop actuator follower 480 is located inside the feed neck extension 308 and the shaft portion 520 of the plunger 516 has moved the bolt stop actuator 352 to it upmost position, the lead follower 476 is positioned against the cartridge stop 434 and the feed lip 466. The bolt stop (not shown) of the firearm is then only allowed to move until the bolt stop contacts the bolt stop actuator 352. The limited movement of the bolt stop provides an indication to the user that all of the cartridges 24 have been discharged from the firearm, and the feed system 186 needs to be reloaded.

If the user decides to stop using the firearm, and there are still cartridges 24 in the system 186, but wishes to have the cartridges 24 remain in the feed system 186, the user simply pushes the clutch release push button 66 in the same manner as described in the previous embodiment. However, in this embodiment, the clutch release push button 66 is used to actuate the clutch assembly 194, instead of the encapsulated spring clutch mechanism 20, as with the previous embodiment. The user pushes the clutch release push button 66 to overcome the force applied to the clutch release push button return spring 92 in the clutch release push button pocket 68 formed as part of the cam stop winding knob 292. As the clutch release push button 66 is pressed, the force applied to the clutch release push button 66 is transferred to the drive shaft 244, and moves the drive shaft 244 axially within the drive sleeve 264 towards the spiral cover plate 204. The recessed portion 242 formed in the cover plate 204 provides room for the drive shaft 244 to move axially without contacting the cover plate 204.

As the drive shaft 244 is moved axially from the force applied to the clutch release push button 66, the drive pin 258 is moved out of the locking notches 260. Once the drive pin 258 is moved out of the locking notches 260, the drive sleeve 264 is allowed to rotate relative to the drive shaft 244. The tension in the power spring 64 causes the drive sleeve 264 to rotate, and as a result, the tension in the power spring 64 is relieved. As with the previous embodiment, this prevents the power spring 64 from permanently deforming, or developing a "set," improving the life of the power spring 64.

If the user decides to use the firearm again, the cam stop winding knob 292 is rotated to generate tension in the power spring 64 as previously described. However, if the drive pin 258 is not located in one of the locking notches 260, there are multiple locking notches 260 that the drive pin 258 may be received into. Therefore, when the cam stop winding knob 292 is rotated, if the drive pin 258 is not disposed in one of the locking notches 260, then as the cam stop winding knob 292 is rotated, the rotational force applied to the power spring 64 also rotates the drive sleeve 264. The drive sleeve 264 continues to rotate as the cam stop winding knob 292 is rotated until two of the locking notches 260 are in alignment with the drive pin 258. The clutch release button return spring 92 biases the clutch release push button 66, and therefore the drive shaft 244, away from the spiral cover plate 204; the drive pin 258 is consequently biased towards the castle end 262 of the drive sleeve 264. This causes the drive pin 258 to move into whichever of the locking notches 260 come into alignment with the drive pin 258 as the drive sleeve 264 is rotated. Once the drive pin 258 has moved into a pair of the locking notches 260, the drive sleeve 264 is prevented from rotating, and tension is generated in the power spring 64 as the cam stop winding knob 292 is rotated as described above.

It should be noted that if the spiral channel 190 were not completely full of cartridges 24 when the cartridges 24 are loaded, when the cam stop winding knob 292 is rotated, the rotational force is transferred through the various components as described above, but the drive sleeve 264, drive shaft 244, spiral following cartridge drive arm 36, and the cartridge cover plate 60 also rotate, and the spiral following cartridge drive arm pin 58 moves the cartridge follower assembly 474 and the cartridges 24 in the spiral channel 190 until the one of the cartridges 24 contacts the cartridge stop 434 and the feed lip 466. Once a cartridge 24 contacts the cartridge stop 434 and feed lip 466, the cartridges 24 are prevented from further movement unless the firearm is fired, and therefore, the reactionary force is generated, and tension is generated in the power spring 64 as described above.

After the feed system 186 has been loaded, if it is desired to remove the cartridge 24 from the system 186, the system 186 is easily unloaded by removing the spiral cover plate 204, the spiral following cartridge drive arm 36, and the cartridge cover plate 60 in the manner previously described. Once these components have been detached from the system 186, the firearm cartridges 24 are spilled out.

While it has been shown that the feed neck extension 308 is substantially straight, FIGS. 50A and 51A-52C show alternate embodiments of the feed neck extension 308 having the sidewalls 350,362,392,394 as well as the rear flange 314, the side flanges 316,318, and the front flange 322 shaped differently such that when the feed neck extension 308 is connected to the body 188, the body 188 is angled relative to the feed neck extension 308. There are some applications where it is preferable for a firearm to be of a reduced height, and when the body 188 of the ammunition feed system 186 is angled as shown in FIGS. 50A and 51A-52C, the overall height of the firearm is reduced, making the firearm more compact. For example, in FIGS. 50A and 51A-51B, the body 188 is located at an angle 534 of ten degrees from vertical. In FIG. 52B, the body 188 is located at an angle 536 of forty-five degrees from vertical, and in FIG. 52C, the body 188 is located at an angle 538 of ninety-degrees from vertical. It is also within the scope of the invention that the feed neck extension 308 may be manufactured in a manner to position the body 188 at any desired angle relative to the firearm.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. A high capacity ammunition feeding system for use with a firearm, comprising:

a body portion having a channel and a neck portion, one or more firearm cartridges being selectively disposed in said channel;

a feed neck extension selectively connected to said body portion, said feed neck extension operable for transferring said one or more firearm cartridges from said body portion into a firearm, said feed neck extension further comprising one of a plurality of feed neck extensions operable for being selectively inserted into a magazine well of said firearm, and each of said plurality of feed neck extensions shaped so as to position said body portion at an angle relative to said firearm;

a spiral following clutch drive arm operable for moving said one or more firearm cartridges from said channel into said feed neck extension;

a cam stop winding knob connected to said body portion, and operable for rotation relative to said body portion in one direction;

a biasable member operable for transferring rotational force from said cam stop winding knob to said spiral following clutch drive arm;

a double lock latch selectively connected to said neck portion and operable for maintaining the connection between said feed neck extension and said magazine well;

a sidewall formed as part of said body portion, said sidewall operable to facilitate loading of said one or more firearm cartridges into said channel;

wherein said body portion including said sidewall which protrudes outward from said channel, and operably functions as a loading bowl such that when said high capacity ammunition feeding system is disassembled said one or more firearm cartridges can be dumped into said body portion and surrounded by said sidewall and when reassembled said body portion is shaken by a user and each of said one or more firearm cartridges self-locate into the channel orientated for use.

2. The high capacity ammunition feeding system according to claim 1, further comprising, a cartridge cover plate; and at least one pedestal stop having a ledge, said at least one pedestal stop connected to said sidewall formed as part of said body portion, said cartridge cover plate is supported by said ledge of said at least on pedestal stop when said high capacity ammunition feeding system is assembled.

3. The high capacity ammunition feeding system according to claim 2, wherein said cartridge cover plate further comprises a pair of tabs, said spiral following clutch drive arm disposed between said tabs when said high capacity ammunition feeding system is assembled, and said spiral following clutch drive arm operable for applying rotational force to said pair of tabs.

4. The high capacity ammunition feeding system according to claim 1, further comprising:

a front wall formed as part of said neck portion;

an aperture formed as part of said front wall; and a darted feed latch connected to said feed neck extension, said darted feed latch operable for being inserted through said aperture formed as part of said front wall when said feed neck extension is connected to said neck portion.

5. The high capacity ammunition feeding system according to claim 1, further comprising a cartridge stop assembly operably connected to said feed neck extension for selectively prohibiting the discharge of said one or more firearm cartridges from said firearm.

6. The high capacity ammunition feeding system according to claim 5, said cartridge stop assembly further comprising:

a cartridge stop operable for properly orienting said one or more firearm cartridges in said feed neck extension, said cartridge stop operable for moving between an extended position and a retracted position;

a flat spring in contact with said cartridge stop, said flat spring operable for biasing said cartridge stop toward said extended position; and a cartridge stop guide section formed as part of said feed neck extension;

wherein said one or more cartridges are selectively loaded into said feed neck extension by placing said one or more firearm cartridges adjacent said cartridge stop guide section and said cartridge stop and applying a force to said one or more firearm cartridges to overcome the force of said flat spring, allowing said one or more firearm cartridges to be loaded into said feed neck extension.

7. The high capacity ammunition feeding system according to claim 6, said cartridge stop assembly further comprising:

an inner guide surface formed as part of said cartridge stop;

an outer guide surface formed as part of said cartridge stop;

a first cartridge stop guide surface formed as part of said cartridge stop guide section, said inner guide surface formed as part of said cartridge stop in sliding contact with said first cartridge stop guide surface;

a pocket formed as part of said feed neck extension, said cartridge stop slidably disposed in said pocket, and said flat spring disposed in said pocket; and an angled wall portion formed as part of said pocket, said angled wall portion having a second cartridge stop guide surface in sliding contact with said outer guide surface formed as part of said cartridge stop, said first cartridge stop guide surface and said second cartridge stop guide surface operable for guiding the movement of said cartridge stop between said extended position and said retracted position.

8. The high capacity ammunition feeding system according to claim 1, further comprising:

a cartridge follower assembly disposed in said channel, said cartridge follower assembly operable for being moved from said channel into said feed neck extension by said spiral following clutch drive arm; and a bolt stop actuator connected to said feed neck extension, said cartridge follower assembly is operable to move said bolt stop actuator from a retracted position to an extended position, providing an indication that all of said one or more firearm cartridges have been discharged from said firearm.

9. The high capacity ammunition feeding system according to claim 8, further comprising:

a feed neck extension guide rail formed as part of said feed neck extension;

a channel formed as part of said feed neck extension;

a slot formed as part of said feed neck extension guide rail, said slot formed as part of said feed neck extension guide rail adjacent said channel, and said bolt stop actuator slidably disposed in said slot such that said cartridge follower assembly is operable to move said bolt stop actuator from said retracted position to said extended position.

10. The high capacity ammunition feeding system according to claim 9, further comprising:

an aperture formed as part of said feed neck extension guide rail; and a roll pin partially disposed in said aperture formed as part of said feed neck extension guide rail, said roll pin partially disposed in said elongated aperture formed as part of said first flat portion, said roll pin operable for limiting the movement of said bolt stop actuator between said retracted position and said extended position.

11. The high capacity ammunition feeding system according to claim 9, said bolt stop actuator further comprising:

a first flat portion slidably disposed in said slot;

an elongated aperture formed as part of said first flat portion;

a second flat portion substantially parallel to said first flat portion; and a third flat portion connected to both of said first flat portion and said second flat portion, said third flat portion being perpendicular to said first flat portion and said second flat portion, said third flat portion extending through said channel formed as part of said feed neck extension.

12. The high capacity ammunition feeding system according to claim 9, said cartridge follower assembly further comprising:

a lead follower;

at least one shell follower connected to said lead follower; and a bolt stop actuator follower connected to said at least one shell follower, said lead follower, said at least one shell follower, and said bolt stop actuator follower operable for movement between said channel and said feed neck extension such that said bolt stop actuator follower is operable to actuate said bolt stop actuator when said bolt stop actuator follower is located in said feed neck extension.

13. The high capacity ammunition feeding system according to claim 12, said bolt stop actuator follower further comprising:

an actuator follower top;

an actuator follower bottom selectively connected to said actuator follower top; and a plunger slidably disposed in said actuator follower bottom, at least a portion of said plunger protrudes out of said actuator follower bottom through said channel formed as part of said feed neck extension into said slot formed as part of said feed neck extension guide rail when said cartridge follower assembly is at least partially located in said feed neck extension and said plunger is in alignment with said channel formed as part of said feed neck extension, thereby causing said bolt stop actuator to move in said slot formed as part of said feed neck extension guide rail and partially protrude out of said slot formed as part of said feed neck extension guide rail as said cartridge follower assembly moves in said feed neck extension.

14. The high capacity ammunition feeding system according to claim 13, said bolt stop actuator follower further comprising:

an actuator follower top aperture formed as part of said actuator follower top;

an actuator follower bottom aperture formed as part of said actuator follower bottom, said actuator follower bottom aperture having a large diameter portion, a small diameter portion, and a retainer surface;

an enlarged diameter portion formed as part of said plunger, said enlarged diameter portion slidably disposed in said large diameter portion of said actuator follower bottom aperture;

a shaft portion formed as part of said plunger, said shaft portion slidably disposed in said small diameter portion of said actuator follower bottom aperture an actuator follower dowel partially disposed in said actuator follower top aperture and said actuator follower bottom aperture; and a dowel spring disposed on said actuator follower bottom aperture between said enlarged diameter portion of said plunger and said actuator follower dowel;

wherein said dowel spring is operable for biasing said plunger toward an extended position such that when shaft portion of said plunger is in alignment with said channel formed as part of said feed neck extension, said plunger moves toward said extended position, and said enlarged diameter portion of said plunger contacts said retainer surface, and said shaft portion of said plunger is in contact with said bolt stop actuator.

15. The high capacity ammunition feeding system according to claim 1, further comprising:

a magazine catch channel having a lower ledge, said magazine catch channel formed as a portion of said magazine well;

a double lock latch hook formed as part of said double lock latch, said double lock latch hook having a shoulder surface, said shoulder surface of said double lock latch hook selectively in contact with said lower ledge of said magazine catch channel; and an elongated sliding mechanism slidably disposed in said magazine catch channel such that when said elongated sliding mechanism is moved in said magazine catch channel, said elongated sliding mechanism contacts and moves said double lock latch hook, causing said shoulder surface of said double lock latch hook to no longer be in contact with said lower ledge of said magazine catch channel, allowing said feed neck extension to be removed from said magazine well.

16. The high capacity ammunition feeding system according to claim 15, further comprising:

a double latch retainer hook formed as part of said double lock latch, said double lock latch retainer hook having a shoulder surface, said double latch retainer hook formed as part of said double lock latch;

a lower channel formed as part of said neck portion, said double lock latch retainer hook selectively disposed in said lower channel formed as part of said neck portion; and a double lock latch disassembly opening formed as part of said neck portion adjacent to said lower channel formed as part of said neck portion, a portion of said double latch retainer hook being exposed in said double lock latch disassembly opening such that said shoulder surface of said double lock latch retainer hook is in contact with an upper surface of said lower channel formed as part of said neck portion such that when a force is applied to said portion of said double latch retainer hook exposed in said double lock latch disassembly opening, said double lock latch is moved such that said shoulder surface of said double lock latch retainer hook is no longer in contact with said upper surface of said lower channel formed as part of said neck portion, allowing said double lock latch to be removed from said lower channel formed as part of said neck portion.

17. The high capacity ammunition feeding system of claim 1, further comprising, a clutch assembly, wherein said biasable member is operable for transferring rotational force from said cam stop winding knob to said spiral following clutch drive arm such that when said one or more firearm cartridges are prevented from moving into said firearm by said feed neck extension and said cam stop winding knob is rotated, rotational force is transferred through said biasable member to said spiral following clutch drive arm, and tension builds in said biasable member, and as said one or more firearm cartridges are discharged from said firearm, tension in said biasable member rotates said spiral following clutch drive arm, thereby moving said one or more firearm cartridges in said channel and said feed neck extension; and wherein said clutch assembly is operable for transferring rotational force from said biasable member to said spiral following clutch drive arm, said clutch assembly operable for anchoring said biasable member.

18. The high capacity ammunition feeding system of claim 17, said clutch assembly further comprising:

a drive shaft extending through said body portion and operable for transferring rotational force to said spiral clutch following drive arm; and a drive sleeve disposed in said body portion, and said drive shaft slidably disposed in said drive sleeve such that said drive sleeve selectively transfers rotational force from said biasable member to said drive shaft, and said biasable member anchored by said drive sleeve.

19. The high capacity ammunition feeding system of claim 18, said clutch assembly further comprising:

a double flat key end formed as part of said drive shaft, said double flat key end operable for transferring rotational force to said spiral following cartridge drive arm;

a drive pin operably connected to said drive shaft;

a castle end formed as part of said drive sleeve;

a plurality of locking notches formed as part of said castle end, said drive pin selectively disposed in one or more of said plurality of locking notches, and as said drive shaft moves in said drive sleeve, said drive pin is removed from said one or more of said plurality of locking notches, allowing any tension in said biasable member to rotate said drive sleeve relative to said drive shaft, relieving any tension in said biasable member; and a power spring eyelet notch formed as part of said drive sleeve, said power spring eyelet notch operable for anchoring an end of said biasable member.

20. The high capacity ammunition feeding system according to claim 19, further comprising:

a power spring drive shaft compartment formed as part of said body portion;

a power spring pocket formed as part of said cam stop winding knob, said biasable member disposed in said power spring pocket;

at least one cam stop bearing pocket formed on an outer wall of said power spring pocket; and at least one cam stop bearing disposed in said cam stop bearing pocket, said cam stop winding knob is at least partially disposed in said power spring drive shaft compartment such that said at least one cam stop bearing is selectively in contact with an inner wall formed as part of said power spring drive shaft compartment, allowing said cam stop winding knob to rotate in only one direction.

21. The high capacity ammunition feeding system according to claim 20, further comprising:

a power spring drive shaft push button opening formed as part of said power spring pocket;

a clutch release push button pocket formed as part of said cam stop winding knob, said power spring drive shaft push button opening also formed as part of said clutch release push button pocket such that an end of said drive shaft extends through said power spring drive shaft push button opening and is positioned in said clutch release push button pocket;

a clutch release push button disposed in said clutch release push button pocket, said clutch release push button is located on a power spring primary drive shaft push button end of said drive shaft; and a clutch release push button return spring disposed in said clutch release push button pocket and in contact with said clutch release push button such that when said clutch release push button is pressed to overcome the force of said clutch release push button return spring, said drive shaft slides through said drive sleeve and said drive pin is removed from said plurality of locking notches, allowing said biasable member to rotate said drive sleeve relative to said drive shaft, releasing any tension in said biasable member.

22. The high capacity ammunition feeding system according to claim 21, further comprising a lower surface formed as part of said clutch release push button, said clutch release push button return spring disposed between said lower surface formed as part of said clutch release push button and a contact surface formed as part of said clutch release push button pocket, said clutch release push button return spring operable for biasing said clutch release push button away from said contact surface of said clutch release push button pocket.

23. The high capacity ammunition feeding system according to claim 21, further comprising:

a firewall formed as part of said body portion, said firewall separating a side of said body portion having said power spring drive shaft compartment and another side of said body portion having said channel;

a drive shaft opening formed as part of said firewall, said drive sleeve rotatably disposed in said drive shaft opening; and a clutch pocket formed as part of said side of said body portion having said channel, said channel substantially surrounding said clutch pocket, and said drive shaft of said clutch assembly located in said drive shaft opening such that said drive shaft is partially disposed in said clutch pocket, and said drive shaft extends into said power spring drive shaft compartment such that said drive shaft also extends into said power spring drive shaft push button opening formed as part of said power spring pocket.

24. The high capacity ammunition feeding system according to claim 20, said cam stop winding knob further comprising a cam stop friction race formed on an outer periphery of said power spring pocket, said cam stop friction race in sliding contact with said firewall formed as part of said body portion, reducing the amount of friction between said cam stop winding knob and said body portion.

25. The high capacity ammunition feeding system according to claim 19, further comprising:

an elongated aperture formed as part of said spiral following clutch drive arm, said double flat key end of said drive shaft extending through said elongated aperture formed as part of said spiral following clutch drive arm, allowing said spiral following clutch drive arm to move between a fully retracted position and a fully extended position;

a spiral following clutch drive arm pin connected to said spiral following clutch drive arm and extending into said channel formed in said body portion, said spiral following clutch drive arm pin in contact with and operable for moving said one or more firearm cartridges in said channel;

a cartridge cover plate having a secondary drive shaft center, said drive shaft operable for extending through said secondary drive shaft center and then through said elongated aperture formed as part of said spiral following clutch drive arm, and said cartridge cover plate disposed between said spiral following clutch drive arm and said channel, maintaining said one or more firearm cartridges in said channel; and an elongated aperture formed as part of said cartridge cover plate, said spiral following clutch drive arm positioned on said cartridge cover plate, thereby allowing said spiral following clutch drive arm pin to extend through said elongated aperture formed as part of said cartridge cover plate into said channel formed as part of said body portion.

26. The high capacity ammunition feeding system according to claim 1, further comprising:

a spiral cover operable for attachment to said body portion for maintaining the assembly of said spiral following clutch drive arm and a cartridge cover plate;

a recessed portion formed as part of said spiral cover, said drive shaft operable for selectively moving into said recessed portion of said spiral cover, and a spiral cover retaining strap having a first portion selectively connected to said spiral cover, and a second portion connected to said body portion.

27. The high capacity ammunition feeding system according to claim 1, wherein said channel is a spiral channel formed as part of said body portion.

28. A high capacity ammunition feeding system for use with a firearm, comprising:

a body portion having a channel and a neck portion, one or more firearm cartridges being selectively disposed in said channel, wherein said channel is a spiral channel formed as part of said body portion;

a feed neck extension selectively connected to said body portion, said feed neck extension operable for transferring said one or more firearm cartridges from said body portion into a firearm, said feed neck extension further comprising one of a plurality of feed neck extensions operable for being selectively inserted into a magazine well of said firearm, and each of said plurality of feed neck extensions shaped so as to position said body portion at an angle relative to said firearm;

a spiral following clutch drive arm operable for moving said one or more firearm cartridges from said channel into said feed neck extension;

a cam stop winding knob connected to said body portion, and operable for rotation relative to said body portion in one direction;

a clutch assembly;

a biasable member operable for being anchored by said cam stop winding knob and said clutch assembly, said clutch assembly is operable for transferring rotational force from said biasable member to said spiral following clutch drive arm, said clutch assembly operable for anchoring said biasable member;

a double lock latch selectively connected to said neck portion and operable for maintaining the connection between said feed neck extension and said magazine well;

a sidewall formed as part of said body portion, said sidewall operable to facilitate loading of said one or more firearm cartridges into said spiral channel;

a magazine catch channel having a lower ledge, said magazine catch channel formed as a portion of said magazine well;

a double lock latch hook formed as part of said double lock latch, said double lock latch hook having a shoulder surface, said shoulder surface of said double lock latch hook selectively in contact with said lower ledge of said magazine catch channel; and an elongated sliding mechanism slidably disposed in said magazine catch channel such that when said elongated sliding mechanism is moved in said magazine catch channel, said elongated sliding mechanism contacts and moves said double lock latch hook, causing said shoulder surface of said double lock latch hook to no longer be in contact with said lower ledge of said magazine catch channel, allowing said feed neck extension to be removed from said magazine well; and wherein said body portion including said sidewall which protrudes outward from said spiral channel such that said one or more firearm cartridges can be dumped into said body portion and surrounded by said sidewall and when said body portion is shaken by a user, each of said one or more firearm cartridges self-locate into the spiral channel orientated for use.

29. A high capacity ammunition feeding system for use with a firearm, comprising:

a body portion having a channel and a neck portion, one or more firearm cartridges being selectively disposed in said channel, wherein said channel is a spiral channel formed as part of said body portion;

a feed neck extension selectively connected to said body portion, said feed neck extension operable for transferring said one or more firearm cartridges from said body portion into a firearm, said feed neck extension further comprising one of a plurality of feed neck extensions operable for being selectively inserted into a magazine well of said firearm, and each of said plurality of feed neck extensions shaped so as to position said body portion at an angle relative to said firearm;

a spiral following clutch drive arm operable for moving said one or more firearm cartridges from said channel into said feed neck extension;

a cam stop winding knob connected to said body portion, and operable for rotation relative to said body portion in one direction;

a clutch assembly;

a biasable member operable for being anchored by said cam stop winding knob and said clutch assembly, said clutch assembly is operable for transferring rotational force from said biasable member to said spiral following clutch drive arm, said clutch assembly operable for anchoring said biasable member;

a double lock latch selectively connected to said neck portion and operable for maintaining the connection between said feed neck extension and said magazine well;

a sidewall formed as part of said body portion, said sidewall operable to facilitate loading of said one or more firearm cartridges into said spiral channel;

a magazine catch channel having a lower ledge, said magazine catch channel formed as a portion of said magazine well;

a double lock latch hook formed as part of said double lock latch, said double lock latch hook having a shoulder surface, said shoulder surface of said double lock latch hook selectively in contact with said lower ledge of said magazine catch channel; and an elongated sliding mechanism slidably disposed in said magazine catch channel such that when said elongated sliding mechanism is moved in said magazine catch channel, said elongated sliding mechanism contacts and moves said double lock latch hook, causing said shoulder surface of said double lock latch hook to no longer be in contact with said lower ledge of said magazine catch channel, allowing said feed neck extension to be removed from said magazine well;

a cartridge cover plate;

at least one pedestal stop having a ledge, said at least one pedestal stop connected to said sidewall formed as part of said body portion, said cartridge cover plate is supported by said ledge of said at least on pedestal stop when said high capacity ammunition feeding system is assembled;

a double latch retainer hook formed as part of said double lock latch, said double lock latch retainer hook having a shoulder surface, said double latch retainer hook formed as part of said double lock latch;

a lower channel formed as part of said neck portion, said double lock latch retainer hook selectively disposed in said lower channel formed as part of said neck portion; and a double lock latch disassembly opening formed as part of said neck portion adjacent to said lower channel formed as part of said neck portion, a portion of said double latch retainer hook being exposed in said double lock latch disassembly opening such that said shoulder surface of said double lock latch retainer hook is in contact with an upper surface of said lower channel formed as part of said neck portion such that when a force is applied to said portion of said double latch retainer hook exposed in said double lock latch disassembly opening, said double lock latch is moved such that said shoulder surface of said double lock latch retainer hook is no longer in contact with said upper surface of said lower channel formed as part of said neck portion, allowing said double lock latch to be removed from said lower channel formed as part of said neck portion; and wherein said body portion including said sidewall which protrudes outward from said spiral channel such that said one or more firearm cartridges can be dumped into said body portion and surrounded by said sidewall and when said body portion is shaken by a user, each of said one or more firearm cartridges self-locate into the spiral channel orientated for use.

* * * * *

UNITED STATES PATENT AND TRADEMARK OFFICE

CERTIFICATE OF CORRECTION

PATENT NO. : 8,733,224 B2
APPLICATION NO. : 13/874001
DATED : May 27, 2014
INVENTOR(S) : Andrea J. Lasichak, Thomas E. Quetschke and Kenneth D. Woodard It is certified that error appears in the above-identified patent and that said Letters Patent is hereby corrected as shown below:

In the Claims:

Column 27, Line 12, “on” should be --one--

Column 34, Line 49, “on” should be --one--

Signed and Sealed this
Ninth Day of September, 2014

Michelle K. Lee

Michelle K. Lee
*Deputy Director of the United States Patent and Trademark Office*